US011787672B2

(12) United States Patent
Kudara

(10) Patent No.: US 11,787,672 B2
(45) Date of Patent: Oct. 17, 2023

(54) LATTICE STRUCTURE, LATTICE STRUCTURE COUPLING BODY, WORK MACHINE, AND CONNECTOR

(71) Applicant: KOBELCO CONSTRUCTION MACHINERY CO., LTD., Hiroshima (JP)

(72) Inventor: Kazufumi Kudara, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 371 days.

(21) Appl. No.: 17/054,979

(22) PCT Filed: Apr. 23, 2019

(86) PCT No.: PCT/JP2019/017123
§ 371 (c)(1),
(2) Date: Nov. 12, 2020

(87) PCT Pub. No.: WO2019/220881
PCT Pub. Date: Nov. 21, 2019

(65) Prior Publication Data

US 2021/0214195 A1 Jul. 15, 2021

(30) Foreign Application Priority Data

May 18, 2018 (JP) ..... 2018-096179
Feb. 14, 2019 (JP) ..... 2019-024682

(51) Int. Cl.
*B66C 23/00* (2006.01)
*B66C 23/26* (2006.01)
*B66C 23/70* (2006.01)

(52) U.S. Cl.
CPC ..... *B66C 23/26* (2013.01); *B66C 23/70* (2013.01); *B66C 2700/03* (2013.01)

(58) Field of Classification Search
CPC ..... B66C 23/26; B66C 23/346; B66C 23/365; B66C 23/42; B66C 23/68; B66C 23/70;
(Continued)

(56) References Cited

U.S. PATENT DOCUMENTS 2,559,741 A 7/1951 Wachsmann
3,323,660 A * 6/1967 Allin, Sr. ..... B66C 23/70 212/177
(Continued)

FOREIGN PATENT DOCUMENTS

CN 202848922 U 4/2013
CN 103723638 A 4/2014
(Continued)

OTHER PUBLICATIONS

Extended European Search Report dated Feb. 7, 2022 in European Patent Application No. 19804432.3, 10 pages.
(Continued)

*Primary Examiner* — Emmanuel M Marcelo
(74) *Attorney, Agent, or Firm* — Oblon, McClelland, Maier & Neustadt, L.L.P.

(57) ABSTRACT

A lattice structure is mounted on a work machine, and is detachably coupled to a counterpart lattice structure adjacent to the lattice structure. The lattice structure includes a connector to which an end portion of any main pipe among a plurality of main pipes is connected and to which an end portion of at least one inclined pipe among a plurality of inclined pipes is connected, the connector being detachably coupled to a counterpart connector included in a counterpart lattice structure.

18 Claims, 41 Drawing Sheets

(58) Field of Classification Search
CPC . B66C 23/708; B66C 2700/03; F16B 5/0004; F16B 7/0426
See application file for complete search history.

(56) References Cited

U.S. PATENT DOCUMENTS

| | | | | | |
|---|---|---|---|---|---|
| 3,511,388 | A * | 5/1970 | Markwardt | B66C 23/70 | 403/186 |
| 5,199,586 | A | 4/1993 | Pech et al. | | |
| 5,406,767 | A | 4/1995 | Pech et al. | | |
| 5,487,479 | A | 1/1996 | Pech et al. | | |
| 6,076,770 | A * | 6/2000 | Nygren | B64G 99/00 | 52/646 |
| 7,963,084 | B2 * | 6/2011 | Merrifield | E04C 3/005 | 52/645 |
| 8,528,291 | B2 | 9/2013 | Allred, III et al. | | |
| 8,739,988 | B2 * | 6/2014 | Walker | B66C 23/76 | 212/175 |
| 2006/0291952 | A1 * | 12/2006 | Wood | E04B 1/3211 | 403/217 |
| 2007/0044415 | A1 | 3/2007 | Merrifield et al. | | |
| 2009/0139948 | A1 * | 6/2009 | Holly | B66C 23/70 | 212/292 |
| 2014/0231374 | A1 * | 8/2014 | Foust | B66C 23/70 | 212/347 |

FOREIGN PATENT DOCUMENTS

| | | | | |
|---|---|---|---|---|
| CN | 204096967 | U | 1/2015 | |
| CN | 105197817 | A | 12/2015 | |
| CN | 105271021 | A | 1/2016 | |
| DE | 10 2012 221 031 | A1 | 5/2014 | |
| EP | 0 974 546 | A1 | 1/2000 | |
| EP | 1 468 955 | A1 | 10/2004 | |
| EP | 2746214 | A1 * | 6/2014 | B66C 23/70 |
| EP | 2 907 786 | A1 | 8/2015 | |
| JP | 49-138559 | U | 11/1974 | |
| JP | 60-61290 | U | 4/1985 | |
| JP | 5-208795 | A | 8/1993 | |
| JP | 6-239590 | A | 8/1994 | |
| JP | 7-69585 | A | 3/1995 | |
| JP | 2012062200 | A * | 3/2012 | B66C 23/70 |
| JP | 2013-193852 | A | 9/2013 | |

OTHER PUBLICATIONS

Combined Chinese Office Action and Search Report dated Apr. 18, 2022 in Chinese Patent Application No. 201980031544.5 (with English Summary translation), 11 pages.
International Search report dated Jul. 23, 2019 in PCT/JP2019/017123 filed Apr. 23, 2019, 2 pages.
Combined Chinese Office Action and Search Report dated Jan. 19, 2023, in corresponding Chinese Patent Application No. 201980031544.5 (with Partial English Translation and English Translation of Category of Cited Documents), 10 pages.

* cited by examiner (A)

(B)

(A)

(B)

LATTICE STRUCTURE, LATTICE STRUCTURE COUPLING BODY, WORK MACHINE, AND CONNECTOR

TECHNICAL FIELD

The present invention relates to a connector used in a lattice structure which a work machine includes.

BACKGROUND ART

In general, as a raising and lowering member for operation which is provided to a large-sized work machine, for example, a large-sized crane, a lattice arrangement which is light weight and has a high strength is adopted. A long raising and lowering member is formed of a plurality of lattice structures which are detachably coupled to each other for transportation of the raising and lowering member.

Patent Literature 1 discloses assemble-type boom members which can be formed by coupling and are used in a crane. The boom members includes a plurality of lattice structures which are coupled to each other ("boom butt", "boom insert sections", "boom top" in Patent Literature 1). Each lattice structure includes: a plurality of main pipes ("chord members" in Patent Literature 1); a plurality of inclined pipes which extend so as to be inclined with respect to an axial direction of a main pipe and are provided for coupling the plurality of main pipes to each other ("lattice members" in Patent Literature 1); and connectors each mounted on an end portion of the main pipe. Two lattice structures are coupled to each other by coupling the connectors to counterpart connectors each mounted on an end portion of another lattice structure adjacent to the lattice structure.

In the lattice structure described above, a plurality of triangular configurations (lattice arrangement) are continuously formed by the plurality of main pipes and the plurality of inclined pipes. Thus, it is possible to realize the lattice structure which is light weight and has a high strength.

As described in FIG. 2 of Patent Literature 1, a structure coupling portion where two lattice structures are coupled to each other is formed by arranging the connector and the counterpart connector coupled to the connector sequentially along an axial direction of the main pipe. Accordingly, end portions of two inclined pipes disposed with the structure coupling portion sandwiched therebetween along the axial direction of the main pipe are disposed at an interval which exceeds at least a length of the structure coupling portion, that is, a length in the axial direction of the connector coupling body which is formed of the connector and the counterpart connector. Accordingly, in the structure coupling portion, the above-mentioned triangular configurations (lattice arrangement) are not continuously formed and are interrupted. As a result, a strength of the structure coupling portion becomes low compared to a strength of a portion where the lattice structures are continuously formed and hence, deformation is likely to be generated locally at the structure coupling portion.

Usually, to suppress lowering of a strength of the above-mentioned structure coupling portion, for example, as shown in FIG. 2 in Patent Literature 1, an orthogonal pipe (frame member) which extends so as to be orthogonal to an axial direction of the main pipe is provided to end portions of the respective lattice structures. By coupling the plurality of main pipes at the end portions of the respective lattice structures by this orthogonal pipe, the structure coupling portion is reinforced.

However, when the orthogonal pipe is provided to the lattice structure in addition to the plurality of inclined pipes, the weight of the lattice structure is increased. Further, there is also a drawback that the number of man-hours for manufacturing the lattice structure is increased.

CITATION LIST

Patent Literature

Patent Literature 1: JPH05-208795 A

SUMMARY OF INVENTION

It is an object of the present invention to provide a lattice structure, a lattice structure coupling body, a work machine, and a connector which can suppress the increase of a weight of the lattice structure and the increase of the number of manufacturing man-hours and, at the same time, can also suppress the lowering of a strength at a structure coupling portion where the lattice structures are coupled to each other.

A lattice structure of the present invention is mounted on a work machine, and is detachably coupled to a counterpart lattice structure adjacent to the lattice structure. The lattice structure includes: a plurality of main pipes arranged at an interval in a radial direction; a plurality of inclined pipes extending so as to be inclined with respect to an axial direction of each of the plurality of main pipes, each of the plurality of inclined pipes coupling any two of the plurality of main pipes to each other; and a plurality of connectors detachably coupled to a plurality of counterpart connectors included in the counterpart lattice structure. The plurality of connectors include a predetermined connector to which an end portion of any one of the plurality of main pipes is connected, and to which an end portion of at least one of the plurality of inclined pipes is connected.

DESCRIPTION OF EMBODIMENTS

Hereinafter, embodiments of the present invention are described with reference to drawings.

[Work Machine]

Figure 1:
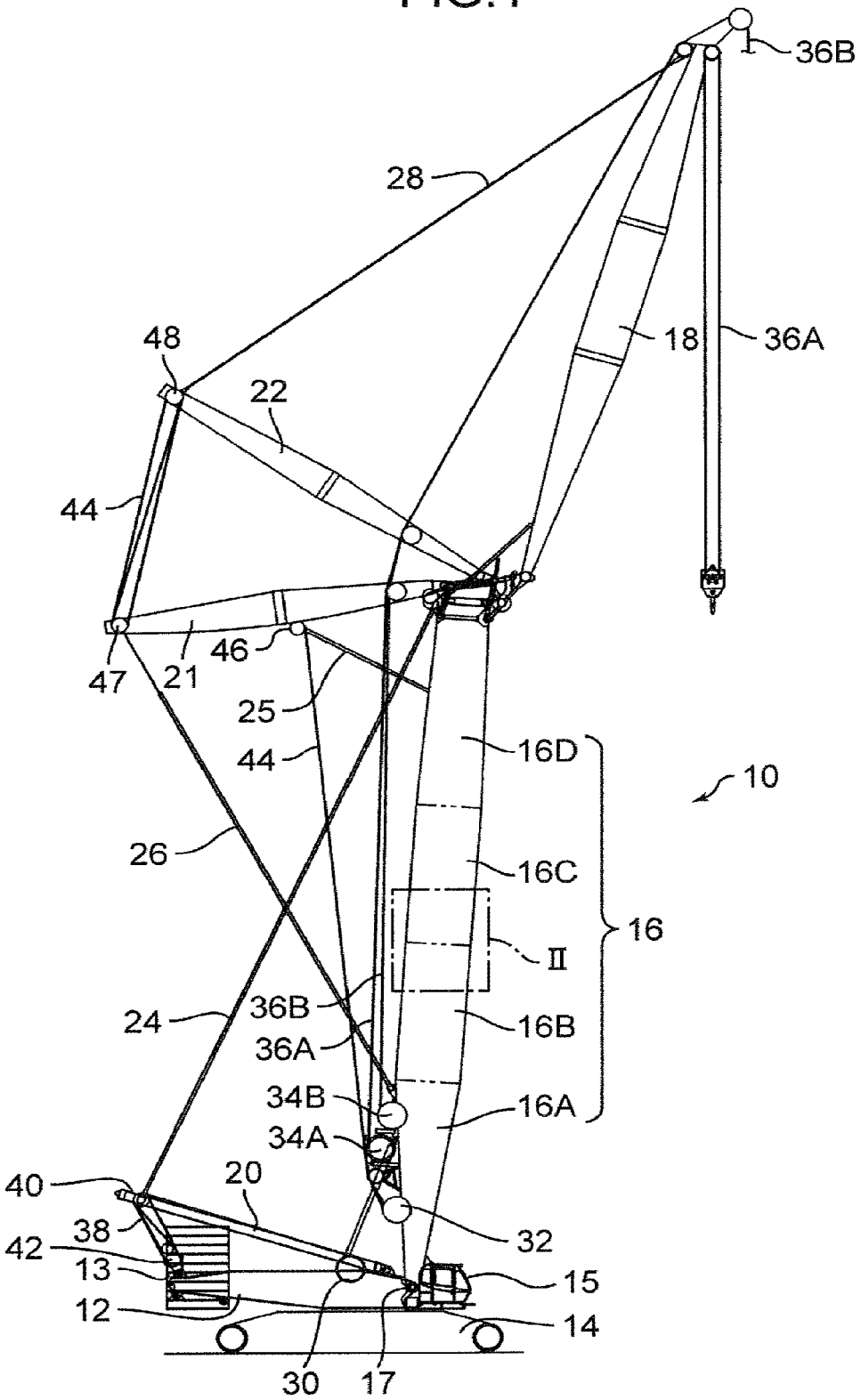
FIG. 1 is a side view showing a crane as a work machine according to an embodiment of the present invention.

FIG. 1 is a side view showing a crane 10 as a work machine according to the embodiment of the present invention. As shown in FIG. 1, the crane 10 includes: a lower traveling body 14 as a base body; an upper slewing body 12 slewably supported on the lower traveling body 14; a lattice boom 16; a jib 18; a mast 20; a rear strut 21; and a front strut 22. A counterweight 13 for adjusting the balance of the crane 10 is mounted on a rear portion of the upper slewing body 12, and a cab 15 which is a driver's cab is mounted on a front end portion of the upper slewing body 12.

The lattice boom 16 has a lower end portion which forms a boom foot 17, and is supported on a slewing frame of the upper slewing body 12 so as to be able to swing in a raising and lowering direction using the lower end portion as a fulcrum. The lattice boom 16 includes a plurality of lattice structures coupled to each other. The plurality of lattice structures include a first boom member 16A, a second boom member 16B, a third boom member 16C, and a fourth boom member 16D which are arranged sequentially in this order from a proximal end side.

The first boom member 16A is a proximal-end-side boom member, and has a proximal end portion including the boom foot 17, and a distal end portion on a side opposite to the proximal end portion. The boom foot 17 is swingably coupled to a front portion of the upper slewing body 12 in the raising and lowering direction.

The second to fourth boom members 16B, 16C, 16D are arranged sequentially in this order from a side near the first boom member 16A, and the boom members adjacent to each other in an arrangement direction of the boom members (that is, a longitudinal direction of the lattice boom 16) are detachably coupled to each other. That is, the second and third boom members 16B, 16C are intermediate boom members, and each have a proximal end portion detachably coupled to a boom member adjacent to a proximal end side thereof, and a distal end portion detachably coupled to a boom member adjacent to a distal end side thereof. The fourth boom member 16D is a distal-end-side boom member, and has a proximal end portion detachably coupled to a distal end portion of the third boom member 16C, and a distal end portion which forms an end portion on a side opposite to the proximal end portion and forming a distal end of the lattice boom 16.

The jib 18 is swingably coupled to the distal end of the lattice boom 16, that is, the distal end portion of the fourth boom member 16D. The mast 20, the rear strut 21, and the front strut 22 are members provided for swinging the jib 18.

The mast 20 has a proximal end portion supported on the upper slewing body 12 so as to be able to swing in the same direction as the raising and lowering direction of the boom 16, and a distal end portion on a side opposite to the proximal end portion. The distal end portion is coupled to the distal end of the boom 16 by way of a pair of left and right boom guylines 24.

The rear strut 21 and the front strut 22 are swingably supported on the distal end of the lattice boom 16. The rear strut 21 is held in a posture that the rear strut 21 protrudes toward a boom raising side (toward a left side in FIG. 1) from the distal end of the lattice boom 16 by a pair of left and right backstops 25 and a link 26. The front strut 22 is coupled to the jib 18 by way of a pair of left and right jib guylines 28 so as to swing in conjunction (integrally) with the jib 18.

A plurality of winches are mounted on the upper slewing body 12. The plurality of winches include a boom raising and lowering winch 30, a jib raising and lowering winch 32, a main winding winch 34A, and an auxiliary winding winch 34B.

The boom raising and lowering winch 30 swings the mast 20 by performing winding and feeding of a boom raising and lowering rope 38, thus raising and lowering the lattice boom 16. The boom raising and lowering rope 38 is extended between and wound around sheave blocks 40, 42 provided to a swing end portion of the mast 20 and a rear end portion of the upper slewing body 12, respectively.

The jib raising and lowering winch 32 swings the front strut 22 by performing winding and feeding of a jib raising and lowering rope 44 extended between and wound around the rear strut 21 and the front strut 22, thus raising and lowering the jib 18. The jib raising and lowering rope 44 is hooked on a guide sheave 46 disposed on an intermediate portion in a longitudinal direction of the rear strut 21, and is extended between and wound around sheave blocks 47, 48 provided to a swing end portion of the rear strut 21 and a swing end portion of the front strut 22, respectively.

The main winding winch 34A performs winding up and down of a suspended load suspended from a distal end of the jib 18 by way of a main winding rope 36A, and the auxiliary winding winch 34B performs winding up and down of a suspended load suspended from the distal end of the jib 18 by way of an auxiliary winding rope 36B.

[Lattice Structure Coupling Body]

In the crane 10 described above, the first to fourth boom members 16A to 16D which form the lattice boom 16 are lattice structures basically having substantially the same structure, Accordingly, the second boom member 16B and the third boom member 16C adjacent to the second boom member 16B are chosen among the first to fourth boom members 16A to 16D, and, the basic structures of the second boom member 16B and the third boom member 16C, and the structure for detachably coupling the second boom member 16B and the third boom member 16C to each other are described with reference to drawings.

Figure 2:
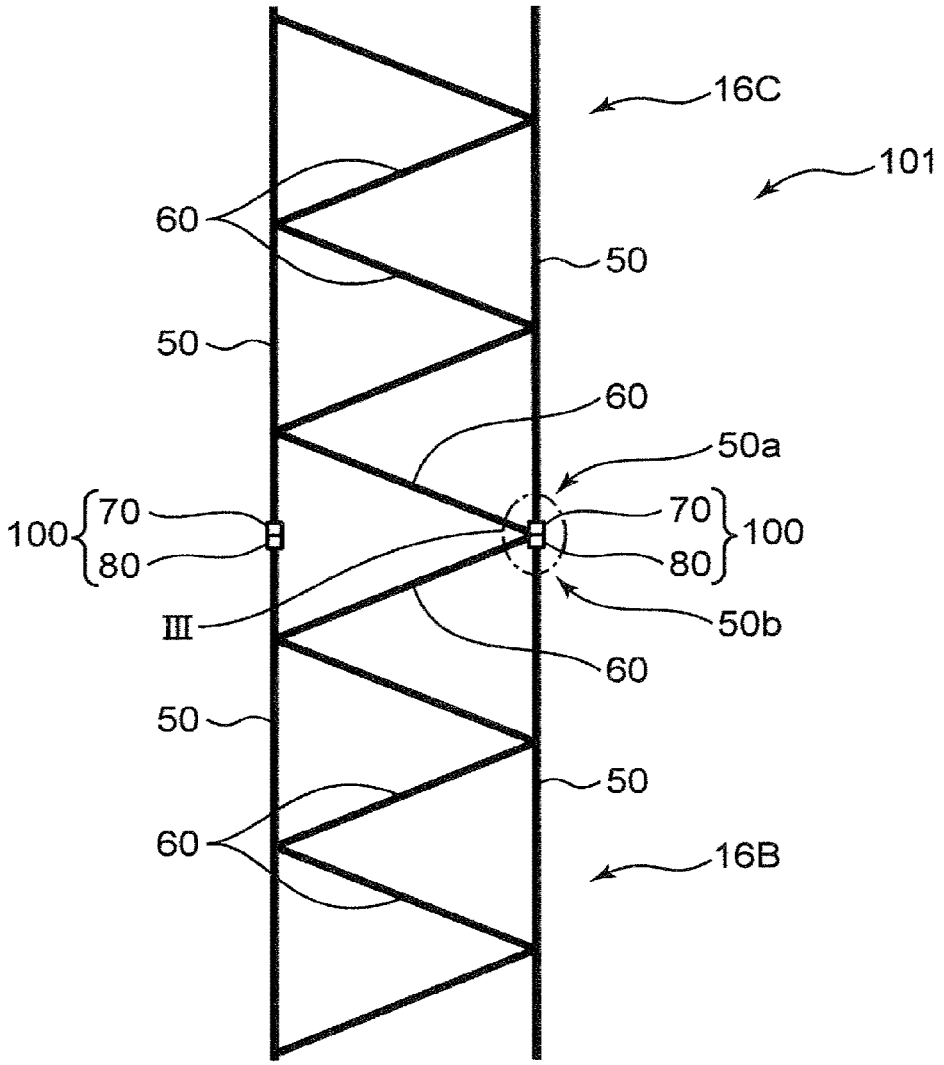
FIG. 2 is an enlarged view of a portion surrounded by a frame II in FIG. 1 and shows a lattice structure coupling body according to the embodiment of the present invention.

FIG. 2 is an enlarged view of a portion surrounded by a frame II in FIG. 1, and shows a lattice structure coupling body 101 according to the embodiment of the present invention. As shown in FIG. 2, the lattice structure coupling body 101 is constituted of the second boom member 16B and the third boom member 16C. In this embodiment, the lattice structure coupling body 101 forms a portion of the boom 16. However, the lattice structure coupling body 101 may form the whole boom 16. That is, the lattice structure coupling body is not limited to the lattice structure coupling body where two lattice structures are coupled to each other as in the case of this embodiment, and may be a lattice structure coupling body where three or more lattice structures are coupled to each other.

As shown in FIG. 2, the second boom member 16B includes a plurality of main pipes 50, a plurality of inclined pipes 60, and a plurality of connectors 80. The third boom member 16C includes a plurality of main pipes 50 (main members), a plurality of inclined pipes 60 (inclined members), and a plurality of connectors 70. The plurality of main pipes 50 and the plurality of inclined pipes 60 are joined to each other, thus forming a lattice arrangement. The connectors 70 and the connectors 80 form a connector coupling body 100 described later.

Each of the plurality of main pipes 50 is formed of a linearly extending tube member, and has a first end portion 50*a*, and a second end portion 50*b* on a side opposite to the first end portion 50*a*. The plurality of main pipes 50 are arranged at an interval in a radial direction of the main pipe 50. In other words, the plurality of main pipes 50 are arranged at an interval in a direction orthogonal to an axial direction of the main pipe 50. The plurality of main pipes 50 are disposed in a posture parallel to a direction along an axial direction of the lattice boom 16.

The plurality of main pipes 50 are disposed at positions corresponding to respective vertices of a polygonal shape having three or more vertices as viewed in the axial direction of the plurality of main pipes 50. The boom member 16B and the boom member 16C which form the lattice structure coupling body 101 according to the embodiment each include four main pipes 50 and hence, the plurality of main pipes 50 are disposed at positions corresponding to vertices of a quadrangular shape (for example, an approximately square shape). FIG. 2 is a view of the intermediate boom members 16B, 16C as viewed in a side view and hence, only two main pipes 50 out of four main pipes 50 are shown, and the illustration of other two main pipes 50 is omitted.

In this embodiment, a first end portion 50*a* of each main pipe 50 forms a proximal end portion positioned on a side close to the boom foot 17 of the lattice boom 16, and a second end portion 50*b* of each main pipe 50 forms a distal end portion positioned on a side close to a distal end of the lattice boom 16 on a side opposite to the proximal end portion.

The plurality of inclined pipes 60 are disposed so as to couple the neighboring main pipes 50 to each other. Each of the plurality of inclined pipes 60 is fowled of a structure member extending linearly (a tube member in this embodiment). Out of both end portions of each inclined pipe 60, one end portion is joined to one of the plurality of main pipes 50, and the other end portion is joined to the main pipe 50 adjacent to the main pipe 50 to which the one end portion is joined. Each inclined pipe 60 is disposed in a posture inclined with respect to the axial direction of the main pipe 50 so as to form the lattice arrangement which is advantageous in strength. That is, each inclined pipe 60 is disposed in a posture not parallel to the axial direction of the main pipe 50 and in a posture not orthogonal to the axial direction of the main pipe 50.

In the present invention, concepts of the "lattice structure" and the "counterpart lattice structure" are relative concepts. For example, when the third boom member 16C is assumed as the "lattice structure" according to the present invention, the second boom member 16B corresponds to the "counterpart lattice structure" according to the present invention. In this case, the main pipe 50 and the inclined pipe 60 which the third boom member 16C includes respectively correspond to the "main pipe" and the "inclined pipe" according to the present invention, the main pipe 50 and the inclined pipe 60 which the second boom member 16B includes respectively correspond to the "counterpart main pipe" and the "counterpart inclined pipe" according to the present invention, the connector 70 which the third boom member 16C includes corresponds to the "connector" according to the present invention, and the connector 80 which the second boom member 16B includes corresponds to the "counterpart connector" according to the present invention.

On the other hand, when the second boom member 16B is assumed as the "lattice structure" according to the present invention, the third boom member 16C corresponds to the "counterpart lattice structure". In this case, the main pipe 50 and the inclined pipe 60 which the second boom member 16B includes respectively correspond to the "main pipe" and the "inclined pipe" according to the present invention, the main pipe 50 and the inclined pipe 60 which the third boom member 16C includes respectively correspond to the "counterpart main pipe" and the "counterpart inclined pipe", the connector 80 which the second boom member 16B includes corresponds to the "connector" according to the present invention, and the connector 70 which the third boom member 16C includes corresponds to the "counterpart connector" according to the present invention.

[Connector Coupling Body]

The lattice structure coupling body 101 includes a plurality of connector coupling bodies 100. Each connector coupling body 100 is formed of the connector 70 and the connector 80 (counterpart connector). Each connector coupling body 100 is provided for detachably coupling the lattice structure (the third boom member 16C in this embodiment) and the counterpart lattice structure (the second boom member 16B in this embodiment) in the lattice boom 16 to each other. In this embodiment, the connector 70 which the connector coupling body 100 includes forms an end portion of the third boom member 16C, and the counterpart connector 80 which the connector coupling body 100 includes folios an end portion of the second boom member 16B. Since the connector 70 and the counterpart connector 80 are coupled to each other, the third boom member 16C and the second boom member 16B are coupled to each other.

The plurality of connectors 70 are disposed, on a one-by-one basis, on the first end portions 50*a* (proximal end portions) of the plurality of main pipes 50 which the third boom member 16C includes, and are joined to the first end portions 50*a* by welding, respectively. In the same manner, the plurality of connectors 80 (counterpart connectors) are disposed, on a one-by-one basis, on the second end portions 50*b* (distal end portions) of the plurality of main pipes 50 which the second boom member 16B includes, and are joined to the second end portions 50*b* by welding, respectively. Each of the plurality of connectors 70 is detachably coupled to the corresponding counterpart connector 80.

In this embodiment, the plurality of connector coupling bodies 100 have substantially the same structure and, as shown in FIG. 2, are in common with respect to a point that two main pipes 50 are connected to each connector coupling body 100. However, the plurality of connector coupling bodies 100 differ from each other in the following points. That is, the end portions of the inclined pipes 60 are positioned at an area where one connector coupling body 100 (the connector coupling body 100 on a right side in FIG. 2) is disposed and hence, the inclined pipes 60 (for example, two inclined pipes 60) are connected to the one connector coupling body 100. On the other hand, an end portion of the inclined pipe 60 is not positioned at an area where the other connector coupling body 100 (the connector coupling body 100 on a left side in FIG. 2) is disposed and hence, the inclined pipe 60 is not connected to the other connector coupling body 100.

Hereinafter, the specific structure of the connector coupling body 100, and the specific structures of the connector 70 and the counterpart connector 80 which form the connector coupling body 100 are exemplified.

First Embodiment

Figure 3:
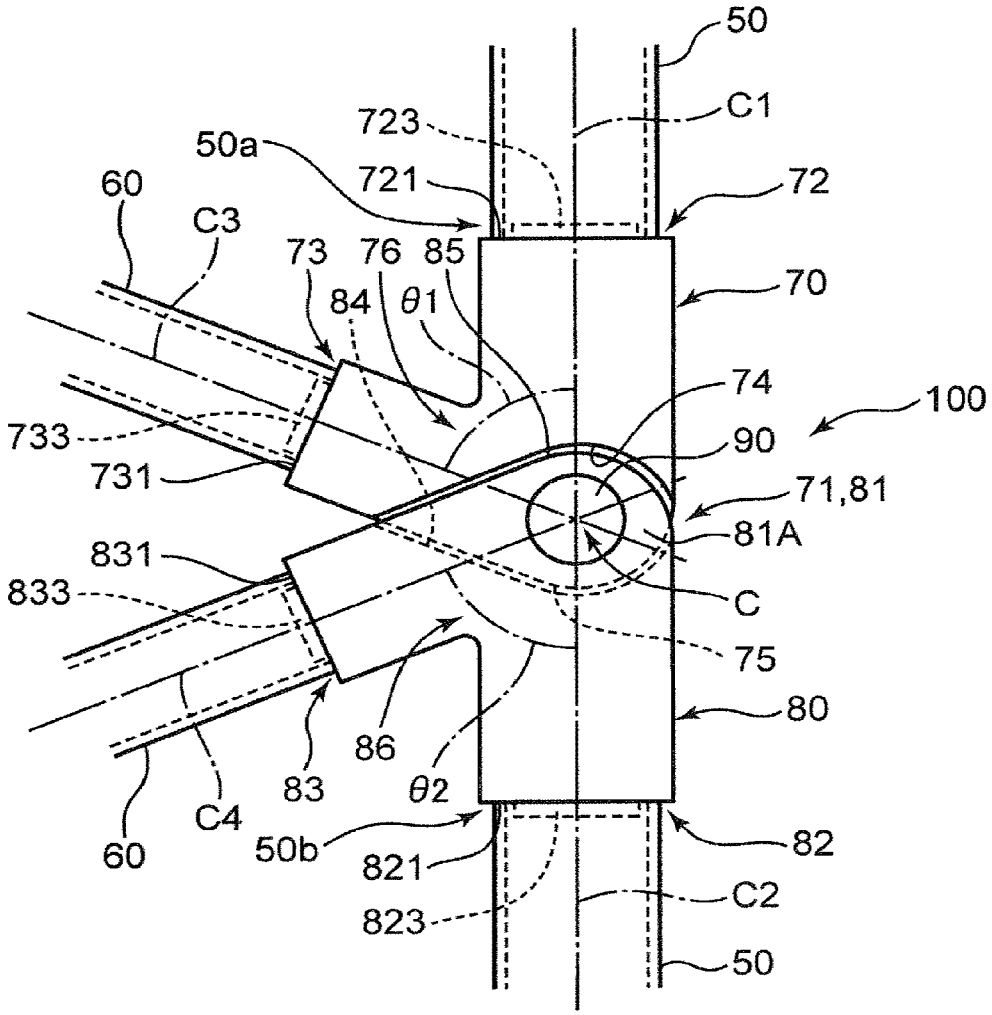
FIG. 3 is an enlarged view of a portion surrounded by a frame III in FIG. 2, and is a side view showing a connector coupling body which a lattice structure coupling body according to a first embodiment of the present invention includes, and main pipes and inclined pipes connected to the connector coupling body.
Figure 4:
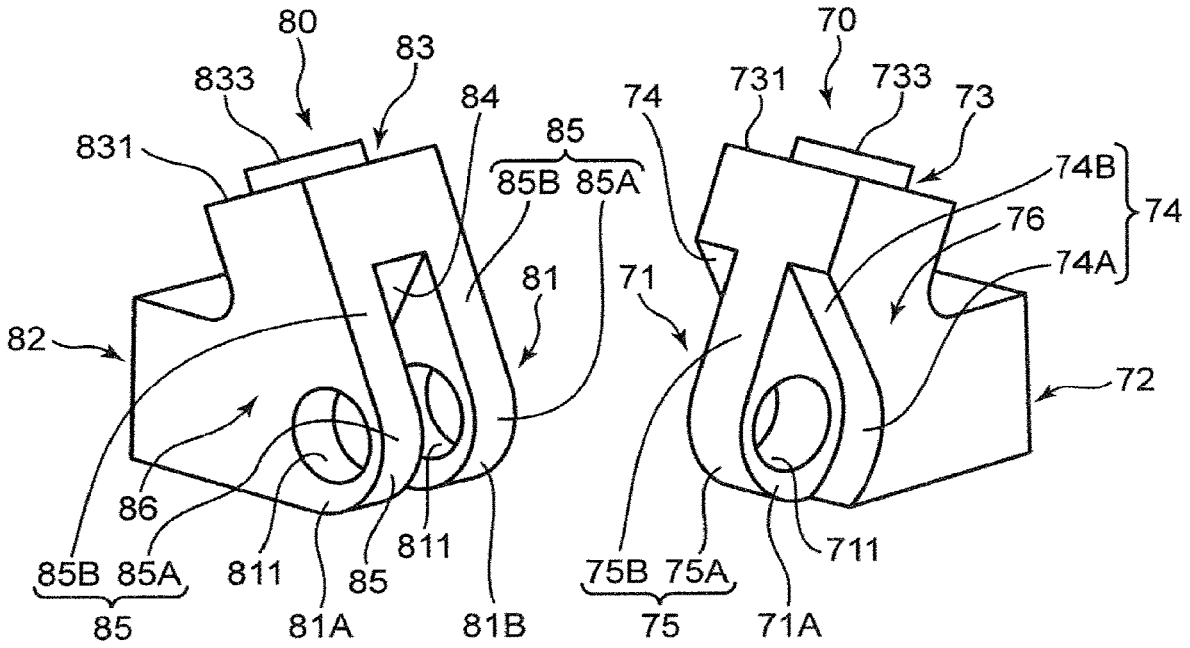
FIG. 4 is a perspective view showing a connector and a counterpart connector which form the connector coupling body shown in FIG. 3.
Figure 5:
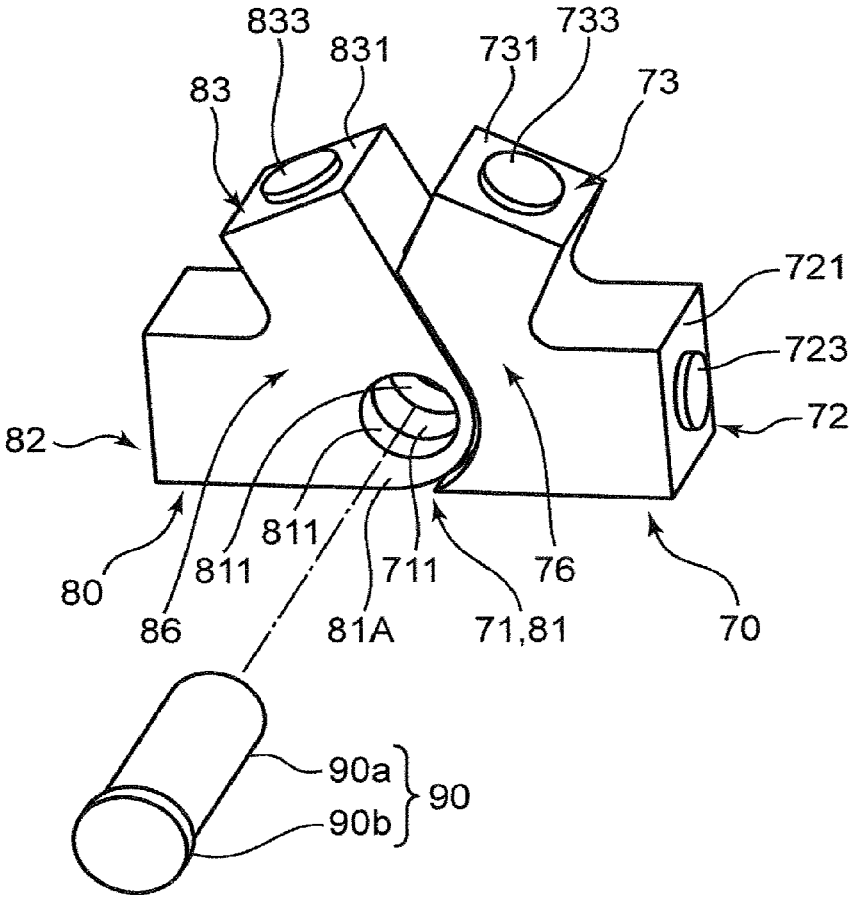
FIG. 5 is a perspective view showing a state where a coupling portion of the connector and a coupling portion of the counterpart connector shown in FIG. 4 engage with each other by fitting.
Figure 6:
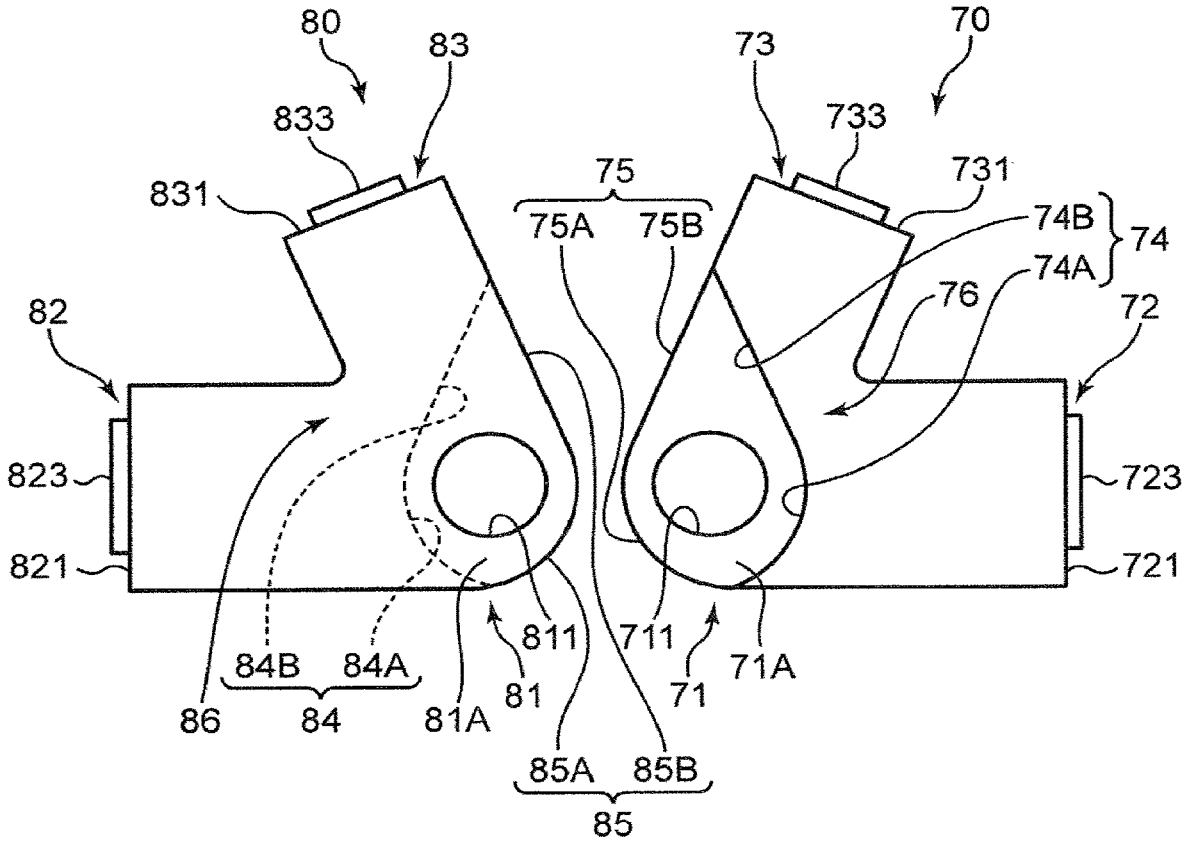
FIG. 6 is a side view showing the connector and the counterpart connector which form the connector coupling body shown in FIG. 3.

FIG. 3 is an enlarged view of a portion surrounded by a frame III in FIG. 2, and is a side view showing a connector coupling body 100 which a lattice structure coupling body 101 according to a first embodiment of the present invention includes, and main pipes 50 and inclined pipes 60 which are connected to the connector coupling body 100. FIG. 4 is a perspective view showing the connector 70 and the counterpart connector 80 which form the connector coupling body 100 shown in FIG. 3. FIG. 5 is a perspective view showing a state where a coupling portion 71 of the connector 70 and a coupling portion 81 of the counterpart connector 80 shown in FIG. 4 engage with each other by fitting. FIG. 6 is a side view showing the connector 70 and the counterpart connector 80 which form the connector coupling body 100 shown in FIG. 3.

As shown in FIG. 3 to FIG. 6, the connector 70 has a connector body portion 76 and a coupling portion 71. The connector body portion 76 includes a main pipe connecting portion 72, and an inclined pipe connecting portion 73. The connector body portion 76 has a size which allows the end portion of the main pipe 50 to be connected to the main pipe connecting portion 72 included in the connector body portion 76, and allows the end portion of the inclined pipe 60 to be connected to the inclined pipe connecting portion 73 included in the connector body portion 76.

In the same manner, the connector 80 has a connector body portion 86, and a coupling portion 81. The connector body portion 86 includes a main pipe connecting portion 82, and an inclined pipe connecting portion 83. The connector body portion 86 has a size which allows the end portion of the main pipe 50 to be connected to the main pipe connecting portion 82 included in the connector body portion 86, and allows the end portion of the inclined pipe 60 to be connected to the inclined pipe connecting portion 83 included in the connector body portion 86.

As shown in FIG. 6, the connector body portion 76 and the connector body portion 86 are each formed of a member having an approximately L shape as viewed in a side view, that is, a shape where the main pipe connecting portion 72 and the inclined pipe connecting portion 73 are branched from each other.

The coupling portion 71 of the connector 70 has a projection piece 71A. The projection piece 71A has an approximately flat plate shape in this embodiment. The projection piece 71A projects from an end surface 74 which is one of a plurality of end surfaces of the connector body portion 76 by a predetermined size.

The coupling portion 81 of the connector 80 has a pair of projection pieces 81A, 81B. The pair of projection pieces 81A, 81B each have an approximately flat plate shape in this embodiment. The pair of projection pieces 81A, 81B project from an end surface 84 which is one of a plurality of end surfaces of the connector body portion 86 by a predetermined size. The pair of projection pieces 81A, 81B are disposed with a gap having a size which allows the insertion of the projection piece 71A between the projection pieces 81A, 81B.

The projection piece 71A of the connector 70 is inserted between the pair of projection pieces 81A. 81B of the connector 80, and is detachably joined to the pair of projection pieces 81A, 81B by way of a coupling pin 90. That is, the projection piece 71A of the connector 70 forms the male-type coupling portion 71 which is detachably joined to the pair of projection pieces 81A, 81B of the connector 80, which form a counterpart connector, and the pair of projection pieces 81A, 81B form the female-type coupling portion 81.

Pin insertion holes 711, 811, 811 are respectively formed in the projection piece 71A and the pair of projection pieces 81A, 81B as shown in FIG. 4. These pin insertion holes 711, 811, 811 each have an inner diameter which allows the insertion of the coupling pin 90 into the pin insertion holes 711, 811, 811. As shown in FIG. 5, the positions of the pin insertion holes are set such that the projection piece 71A and the projection pieces 81A, 81B can be detachably joined to each other by allowing the coupling pin 90 to penetrate the projection piece 71A and the projection pieces 81A, 81B in a plate thickness direction, respectively, while passing through the pin insertion holes of the respective projection pieces in a state where the projection piece 71A and the projection pieces 81A, 81B overlap with each other in the plate thickness direction (direction orthogonal to the axial direction of the main pipe 50).

The main pipe connecting portion 72 has a shape which allows the connection between the main pipe connecting portion 72 and the end portion of the main pipe 50. Specifically, as shown in FIG. 5 and FIG. 6, the main pipe connecting portion 72 has an end surface 721 which is another one of the plurality of end surfaces of the connector body portion 76, and a projection 723 which projects from the end surface 721.

The end surface 721 is a flat surface which the end surface of the end portion 50*a* of the main pipe 50 faces, and is parallel to the end surface. In this embodiment, the end surface 721 of the main pipe connecting portion 72 and the end surface of the end portion 50*a* of the main pipe 50 are surfaces parallel to a plane orthogonal to the axial direction of the main pipe 50.

The end surface 721 also functions as a welding surface where welding for fixing the end portion 50*a* of the main pipe 50 to the main pipe connecting portion 72 is performed. Welding between the end portion 50*a* of the main pipe 50 and the main pipe connecting portion 72 is performed over the whole circumferences of the end portion 50*a* and the end surface 721. Thus, the welding can be performed under the same welding condition over the whole circumferences and hence, the same working condition can be adopted thus enhancing workability and also enhancing welding quality. The same applies for welding between the inclined pipe 60 and the inclined pipe connecting portion 73 described later. The main pipe connecting portion 72 and the inclined pipe connecting portion 73 described later are positioned away from each other and, further, the main pipe connecting portion 72 and the inclined pipe connecting portion 73 are also positioned away from the position of the coupling pin 90 and hence, the welding positions of two pipes 50, 60 can be positioned away from each other, thus further enhancing the workability.

The projection 723 has a shape which allows the insertion of the projection 723 into the inside of the end portion of the main pipe 50 with a slight gap. Specifically, the projection 723 has a circular columnar shape in this embodiment, and an outer diameter of the projection 723 is slightly smaller than an inner diameter of the end portion of the main pipe 50. Thus, the end portion of the main pipe 50 is supported by the projection 723 and hence, a connecting strength can be enhanced.

In the same manner as the main pipe connecting portion 72, the inclined pipe connecting portion 73 has a shape which allows the connection between the inclined pipe connecting portion 73 and the end portion of the inclined pipe 60. Specifically, as shown in FIG. 5 and FIG. 6, the inclined pipe connecting portion 73 has an end surface 731 which is yet another one of the plurality of end surfaces of the connector body portion 76, and a projection 733 which projects from the end surface 731.

The end surface 731 is a flat surface which the end surface of the end portion of the inclined pipe 60 faces, and is parallel to the end surface. In this embodiment, the end surface 731 of the inclined pipe connecting portion 73 and the end surface of the end portion of the inclined pipe 60 are surfaces parallel to a plane orthogonal to the axial direction of the inclined pipe 60. The end surface 731 also functions as a welding surface where welding for fixing the end portion of the inclined pipe 60 to the inclined pipe connecting portion 73 is performed.

The projection 733 has a shape which allows the insertion of the projection 733 into the inside of the end portion of the inclined pipe 60 with a slight gap. Specifically, the projection 733 has a circular columnar shape in this embodiment, and an outer diameter of the projection 733 is slightly smaller than an inner diameter of the end portion of the inclined pipe 60.

However, the shapes of the projections 723, 733 are not limited to the above-mentioned shapes. The projections 723, 733 may be formed of a plurality of projections arranged along an inner peripheral surface of the main pipe 50 and an inner peripheral surface of the inclined pipe 60, respectively, for example.

The main pipe connecting portion 82 has an end surface 821 which is another one of the plurality of end surfaces of the connector body portion 86, and a projection 823 which projects from the end surface 821. The inclined pipe connecting portion 83 has an end surface 831 which is another one of the plurality of end surfaces of the connector body portion 86, and a projection 833 which projects from the end surface 831. The configurations of the main pipe connecting portion 82 and the inclined pipe connecting portion 83 of the connector 80 are substantially equal to the configurations of the main pipe connecting portion 72 and the inclined pipe connecting portion 73 of the above-mentioned connector 70, respectively, and hence, the detailed explanation of the configurations of the main pipe connecting portion 82 and the inclined pipe connecting portion 83 is omitted.

The coupling pin 90 has a shaft portion 90*a* having a circular columnar shape which is inserted into the pin insertion holes 711, 811, 811, and a head portion 90*b* which is formed on one end of the shaft portion 90*a* and has an outer diameter larger than an outer diameter of the shaft portion 90*a*. The outer diameter of the shaft portion 90*a* of the coupling pin 90 is slightly smaller than inner diameters of the pin insertion holes 711, 811, 811, and the outer diameter of the head portion 90*b* of the coupling pin 90 is larger than the inner diameters of the pin insertion holes 711, 811, 811. A length of the shaft portion 90*a* of the coupling pin 90 is greater than a size obtained by overlapping the projection piece 71A and the projection pieces 81A, 81B in the plate thickness direction of these projection pieces.

The connector 70 is formed such that, as shown FIG. 3, when the connector 70 is viewed in a side view (when the connector 70 is viewed in an axial direction of the coupling pin 90), a center axis line C1 of the main pipe 50 which is connected to the main pipe connecting portion 72 and a center axis line C3 of the inclined pipe 60 which is connected to the inclined pipe connecting portion 73 intersect with each other at the center C of the coupling pin 90 (on a center axis line of the shaft portion 90*a*). The center axis line C1 of the main pipe 50 and the center axis line C3 of the inclined pipe 60 do not necessarily intersect with each other when the connector 70 is viewed stereoscopically (three-dimensionally), and it is sufficient that the center axis line C1 of the main pipe 50 and the center axis line C3 of the inclined pipe 60 intersect with each other when the connector 70 is depicted on a plane (two-dimensionally) as shown in FIG. 3. The same applies for a center axis line C2 and a center axis line C4 described next, and further, the same applies for modifications 1 to 4 and a second embodiment described later.

The connector 80 is formed such that, as shown FIG. 3, when the connector 80 is viewed in a side view (when the connector 80 is viewed in the axial direction of the coupling pin 90), the center axis line C2 of the main pipe 50 which is connected to the main pipe connecting portion 82 and the center axis line C4 of the inclined pipe 60 which is connected to the inclined pipe connecting portion 83 intersect with each other at the center C of the coupling pin 90.

In this embodiment, an angle θ1 formed by the center axis line C1 and the center axis line C3 shown in FIG. 3 is set to an acute angle, and an angle θ2 formed by the center axis line C2 and the center axis line C4 is also set to an acute angle. Specific values of these angles θ1, θ2 are not particularly limited, and are suitably set corresponding to properties required for the boom 16.

As shown in FIG. 4 and FIG. 6, the end surface 74 of the connector body portion 76 includes a guide surface 74A and a restricting surface 74B. The end surface 84 of the connector body portion 86 includes a guide surface 84A and a restricting surface 84B. The end surface 75 of the projection piece 71A of the connector 70 positioned on a distal end in the projecting direction includes a guide surface 75A and a restricting surface 75B. The end surfaces 85 of the pair of projection pieces 81A, 81B of the connector 80 positioned on the distal ends thereof in the protruding direction each have a guide surface 85A and a restricting surface 85B.

As shown in FIG. 5, in a fitting engagement state where the connector 70 and the connector 80 engage with each other by filling, the guide surface 74A and the guide surface 85A shown in FIG. 4 and FIG. 6 face each other in an adjacent state or in a contact state, and the restricting surface 74B and the restricting surface 85B face each other in an adjacent state or in a contact state. Further, in the fitting engagement state, the guide surface 75A and the guide surface 84A face each other in an adjacent state or in a contact state, and the restricting surface 75B and the restricting surface 84B face each other in an adjacent state or in a contact state.

In the fitting engagement state, these guide surfaces 74A, 75A, 84A, 85A are disposed at positions where the center axis line C1 and the center axis line C3 described above intersect with each other at a predetermined position (the center C of the coupling pin 90 in this embodiment), and the center axis line C2 and the center axis line C4 intersect with each other at a predetermined position (the center C of the coupling pin 90 in this embodiment).

The guide surface 74A and the guide surface 84A are concave curved surfaces which are curved in a circular arc shape, and the guide surface 75A and the guide surface 85A are convex curved surfaces which are curved in a circular arc shape. These curved surfaces have substantially equal radii of curvature, and are curved surfaces having a circular arc shape about an axis which coincides with the axial center of the coupling pin 90 which is inserted into the pin insertion holes 711, 811, 811. Accordingly, the connector 70 and the connector 80 are configured to be rotatable relative to each other about the axis while being guided by the guide surfaces 74A, 75A, 84A, 85A.

In a use state where the center axis line C1 of the main pipe 50 connected to the connector 70 and the center axis line C2 of the main pipe 50 connected to the connector 80 are positioned on substantially the same straight line (a state shown in FIG. 3), the restricting surface 74B and the restricting surface 85B are flat surfaces extending in the same direction from one end portions (upper end portions in FIG. 6) of the circular-arc-shaped guide surface 74A and the circular-arc-shaped guide surface 85A as shown in FIG. 6, and the restricting surface 75B and the restricting surface 84B are flat surfaces extending in the same direction from one end portions (upper end portions in FIG. 6) of the circular-arc-shaped guide surface 75A and the circular-arc-shaped guide surface 84A as shown in FIG. 6 in the use state.

In this embodiment, in the use state, the restricting surface 74B and the restricting surface 85B face each other in an adjacent state or in a contact state, and the restricting surface 75B and the restricting surface 84B face each other in an adjacent state or in a contact state. Accordingly, it is possible to restrict the relative rotation of the connector 70 and the connector 80 in a direction in which the inclined pipe 60 connected to the connector 70 and the inclined pipe 60 connected to the connector 80 further approach each other from the use state.

Figure 16:
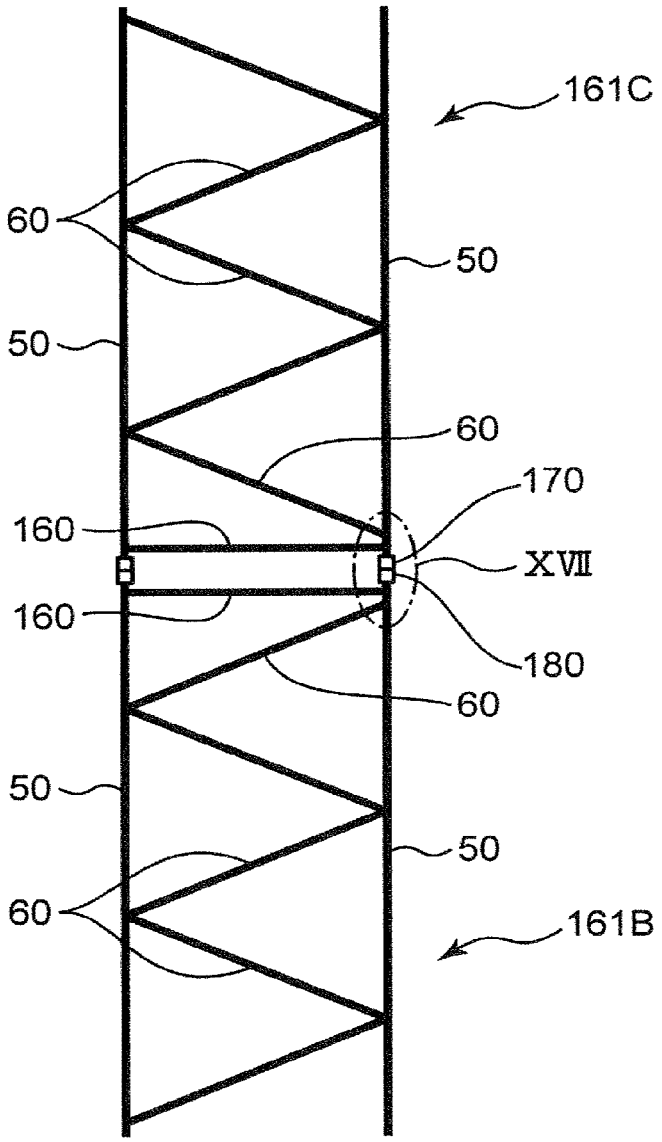
FIG. 16 is a side view showing a lattice structure coupling body according to a comparative example.
Figure 17:
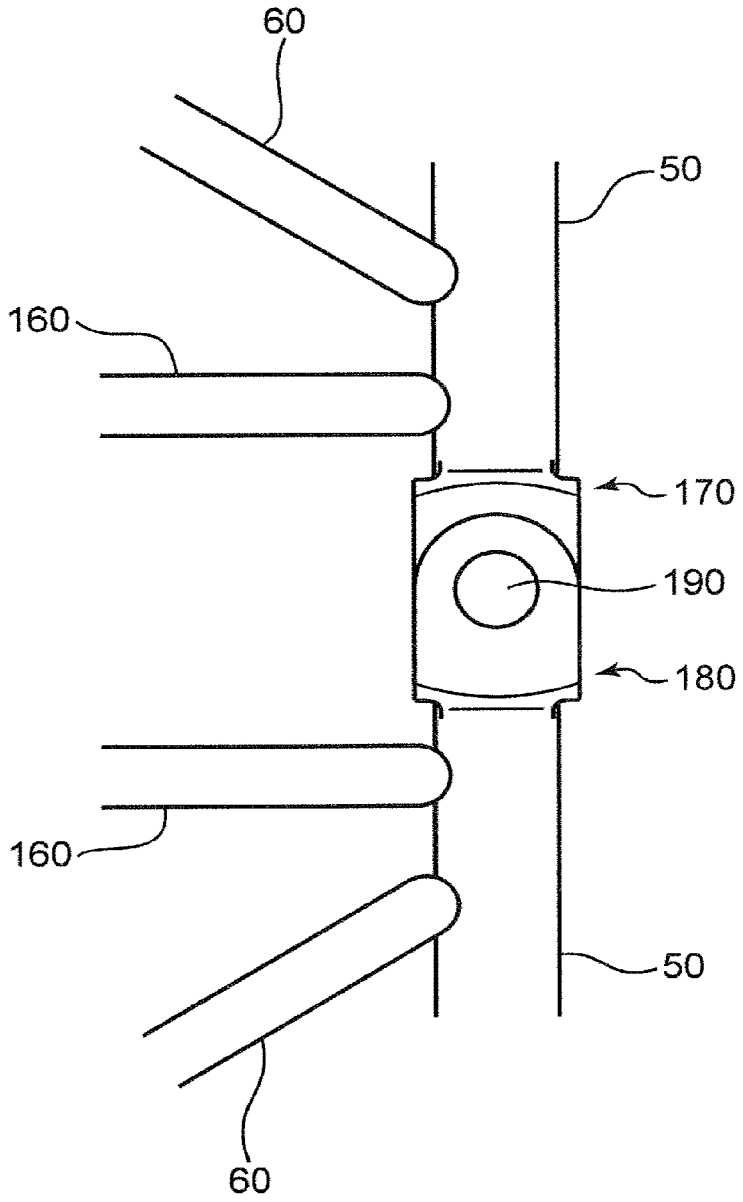
FIG. 17 is a side view showing a connector coupling body which the lattice structure coupling body according to the comparative example includes, and main pipes connected to the connector coupling body, inclined pipes, and orthogonal pipes.

The connector 70 and the connector 80 which form the connector coupling body 100 according to this embodiment having the above-mentioned configuration have the following advantageous effects compared with a connector 170 and a connector 180 according to a comparative example shown in FIG. 16 and FIG. 17, for example.

FIG. 16 is a side view showing lattice structures 161B, 161C according to the comparative example. FIG. 17 is an enlarged view of a portion surrounded by a frame XVII in FIG. 16, and is a side view showing a structure coupling portion of the lattice structures 161B, 161C according to the comparative example. As described in FIG. 16 and FIG. 17, in the structure coupling portion according to the comparative example where two lattice structures 161B, 161C are coupled to each other, the connector 170 and the counterpart connector 180 coupled to the connector 170 are provided, and these connectors 170, 180 are arranged along an axial direction of a main pipe 50 and coupled to each other by a coupling pin 190. Accordingly, end portions of two inclined pipes 60, 60 disposed with the structure coupling portion sandwiched therebetween along the axial direction of the main pipe 50 are disposed at an interval which exceeds at least a length of the structure coupling portion, that is, a length in the axial direction of the connector coupling body which is formed of the coupled connectors 170, 180. Accordingly, in the connector coupling body according to the comparative example, the triangular configurations (lattice arrangement) are not continuously formed and are interrupted in the structure coupling portion. As a result, a strength and rigidity of the structure coupling portion become low compared to a strength and rigidity of a portion where the lattice structures are continuously formed.

To suppress such lowering of the strength and the rigidity of the structure coupling portion, as shown in FIG. 16 and FIG. 17, orthogonal pipes 160 (frame members) which extend so as to be orthogonal to the axial direction of the main pipe 50 are provided to end portions of the respective lattice structures. By coupling the plurality of main pipes 50 of the respective lattice structures to each other by the orthogonal pipes 160, the structure coupling portion is reinforced. However, when the orthogonal pipes 160 are provided to the lattice structure in addition to the plurality of inclined pipes 60, a weight of the lattice structure is increased, and further, there is also a drawback that the number of man-hours for manufacturing the lattice structure is increased. In the connectors 170, 180 shown in FIG. 17, unlike the connectors 70, 80 according to the embodiment, it is not estimated that an inclined pipe connecting portion for connecting the end portion of the inclined pipe 60 is mounted on the connectors 170, 180, and the connectors 170, 180 also have no space for mounting the inclined pipe connecting portion on the connectors 170, 180.

On the other hand, by coupling the boom members 16B, 16C to each other using the connector 70 and the connector 80 according to the present embodiment, as shown in FIG. 3, both the end portion of the inclined pipe 60 connected to the connector 70 and the end portion of the inclined pipe 60 connected to the counterpart connector 80 are positioned on the structure coupling portion, that is, on the connector coupling body 100 and are closely positioned each other. Thus, also in the structure coupling portion, configurations similar to the above-mentioned triangular configurations (lattice arrangement) are continuously formed without being interrupted. In this manner, by coupling the boom members 16B, 16C to each other using the connector 70 and the connector 80 according to the present embodiment, it is possible to suppress the lowering of a strength and rigidity of the structure coupling portion and hence, unlike the comparative example, it becomes unnecessary to provide the orthogonal pipe 160 to the end portion of each lattice structure. As described above, according to the present embodiment, it is possible to suppress the increase of a weight of the lattice structure and the increase of the number of manufacturing man-hours and, at the same time, it is also possible to suppress the lowering of a strength and rigidity at a structure coupling portion where the lattice structures are coupled to each other.

In the present embodiment, in a state where the connector 70 and the counterpart connector 80 are coupled to each other, when the connector coupling body 100 is viewed in a side view (when the connector coupling body 100 is viewed in the axial direction of the coupling pin 90), an intersection between the center axis lines C1, C3 of the main pipe 50 and the inclined pipe 60 is positioned at the center of the coupling pin 90 and hence, two inclined pipes 60 and the main pipes 50 form an ideal triangular configuration in the structure coupling portion. Thus, the lowering of the strength of the structure coupling portion can be effectively suppressed.

In the present embodiment, in a state where the end surface of the end portion 50*a* of the main pipe 50 is made to face the flat surface 721 of the main pipe connecting portion 72 and the end surface of the end portion of the inclined pipe 60 is made to face the flat surface 731 of the inclined pipe connecting portion 73, the end portion 50*a* of the main pipe 50 and the end portion of the inclined pipe 60 can be connected to the main pipe connecting portion 72 and the inclined pipe connecting portion 73 of the connector 70, respectively, using a joining method such as welding, for example. Accordingly, workability at the time of connecting these pipes is enhanced, and a quality of a connection state can be easily ensured.

In the present embodiment, the main pipe connecting portion 72 has the projection 723 for alignment of the position of the end portion 50*a* of the main pipe 50, and the inclined pipe connecting portion 73 has the projection 733 for alignment of the position of the end portion of the inclined pipe 60. Thus, the position alignment at the time of connecting the end portion 50*a* of the main pipe 50 and the end portion of the inclined pipe 60 to the main pipe connecting portion 72 and the inclined pipe connecting portion 73 of the connector 70 can be easily performed.

[Modification 1]

Figure 7:
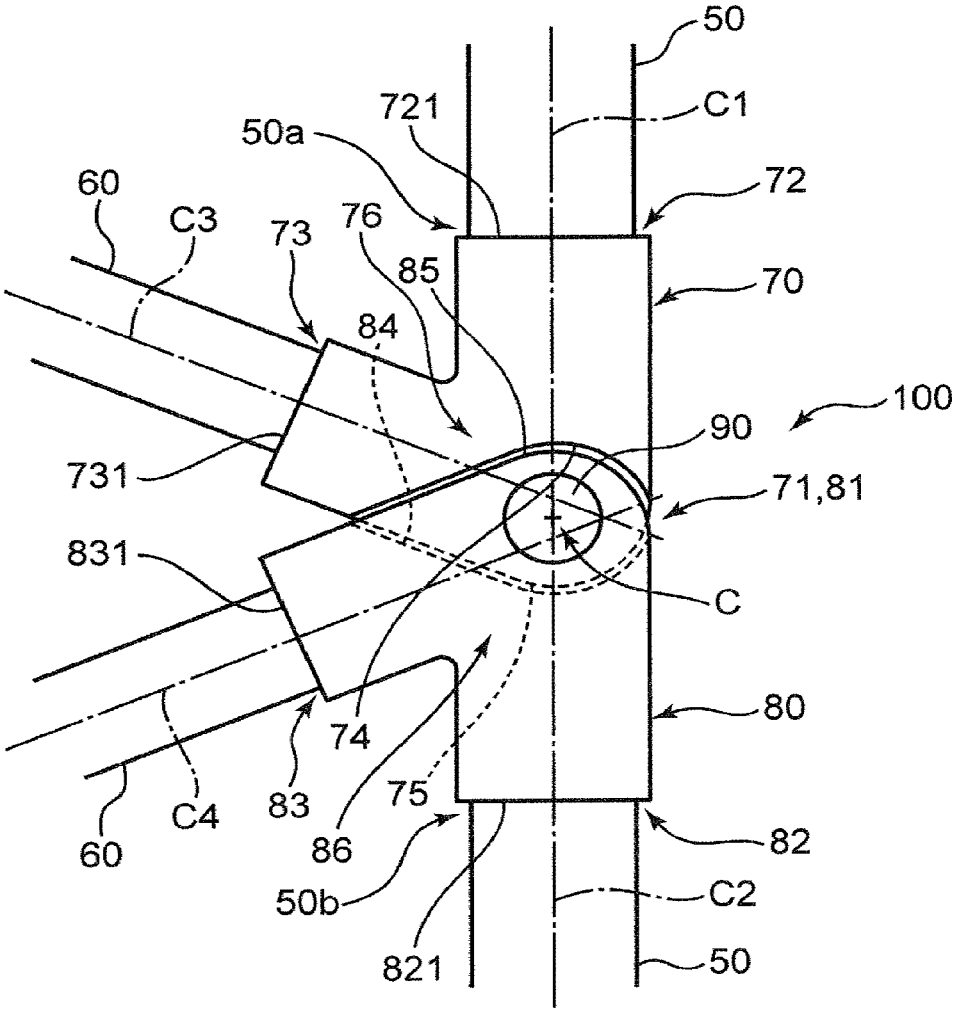
FIG. 7 is a side view showing a connector coupling body which a lattice structure coupling body according to a modification 1 of the first embodiment includes, and main pipes and inclined pipes connected to the connector coupling body.

FIG. 7 is a side view showing a connector coupling body 100 which a lattice structure coupling body 101 according to a modification 1 of the first embodiment includes, and main pipes 50 and inclined pipes 60 connected to the connector coupling body 100.

The modification 1 shown in FIG. 7 differs from the above-mentioned embodiment shown in FIG. 3 with respect to positions of the center axis lines C3, C4, and other configurations of the modification 1 are substantially equal to corresponding configurations of the above-mentioned embodiment shown in FIG. 3 and hence, only the different point is described hereinafter.

In the modification 1, an inclined pipe 60 connected to an inclined pipe connecting portion 73 of a connector 70 is disposed at a position displaced in one direction in an axial direction of the main pipe 50 compared to the inclined pipe 60 in the above-mentioned embodiment shown in FIG. 3. Thus, when the connector 70 is viewed in an axial direction of a coupling pin 90, an intersection between a center axis line C3 of the inclined pipe 60 and a center axis line C1 of the main pipe 50 connected to the main pipe connecting portion 72 of the connector 70 is disposed at a position displaced in a direction approaching the main pipe connecting portion 72 compared to the intersection in the above-mentioned embodiment shown in FIG. 3.

Specifically, when the connector 70 is viewed in the axial direction of the coupling pin 90 as shown in FIG. 7, the center axis line C1 of the main pipe 50 and the center axis line C3 of the inclined pipe 60 intersect with each other at a position displaced from the center C of the coupling pin 90 toward the main pipe connecting portion 72 of the connector 70 and within a range of the coupling pin 90. Although it is sufficient that, when the connector 70 is viewed in the axial direction of the coupling pin 90, the center axis lines C1, C3 intersect with each other within a range of a head portion 90*b* of the coupling pin 90, it is more preferable that the center axis lines C1, C3 intersect with each other within a range of a shaft portion 90*a* having an outer diameter smaller than an outer diameter of the head portion 90*b*.

In the modification 1, an inclined pipe 60 connected to an inclined pipe connecting portion 83 of a connector 80 is disposed at a position displaced in the other direction in the axial direction of the main pipe 50 compared to the inclined pipe 60 in the above-mentioned embodiment shown in FIG. 3. Thus, when the connector 80 is viewed in the axial direction of the coupling pin 90, an intersection between a center axis line C4 of an inclined pipe 60 and a center axis line C2 of a main pipe 50 connected to the main pipe connecting portion 82 of the connector 80 is disposed at a position displaced in a direction approaching the main pipe connecting portion 82 compared to the intersection in the above-mentioned embodiment shown in FIG. 3.

Specifically, when the connector 80 is viewed in the axial direction of the coupling pin 90 as shown in FIG. 7, the center axis line C2 of the main pipe 50 and the center axis line C4 of the inclined pipe 60 intersect with each other at a position displaced from the center C of the coupling pin 90 toward the main pipe connecting portion 82 of the connector 80 and within a range of the coupling pin 90. Although it is sufficient that, when the connector 80 is viewed in the axial direction of the coupling pin 90, two center axis lines C2, C4 intersect with each other within the range of the head portion 90*b* of the coupling pin 90, it is more preferable that the center axis lines C2, C4 intersect with each other within the range of the shaft portion 90*a* having an outer diameter smaller than an outer diameter of the head portion 90*b*.

The center axis line C1 and the center axis line C3 may intersect with each other at a position displaced from the center C of the coupling pin 90 toward the main pipe connecting portion 82 of the connector 80 and within the range of the coupling pin 90. The center axis line C2 and the center axis line C4 may intersect with each other at a position displaced from the center C of the coupling pin 90 toward the main pipe connecting portion 72 of the connector 70 and within the range of the coupling pin 90.

[Modification 2]

Figure 8:
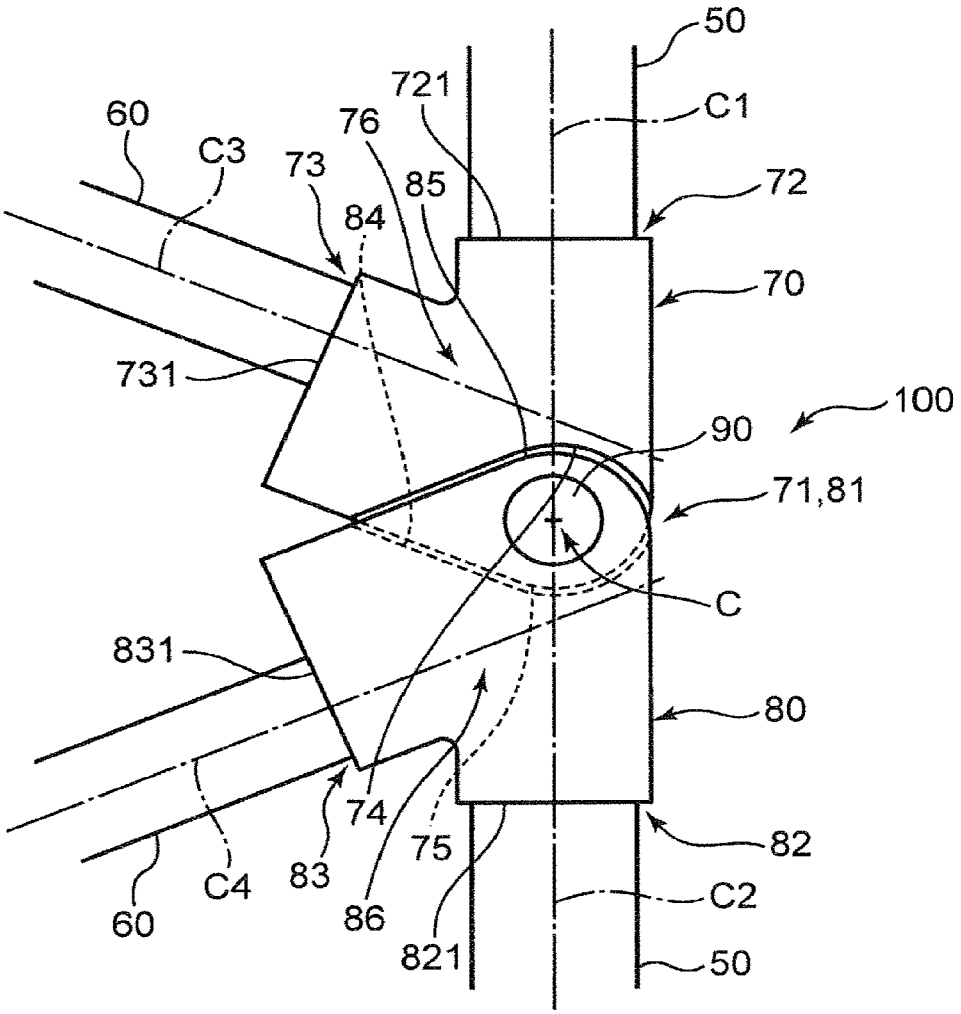
FIG. 8 is a side view showing a connector coupling body which a lattice structure coupling body according to a modification 2 of the first embodiment includes, and main pipes and inclined pipes connected to the connector coupling body.

FIG. 8 is a side view showing a connector coupling body 100 which a lattice structure coupling body 101 according to a modification 2 of the first embodiment includes, and main pipes 50 and inclined pipes 60 connected to the connector coupling body 100.

The modification 2 shown in FIG. 8 differs from the above-mentioned embodiment shown in FIG. 3 with respect to positions of the center axis lines C3, C4, and other configurations of the modification 2 are substantially equal to those of the above-mentioned embodiment shown in FIG. 3 and hence, only the different point is described hereinafter.

In the modification 2, the inclined pipe 60 connected to the inclined pipe connecting portion 73 of the connector 70 is disposed at a position displaced in one direction in the axial direction of the main pipe 50 compared to the inclined pipe 60 in the above-mentioned embodiment shown in FIG. 3, and is disposed at the position displaced in one direction in the axial direction of the main pipe 50 also compared to the inclined pipe 60 in the modification 1 shown in FIG. 7.

Specifically, when the connector 70 is viewed in the axial direction of the coupling pin 90 as shown in FIG. 8, the center axis line C1 of the main pipe 50 and the center axis line C3 of the inclined pipe 60 intersect with each other at the position displaced from the center C of the coupling pin 90 toward the main pipe connecting portion 72 of the connector 70, outside a range of the coupling pin 90 and within a range of the connector 70.

When the connector 80 is viewed in the axial direction of the coupling pin 90 as shown in FIG. 8, the center axis line C2 of the main pipe 50 and the center axis line C4 of the inclined pipe 60 intersect with each other at the position displaced from the center C of the coupling pin 90 toward the main pipe connecting portion 82 of the connector 80, outside the range of the coupling pin 90 and within the range of the connector 80.

The center axis line C1 and the center axis line C3 may intersect with each other at a position displaced from the center C of the coupling pin 90 toward the main pipe connecting portion 82 of the connector 80, outside the range of the coupling pin 90 and within the range of the connector 70. The center axis line C2 and the center axis line C4 may intersect with each other at a position displaced from the center C of the coupling pin 90 toward the main pipe connecting portion 72 of the connector 70, outside the range of the coupling pin 90 and within the range of the connector 80.

[Modification 3]

Figure 9:
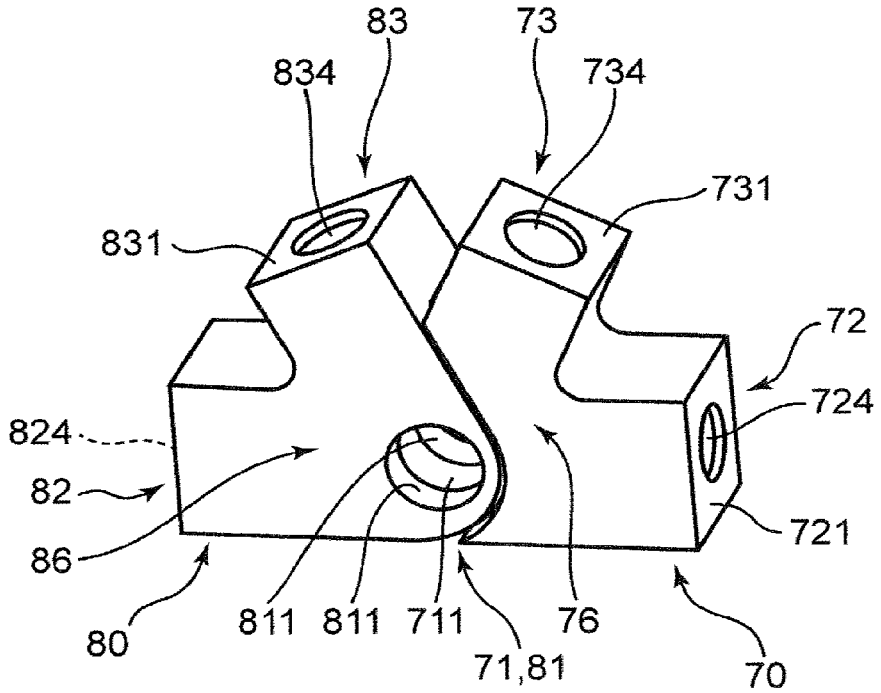
FIG. 9(A) is a perspective view showing a connector and a counterpart connector which a lattice structure coupling body according to a modification 3 of the first embodiment includes.
FIG. 9(B) is a side view showing an inclined pipe connecting portion of the connector and an end portion of the inclined pipe connected to the inclined pipe connecting portion.
Figure 9:
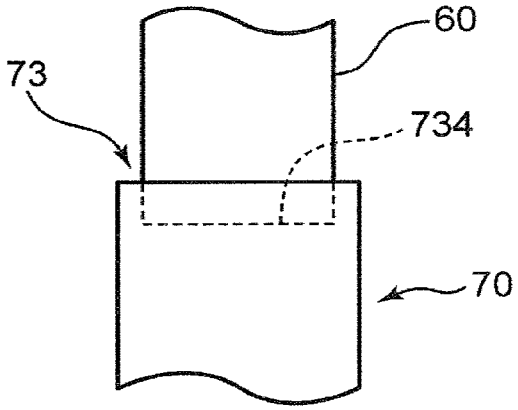

FIG. 9(A) is a perspective view showing a connector 70 and a counterpart connector 80 which a lattice structure coupling body 101 according to a modification 3 of the first embodiment includes, and FIG. 9(B) is a side view showing an inclined pipe connecting portion 73 of a connector 70 and an end portion of an inclined pipe 60 connected to the inclined pipe connecting portion 73.

The modification 3 shown in FIG. 9(A), (B) differs from the above-mentioned embodiment shown in FIG. 3 to FIG. 6 with respect to configurations of the main pipe connecting portion 72 and the inclined pipe connecting portion 73, and other configurations of the modification 3 are substantially equal to those of the above-mentioned embodiment shown in FIG. 3 to FIG. 6 and hence, only the different point is described hereinafter.

In the modification 3, as shown in FIG. 9(A), (B), the main pipe connecting portion 72 has a recess 724 which is recessed toward the inside (toward a coupling portion 71 side) from the end surface 721, and the main pipe connecting portion 82 has a recess 824 which is recessed toward the inside (toward a coupling portion 81 side) from the end surface 821 (see FIG. 6). The recess 724 and the recess 824 are provided for position alignment of end portions of the main pipes 50, respectively.

The recess 724 and the recess 824 each have a shape which allows the end portion of the main pipe 50 to be fitted into the recess with a slight gap. Specifically, in this embodiment, the recess 724 and the recess 824 each have an annular inner peripheral surface corresponding to the end portions of the cylindrical main pipes 50, and inner diameters of the recess 724 and the recess 824 are slightly larger than outer diameters of the end portions of the main pipes 50. However, the inner peripheral surfaces of the recess 724 and the recess 824 are not limited to the above-mentioned annular shape.

The inclined pipe connecting portion 73 has a recess 734 which is recessed toward the inside (toward the coupling portion 71 side) from the end surface 731. The inclined pipe connecting portion 83 has a recess 834 which is recessed toward the inside (toward the coupling portion 81 side) from the end surface 831. The recess 734 and the recess 834 are provided for position alignment of the end portions of the inclined pipes 60, respectively.

The recess 734 and the recess 834 each have a shape which allows the end portion of the inclined pipe 60 to be fitted in the recess 734 and the recess 834 with a slight gap. Specifically, in this embodiment, the recess 734 and the recess 834 each have an annular inner peripheral surface corresponding to the end portion of the cylindrical inclined pipe 60, and inner diameters of the recess 734 and the recess 834 are slightly larger than outer diameters of the end portions of the inclined pipes 60. However, the inner peripheral surfaces of the recess 734 and the recess 834 are not limited to the above-mentioned annular shape.

[Modification 4]

Figure 10:
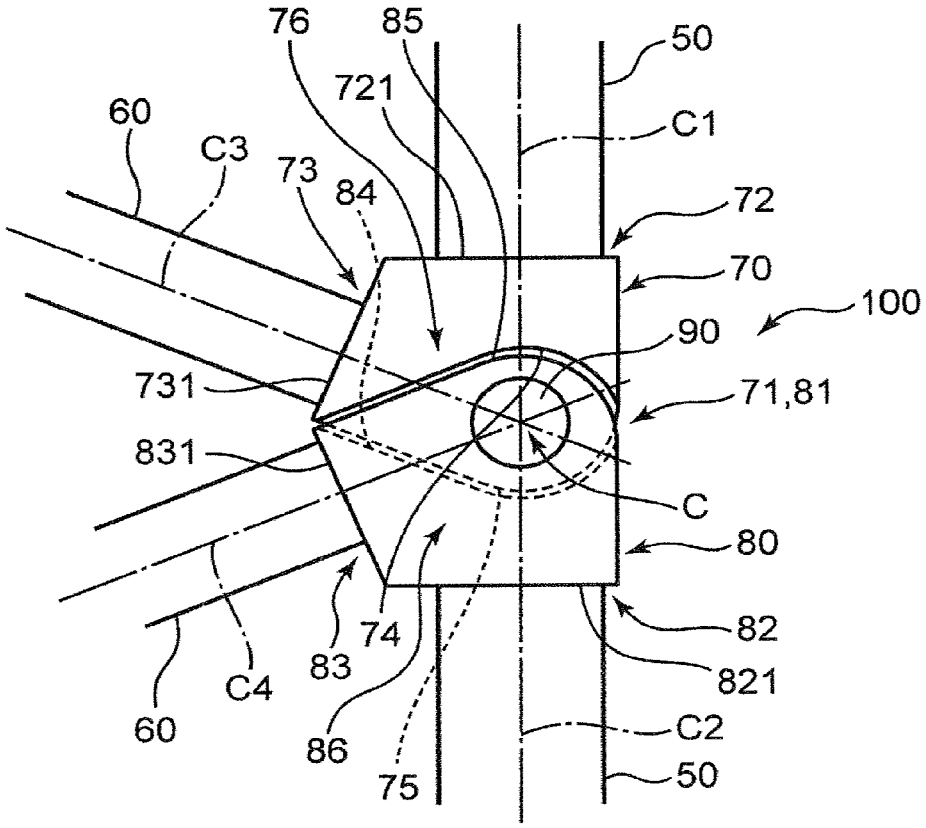
FIG. 10 is a side view showing a connector coupling body which a lattice structure coupling body according to a modification 4 of the first embodiment includes, and main pipes and inclined pipes connected to the connector coupling body.
Figure 11:
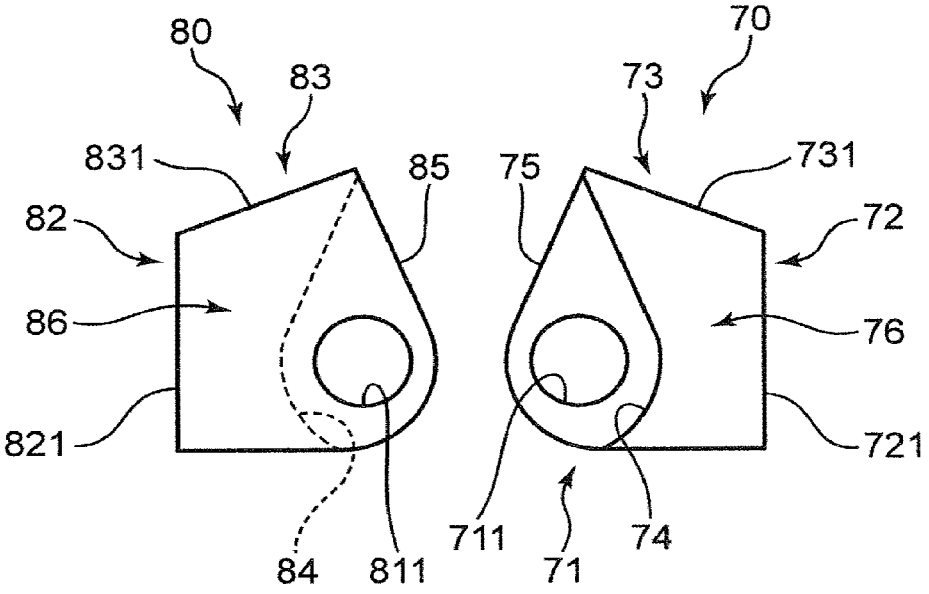
FIG. 11 is a side view showing a connector and a counterpart connector which form the connector coupling body shown in FIG. 10.

FIG. 10 is a side view showing a connector coupling body 100 which a lattice structure coupling body 101 according to a modification 4 of the first embodiment includes, and main pipes 50 and inclined pipes 60 connected to the connector coupling body 100. FIG. 11 is a side view showing a connector 70 and a counterpart connector 80 which form the connector coupling body 100 shown in FIG. 10.

The modification 4 shown in FIG. 10 and FIG. 11 differs from the above-mentioned embodiment shown in FIG. 3 and FIG. 6 with respect to a shape of a connector body portion 76 and a shape of a connector body portion 86, and other configurations of the modification 4 are substantially equal to those of the above-mentioned embodiment shown in FIG. 3 and FIG. 6 and hence, only the different point is described hereinafter.

Unlike the connector body portion 76 according to the above-mentioned embodiment shown in FIG. 3 and FIG. 6, the connector body portion 76 of the connector 70 according to the modification 4 shown in FIG. 10 and FIG. 11 does not have an approximately L shape, that is, a shape that the main pipe connecting portion 72 and the inclined pipe connecting portion 73 are branched from each other. In the connector body portion 76 of the modification 4, a valley portion is not formed between the main pipe connecting portion 72 and the inclined pipe connecting portion 73, and the main pipe connecting portion 72 and the inclined pipe connecting portion 73 are integrally formed with each other. Thus, the connector 70 can be easily manufactured and a strength of the connector 70 can be also increased. The same applies also for the connector body portion 86 of the connector 80.

Second Embodiment

Figure 12:
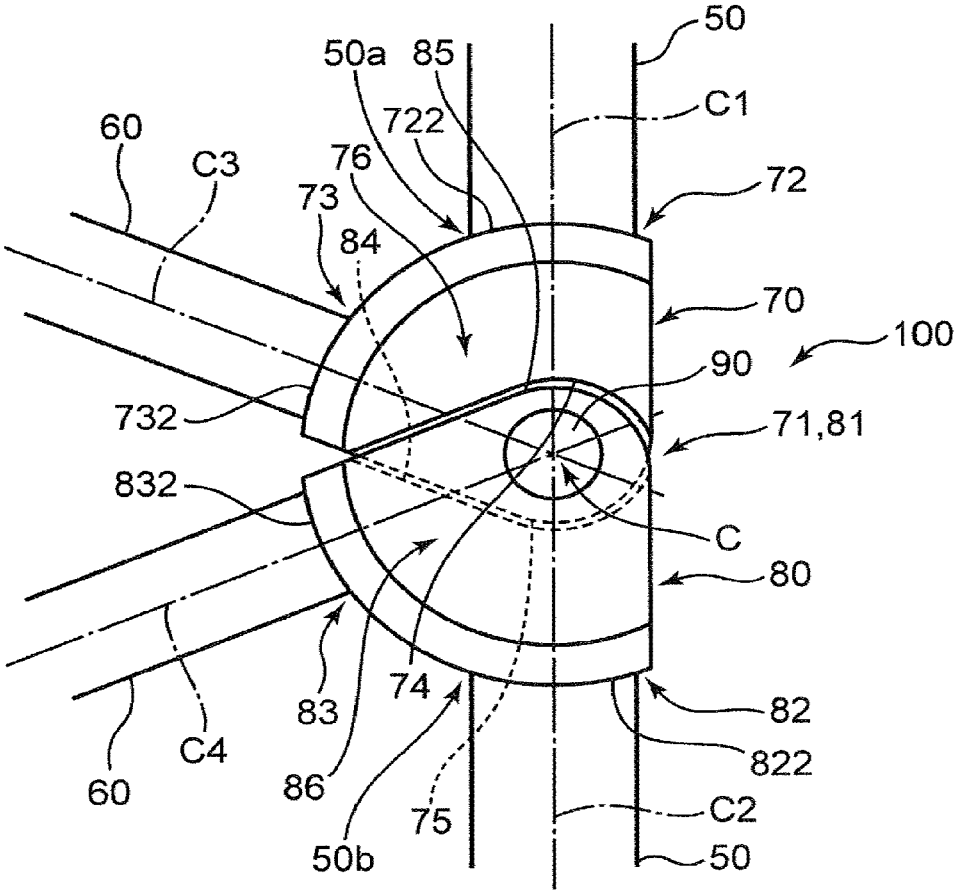
FIG. 12 is a side view showing a connector coupling body which a lattice structure coupling body according to a second embodiment of the present invention includes, and main pipes and inclined pipes connected to the connector coupling body.
Figure 13:
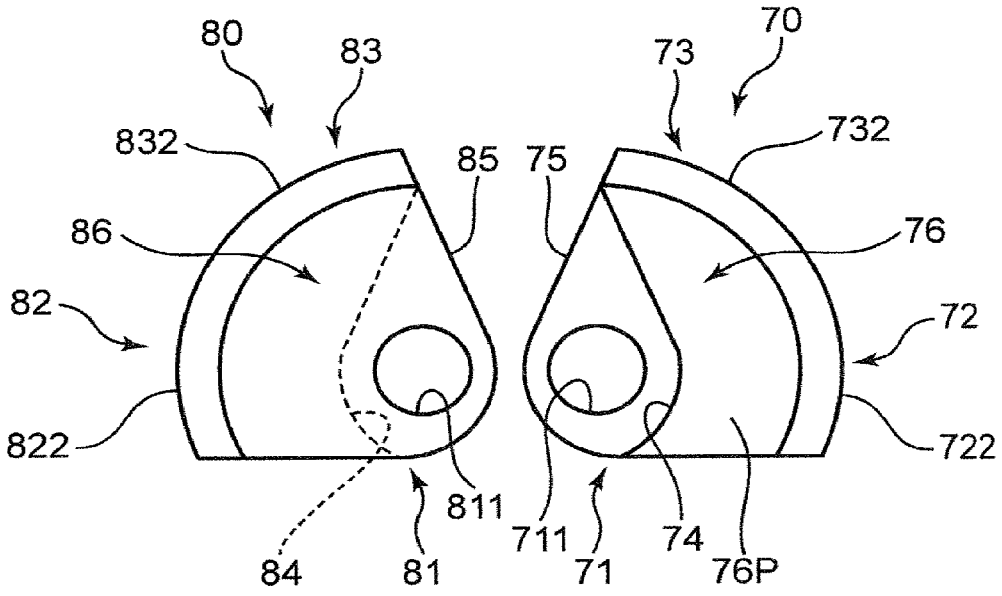
FIG. 13 is a side view showing a connector and a counterpart connector which form the connector coupling body shown in FIG. 12.

FIG. 12 is a side view showing a connector coupling body 100 which a lattice structure coupling body 101 according to a second embodiment of the present invention includes, and main pipes 50 and inclined pipes 60 connected to the connector coupling body 100. FIG. 13 is a side view showing a connector 70 and a counterpart connector 80 which feint the connector coupling body 100 shown in FIG. 12. FIG. 14(A) is a plan view showing the connector 70 shown in FIG. 12, and FIG. 14(B) is a front view of the connector 70 shown in FIG. 12.

Figure 14:
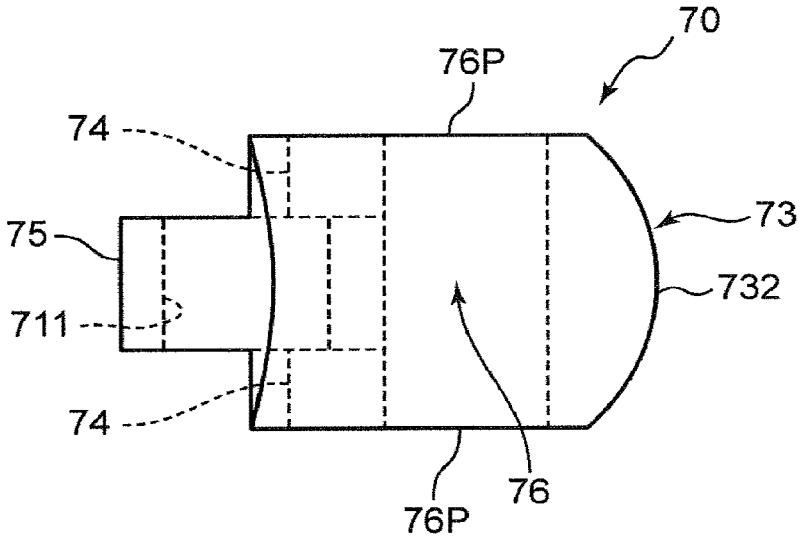
FIG. 14(A) is a plan view showing the connector shown in FIG. 12.
FIG. 14(B) is a front view of the connector shown in FIG. 12.
Figure 14:
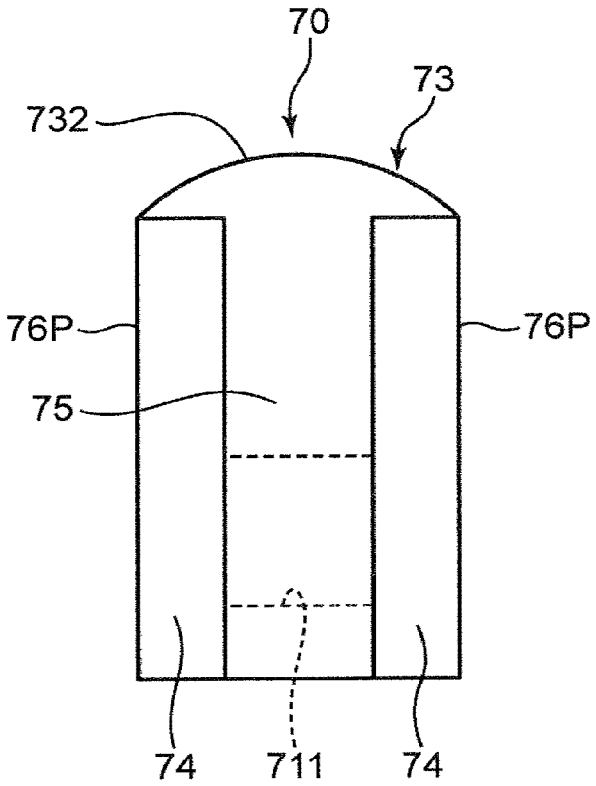

The second embodiment shown in FIG. 12 to FIG. 14 differs from the above-mentioned embodiment shown in FIG. 3 to FIG. 6 with respect to the configurations of main pipe connecting portions 72, 82 and the configurations of inclined pipe connecting portions 73, 83. In the second embodiment, in the same manner as the connector body portion 76 according to the modification 4, a valley portion is not formed between the main pipe connecting portion 72 and the inclined pipe connecting portion 73, and the main pipe connecting portion 72 and the inclined pipe connecting portion 73 are integrally formed with each other. Other configurations of the second embodiment are substantially equal to those of the above-mentioned embodiment shown in FIG. 3 to FIG. 6 and hence, only the different point is described hereinafter.

As shown in FIG. 12 to FIG. 14, according to the second embodiment, in the connector 70, the main pipe connecting portion 72 includes a spherical surface 722 which an end surface of an end portion 50*a* of the main pipe 50 faces and to which the end portion 50*a* of the main pipe 50 is connected. The inclined pipe connecting portion 73 includes a spherical surface 732 which an end surface of an end portion of the inclined pipe 60 faces and to which the end portion of the inclined pipe 60 is connected.

In the connector 80, the main pipe connecting portion 82 includes a spherical surface 822 which an end surface of an end portion 50*b* of the main pipe 50 faces and to which the end portion 50*b* of the main pipe 50 is connected, and the inclined pipe connecting portion 83 includes a spherical surface 832 which an end surface of an end portion of the inclined pipe 60 faces and to which the end portion of the inclined pipe 60 is connected.

In the second embodiment, in the connector 70, in a state where the end surface of the end portion 50*a* of the main pipe 50 is made to face the spherical surface 722 of the main pipe connecting portion 72 and the end surface of the end portion of the inclined pipe 60 is made to face the spherical surface 732 of the inclined pipe connecting portion 73, the end portion 50*a* of the main pipe 50 and the end portion of the inclined pipe 60 can be connected to the main pipe connecting portion 72 and the inclined pipe connecting portion 73 of the connector 70 respectively using a joining method such as welding, for example. Accordingly, workability at the time of connecting these pipes is enhanced, and a quality of a connection state can be easily ensured. The same applies also for the connector 80.

When the connector 70 is viewed in an axial direction of a coupling pin 90, a center of the spherical surface 722 of the main pipe connecting portion 72 (that is, a center of a sphere including a spherical surface 722) and a center of the spherical surface 732 of the inclined pipe connecting portion 73 (that is, a center of a sphere including the spherical surface 732) are positioned within a range of the coupling pin 90. Accordingly, by connecting the end portion of the main pipe 50 and the end portion of the inclined pipe 60 to the main pipe connecting portion 72 and the inclined pipe connecting portion 73 by welding or the like, respectively, in a state where the end surface of the end portion of the main pipe 50 is made to face the spherical surface 722 of the main pipe connecting portion 72 and the end surface of the end portion of the inclined pipe 60 is made to face the spherical surface 732 of the inclined pipe connecting portion 73, an intersection between center axis lines C1, C3 of the main pipe 50 and the inclined pipe 60 (an intersection as viewed in an axial direction of the coupling pin) can be positioned within a range of the coupling pin 90.

Particularly, in the specific example shown in FIG. 12, the center of the spherical surface 722 and the center of the spherical surface 732 are positioned at the center of the coupling pin 90. In this case, as described above, by merely connecting the end portion of the main pipe 50 and the end portion of the inclined pipe 60 to the main pipe connecting portion 72 and the inclined pipe connecting portion 73, respectively, the intersection between the center axis lines C1, C3 of the main pipe 50 and the inclined pipe 60 (the intersection as viewed in the axial direction of the coupling pin) can be positioned at the center C of the coupling pin 90.

Further, as described above, the main pipe connecting portion 72 to which the main pipe 50 is welded is formed of the spherical surface 722, and the inclined pipe connecting portion 73 to which the inclined pipe 60 is welded is formed of the spherical surface 732. Accordingly, when the end portion of the main pipe 50 and the end portion of the inclined pipe 60 are cut along a plane orthogonal to the axial directions of the main pipe 50 and the inclined pipe 60, respectively, by merely making the end surfaces of these end portions abut against the spherical surfaces 722, 732, respectively, these end surfaces and the spherical surfaces 722, 732 can be brought into contact with each other almost without any gap. For example, in a case where an end portion of one pipe is connected to an outer peripheral surface of the other pipe, when the end surface of the end portion of one pipe is merely brought into contact with the outer peripheral surface of the other pipe, a large gap is formed. However, in the second embodiment, such a gap is not formed.

Welding between the end portion 50*a* of the main pipe 50 and the main pipe connecting portion 72 is performed over the whole circumferences of the end portion 50*a* and the end surface 722. In the same manner, welding between the end portion of the inclined pipe 60 and the inclined pipe connecting portion 73 is performed over the whole circumferences of the end portion and the end surface 732. Thus, the welding can be performed under the same welding condition over the whole circumferences and hence, the same working condition can be adopted thus enhancing workability and also enhancing welding quality.

In a state where the end surface of the end portion of the main pipe 50 and the end surface of the end portion of the inclined pipe 60 are made to abut against the spherical surfaces 722, 732, respectively, the center axis line C1 of the main pipe 50 coincides with the center of the spherical surface 722, and the center axis line C3 of the inclined pipe 60 coincides with the center of the spherical surface 732.

As to the above-mentioned features, the same applies for the main pipe connecting portion 82 and the inclined pipe connecting portion 83 of the connector 80.

In the specific examples shown in FIG. 12 to FIG. 14, in the connector 70, the spherical surface 722 and the spherical surface 732 of the connector body portion 76 form a continuous spherical surface. However, the spherical surface 722 and the spherical surface 732 may be formed in a divided manner. The connector body portion 76 has a pair of flat surface portions 76P, 76P between the spherical surfaces 722 and 732 and the coupling portion 71. These flat surface portions 76P, 76P are positioned on one side and the other side in the axial direction of the coupling pin 90 with respect to the spherical surface 722 and the spherical surface 732. However, these flat surface portions 76P, 76P may be omitted as shown in FIG. 15, for example.

Figure 15:
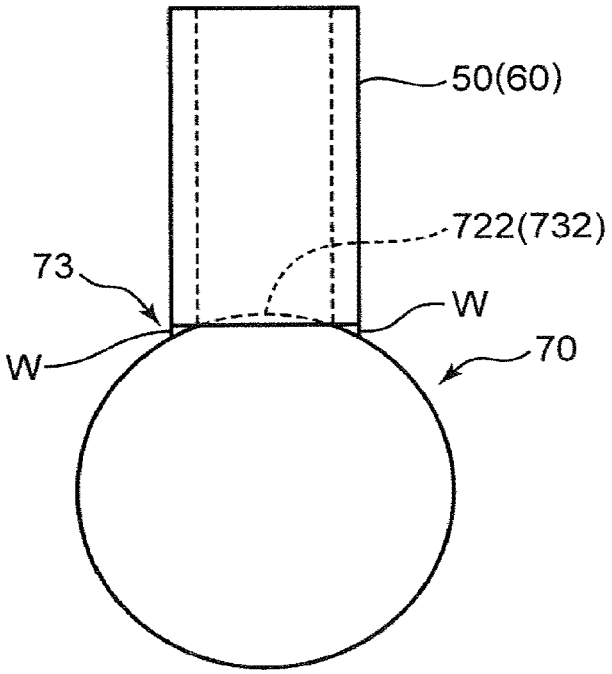
FIG. 15 is a conceptual view for describing features of the connector used for the lattice structure coupling body according to the second embodiment.

FIG. 15 is a conceptual view for describing features of the connector used for the lattice structure coupling body 101 according to the second embodiment. As shown in FIG. 15, in a case where the connector 70 has an approximately spherical shape, the main pipe 50 and the inclined pipe 60 can be connected to arbitrary positions of the connector 70. The end portion of the main pipe 50 (inclined pipe 60) is welded to the spherical surface 722 (spherical surface 732) at a portion W shown in FIG. 15, for example.

Also in the second embodiment, the main pipe connecting portion 72 and the inclined pipe connecting portion 73 may include a projection or a recess for position alignment of the end portion of the main pipe 50 and the end portion of the inclined pipe 60, respectively.

Third Embodiment

The lattice structure coupling body 101 according to the third embodiment of the present invention includes two kinds of connector coupling bodies 100A, 100B which differ from each other in structure for suppressing lowering of workability at the time of assembling the lattice structure coupling body 101 by coupling a boom member 16C (lattice structure 16C) and a boom member 16B (counterpart lattice structure 16B) to each other. The detailed structures of these connector coupling bodies 100A, 100B are described later. Hereinafter, first, the overall structure of the lattice structure coupling body 101 is described.

Figure 18:
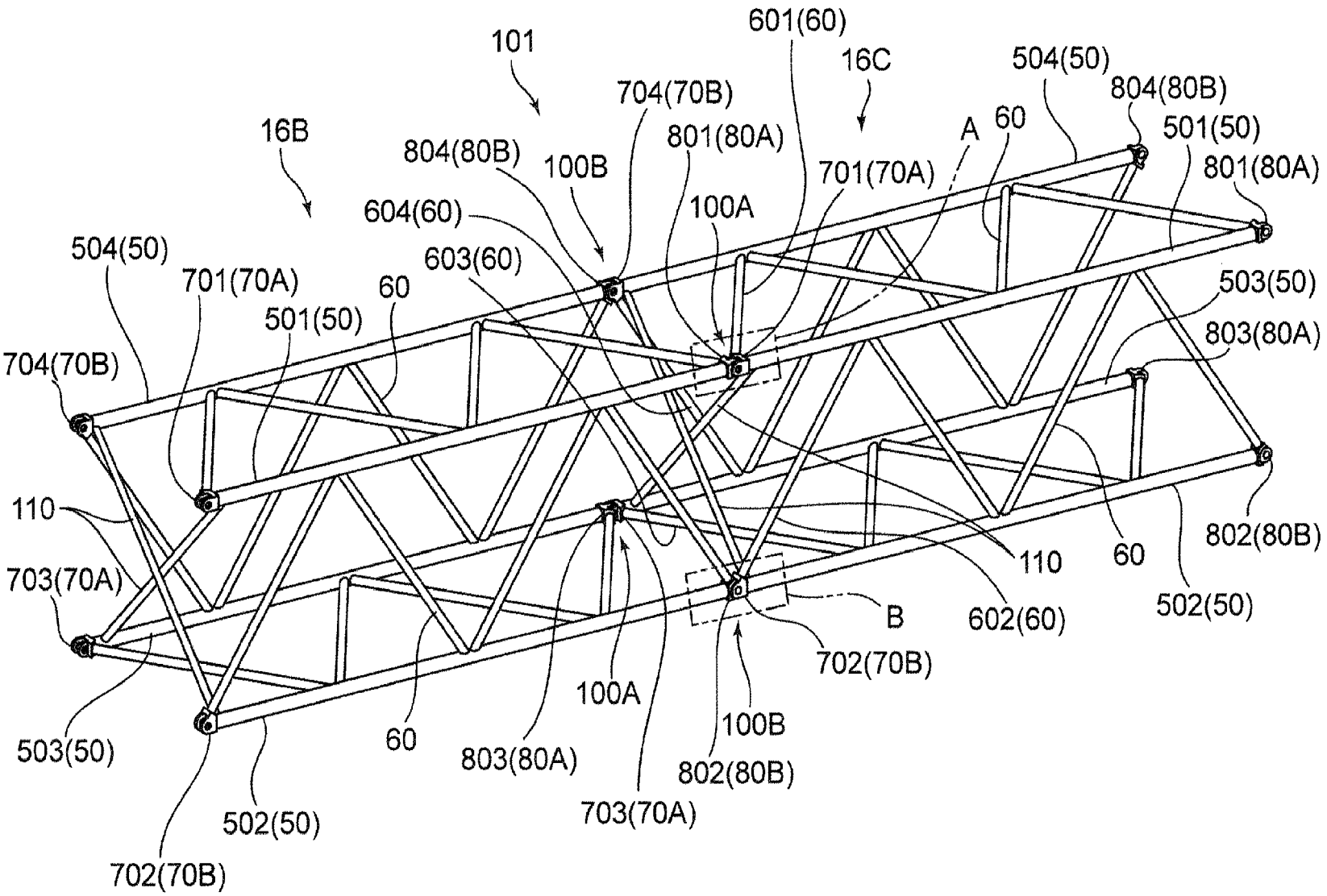
FIG. 18 is a perspective view showing a lattice structure coupling body according to a third embodiment of the present invention.
Figure 19:
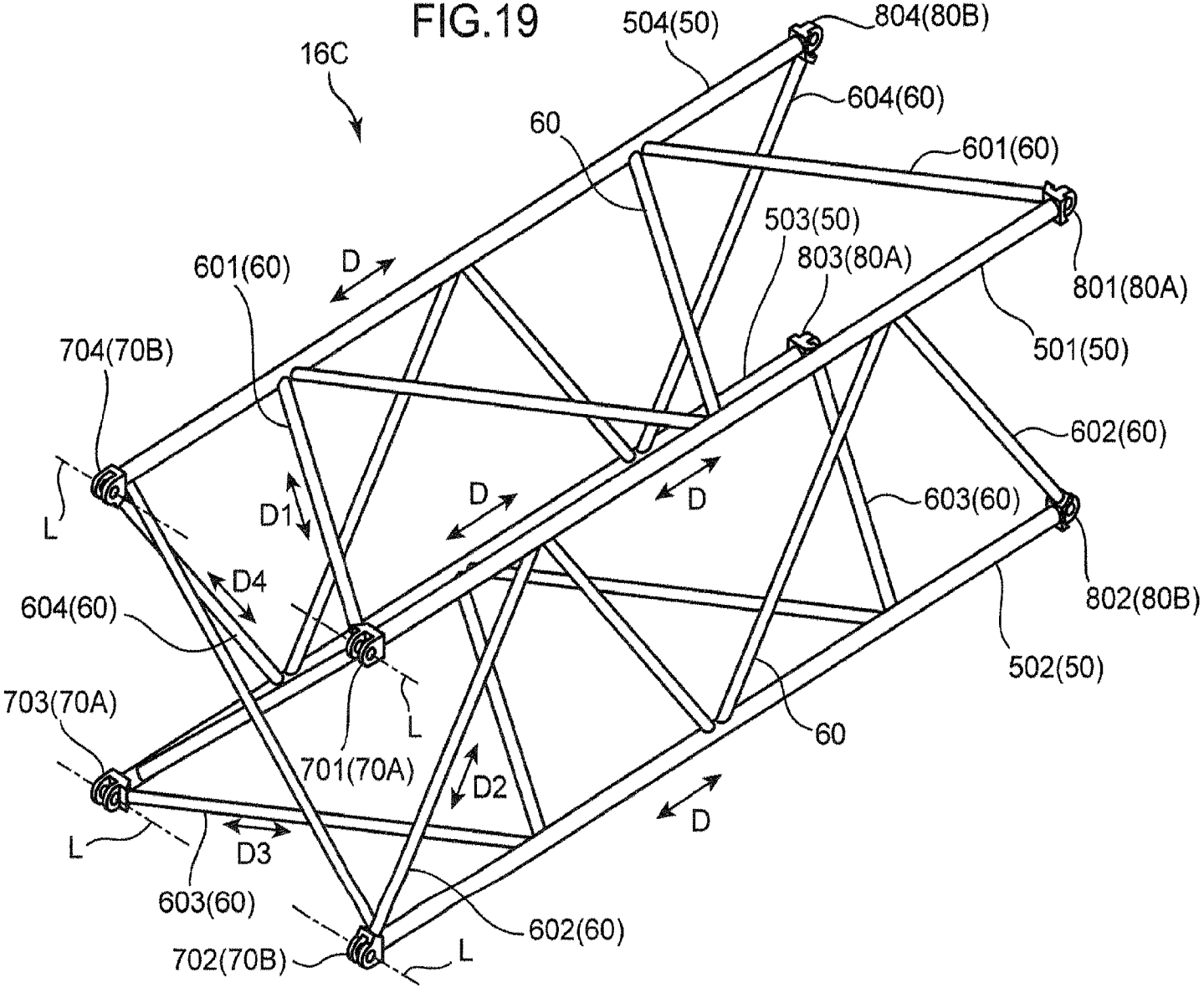
FIG. 19 is a perspective view showing a lattice structure which the lattice structure coupling body according to the third embodiment includes.

FIG. 18 is a perspective view showing the lattice structure coupling body 101 according to the third embodiment of the present invention. FIG. 19 is a perspective view showing the boom member 16C as the lattice structure which the lattice structure coupling body 101 according to the third embodiment includes.

The lattice structure coupling body 101 shown in FIG. 18 is mounted on a crane 10 (one example of a work machine) shown in FIG. 1, for example. The lattice structure coupling body 101 forms a portion of or an entire body of a member having a lattice arrangement such as the boom 16, the jib 18 and the like of the crane 10. The lattice structure coupling body 101 according to this embodiment forms a portion of the boom 16. The lattice arrangement shown in FIG. 18 can be adopted also to the lattice structure coupling body 101 according to the first embodiment and the lattice structure coupling body 101 according to the second embodiment.

Specifically, the lattice structure coupling body 101 shown in FIG. 18 includes a boom member 16C (lattice structure 16C), a boom member 16B (counterpart lattice structure 16B), and four connector coupling bodies for coupling these boom members 16B, 16C to each other.

As shown in FIG. 18 and FIG. 19, the lattice structure 16C includes four main pipes 50, a plurality of inclined pipes 60, four connectors 701 to 704, and four counterpart connectors 801 to 804. The counterpart lattice structure 16B includes four counterpart main pipes 50, a plurality of counterpart inclined pipes 60, four connectors 701 to 704, and four counterpart connectors 801 to 804. In these lattice structures 16B, 16C, four connectors 701 to 704 are disposed on one end portions of the lattice structures 16B, 16C in a longitudinal direction, respectively, and four counterpart connectors 801 to 804 are disposed on the other end portions of the lattice structures 16B, 16C in the longitudinal direction, respectively. In this embodiment, the structure of the lattice structure 16C and the structure of the counterpart lattice structure 16B are equal to each other and hence, hereinafter, the structure of the lattice structure 16C is mainly described.

In the lattice structure 16C, four main pipes 50 are disposed at positions corresponding to four vertices of a rectangular shape in cross section orthogonal to a longitudinal direction of the lattice structure 16C. Four main pipes 50 are arranged at an interval in radial directions of the main pipes 50. Four main pipes 50 are formed of a first main pipe 501, a second main pipe 502, a third main pipe 503, and a fourth main pipe 504. In the lattice structure 16C, four main pipes 50 are disposed in a posture that four main pipes 50 extend so as to be parallel to the longitudinal direction of the boom 16. However, the present invention is not limited to such a configuration. For example, as in the case of the boom member 16A and the boom member 16D shown in FIG. 1, the four main pipes 50 may be inclined with respect to the longitudinal direction of the boom 16. Each main pipe 50 is formed of a round pipe.

In the lattice structure 16C, each of the plurality of inclined pipes 60 couples any two main pipes 50 out of four main pipes 50 to each other. In this embodiment, each of the plurality of inclined pipes 60 couples each two main pipes 50 adjacent to each other among four main pipes 50. Each inclined pipe 60 is formed of a round pipe. The two main pipes 50 adjacent to each other are two main pipes 50 which are disposed, not at two vertices positioned diagonally from each other among four vertices of a rectangular shape in cross section orthogonal to the longitudinal direction of the lattice structure 16C, but are disposed at positions which correspond to two vertices positioned at both ends of one side of the rectangular shape.

In this embodiment, two main pipes 50 adjacent to each other are coupled to each other by some of the plurality of inclined pipes 60 (in the drawings, four inclined pipes 60), and the four inclined pipes 60 couple the two main pipes 50 adjacent to each other in a zigzag manner. In this embodiment, the lattice structure 16C includes four main pipes 50 and hence, there are four sets of main pipes 50 where each set is formed of two main pipes 50 adjacent to each other. In each set, four inclined pipes 60 couple two main pipes 50 to each other in a zigzag manner. Thus, in each set, the lattice arrangement is formed where a plurality of triangular configuration portions are arranged in the longitudinal direction of the boom 16.

As shown in FIG. 18 and FIG. 19, the lattice structure 16C according to the present embodiment further includes a plurality of diagonal pipes 110 (specifically, two diagonal pipes 110). The diagonal pipes 110 are not provided for coupling the two main pipes 50 adjacent to each other. The diagonal pipe 110 couples two main pipes 50 disposed at positions corresponding to two vertices positioned diagonally among four vertices of the rectangular shape to each other. The diagonal pipes 110 are not connected to the connectors 701 to 704 and the counterpart connectors 801 to 804, and are directly connected to the main pipes 50.

[Connector Coupling Body]

Figure 21:
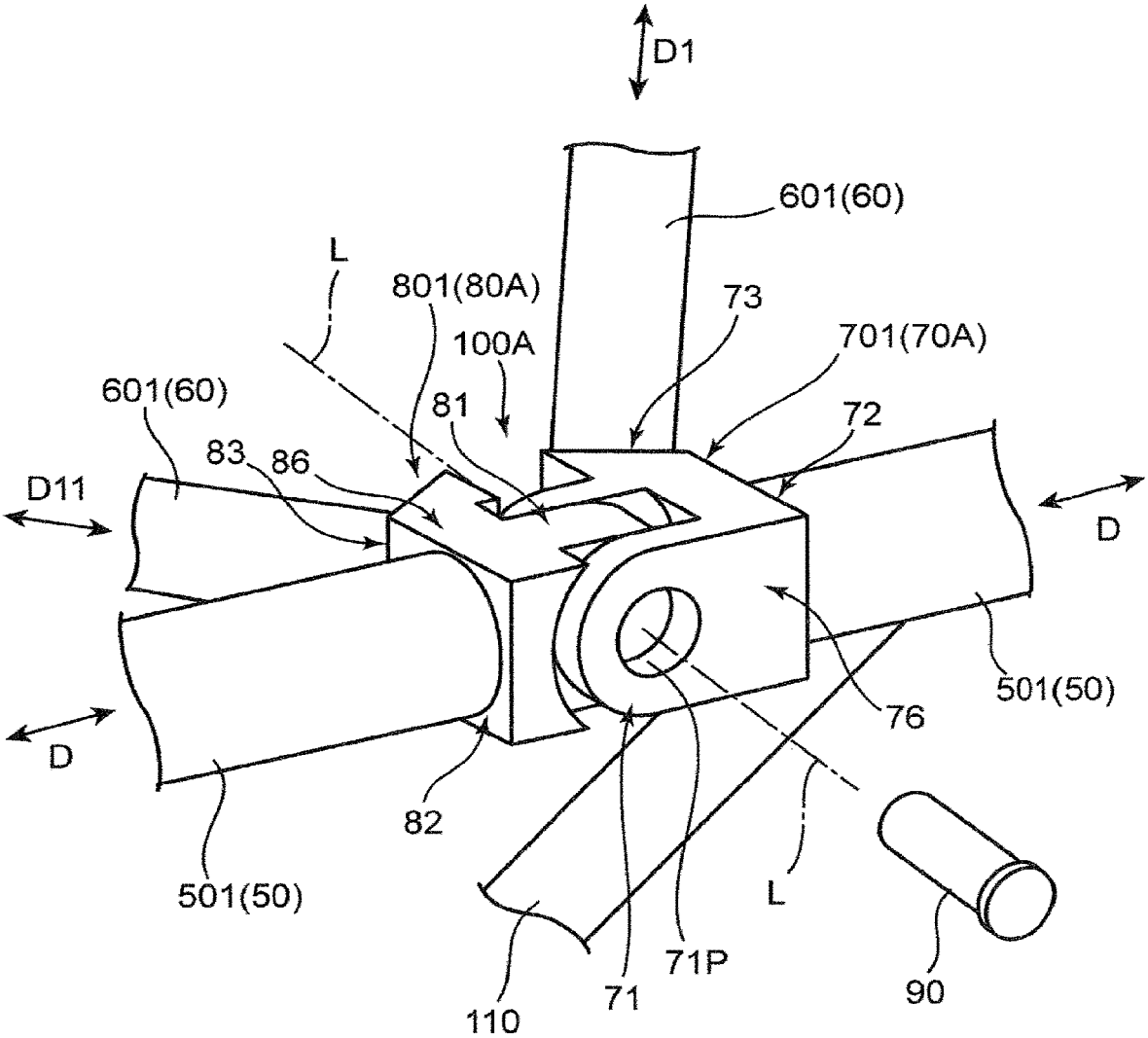
FIG. 21 is a perspective view showing a region A surrounded by a double-dashed chain line in FIG. 18 in an enlarged manner.
Figure 22:
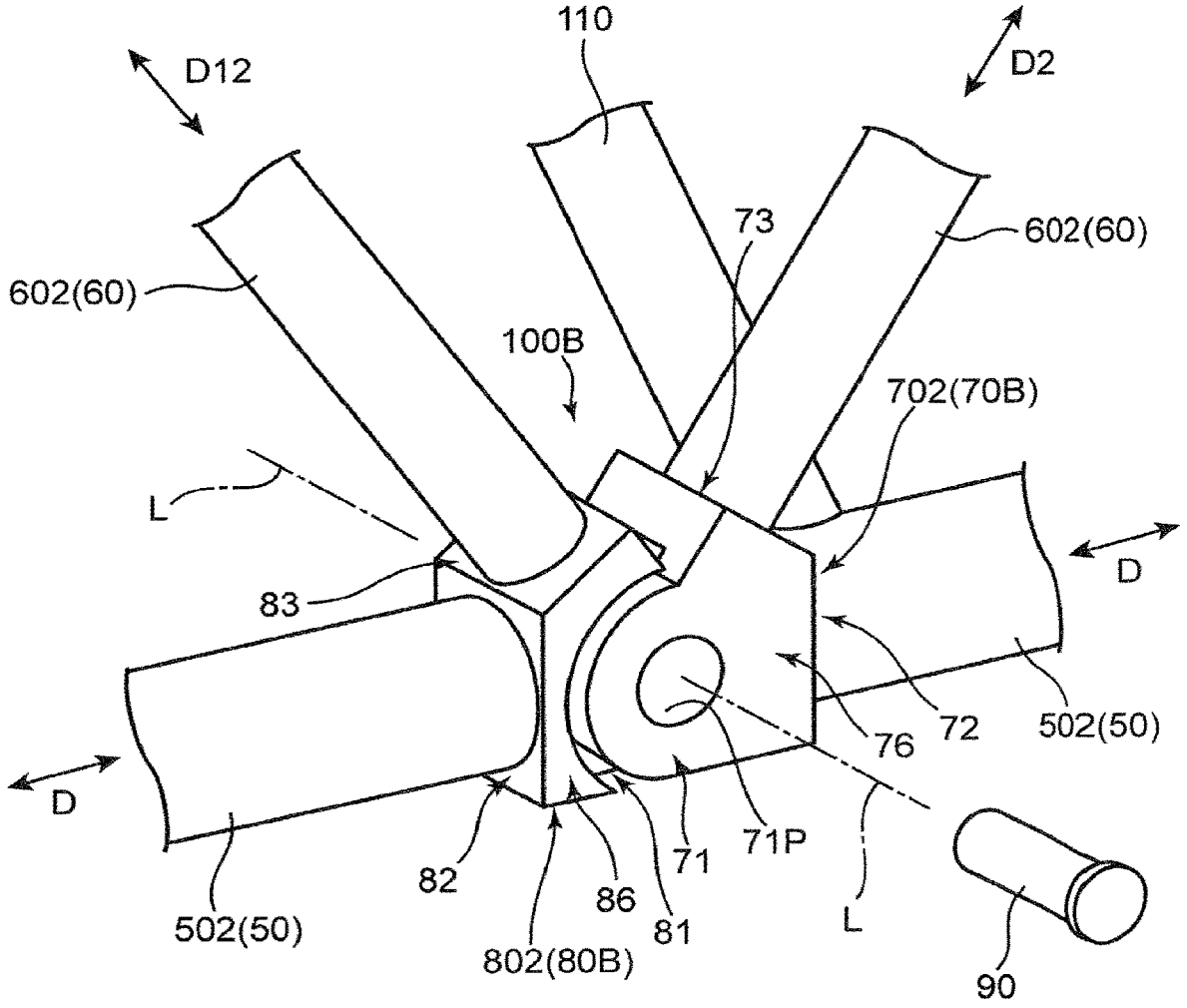
FIG. 22 is a perspective view showing a region B surrounded by a double-dashed chain line in FIG. 18 in an enlarged manner.

FIG. 21 is a perspective view showing a region A surrounded by a double-dashed chain line in FIG. 18 in an enlarged manner, and shows the connector coupling body 100A and a plurality of pipes connected to the connector coupling body 100A. FIG. 22 is a perspective view showing a region B surrounded by a double-dashed chain line in FIG. 18 in an enlarged manner, and shows the connector coupling body 100B and a plurality of pipes connected to the connector coupling body 100B.

As shown in FIG. 21 and FIG. 22, the lattice structure coupling body 101 according to the third embodiment includes two connector coupling bodies 100A and two connector coupling bodies 100B for suppressing lowering of workability at the time of assembling the lattice structure coupling body 101. These connector coupling bodies 100A, 100B differ from each other in structure. These connector coupling bodies 100A, 100B differ from each other mainly with respect to a positional relationship between the main pipes 50 and the inclined pipes 60 with respect to a center line L of a pin insertion hole 71P. By using two kinds of connector coupling bodies 100A, 100B which differ from each other in structure, lowering of assembling workability at the time of assembling the lattice structure coupling body 101 can be suppressed by making the center lines L of four pin insertion holes 71P parallel to each other while suppressing lowering of a strength of the lattice structure coupling body 101.

The two connector coupling bodies 100A are connector coupling bodies to which end portions of two main pipes 501, 503 disposed at positions corresponding to two vertices positioned diagonally among four vertices of the rectangular shape are connected. The two connector coupling bodies 100B are connector coupling bodies to which end portions of two main pipes 502, 504 disposed at positions corresponding to another two vertices positioned diagonally among four vertices of the rectangular shape are connected.

As shown in FIG. 18 and FIG. 21, each of the two connector coupling bodies 100A includes a connector 70A of the lattice structure 16C, a counterpart connector 80A of the counterpart lattice structure 16B, and a coupling pin 90 for coupling these connectors 70A, 80A to each other.

As shown in FIG. 18 and FIG. 22, each of the two connector coupling bodies 100B includes a connector 70B of the lattice structure 16C, a counterpart connector 80B of the counterpart lattice structure 16B, and a coupling pin 90 for coupling these connectors 70B, 80B to each other.

Hereinafter, in FIG. 19, out of two connectors 70A, 70A positioned on a left side of the lattice structure 16C, one connector 70A connected to the first main pipe 501 is referred to as a first connector 701, and the other connector 70A connected to the third main pipe 503 positioned diagonally to the one connector 70A is referred to as a third connector 703. In the same manner, the counterpart connector 80A coupled to the first connector 701 is referred to as a first counterpart connector 801, and the counterpart connector 80A coupled to the third connector 703 is referred to as a third counterpart connector 803. In FIG. 19, out of two connectors 70B, 70B positioned on the left side of the lattice structure 16C, one connector 70B connected to the second main pipe 502 is referred to as a second connector 702, and the other connector 70B connected to the fourth main pipe 504 positioned diagonally to the one connector 70B is referred to as a fourth connector 704. In the same manner, the counterpart connector 80B coupled to the second connector 702 is referred to as a second counterpart connector 802, and the counterpart connector 80B coupled to the fourth connector 704 is referred to as a fourth counterpart connector 804.

As shown in FIG. 21 and FIG. 22, each of the first to fourth connectors 701 to 704 has a connector body portion 76 and a coupling portion 71. The connector body portion 76 includes a main pipe connecting portion 72, and an inclined pipe connecting portion 73. Each of the first to fourth counterpart connectors 801 to 804 has a connector body portion 86, and a coupling portion 81. The connector body portion 86 includes a main pipe connecting portion 82, and an inclined pipe connecting portion 83. A pin insertion hole 71P through which the coupling pin 90 passes is formed in the coupling portion 71 of each connector, and a pin insertion hole 71P through which the coupling pin 90 passes is formed in a coupling portion 81 of each counterpart connector. As shown in FIG. 21 and FIG. 22, by inserting the coupling pin 90 in a state where the position of the pin insertion hole 71P of the connector and the position of the pin insertion hole 71P of the counterpart connector corresponding to the connector are aligned with each other, the connector and the counterpart connector are coupled to each other.

As shown in FIG. 18, FIG. 19, FIG. 21 and FIG. 22, end portions of the first to fourth main pipes 501 to 504 in the lattice structure 16C are connected to the main pipe connecting portions 72 of the first to fourth connectors 701 to 704, respectively. As shown in FIG. 18, FIG. 19, FIG. 21 and FIG. 22, end portions of the first to fourth main pipes 501 to 504 in the counterpart lattice structure 16B are connected to the main pipe connecting portions 82 of the first to fourth counterpart connectors 801 to 804, respectively.

As shown in FIG. 18, FIG. 19, FIG. 21 and FIG. 22, the plurality of inclined pipes 60 in the lattice structure 16C include first to fourth inclined pipes 601 to 604 which are connected to the first to fourth connectors 701 to 704, respectively. One end portions of the first to fourth inclined pipes 601 to 604 are connected to the inclined pipe connecting portions 73 of the first to fourth connectors 701 to 704, respectively. As shown in FIG. 18, FIG. 19, FIG. 21 and FIG. 22, the plurality of counterpart inclined pipes 60 in the counterpart lattice structure 16B include first to fourth counterpart inclined pipes 601 to 604 connected to the first to fourth counterpart connectors 801 to 804, respectively. One end portions of the first to fourth counterpart inclined pipes 601 to 604 are connected to the inclined pipe connecting portions 83 of the first to fourth counterpart connectors 801 to 804, respectively.

One end portion of the first inclined pipe 601 is connected to the first main pipe 501 by way of the first connector 701, and the other end portion of the first inclined pipe 601 is connected to the fourth main pipe 504. One end portion of the second inclined pipe 602 is connected to the second main pipe 502 by way of the second connector 702, and the other end portion of the second inclined pipe 602 is connected to the first main pipe 501. One end portion of the third inclined pipe 603 is connected to the third main pipe 503 by way of the third connector 703, and the other end portion of the third inclined pipe 603 is connected to the second main pipe 502. One end portion of the fourth inclined pipe 604 is connected to the fourth main pipe 504 by way of the fourth connector 704, and the other end portion of the fourth inclined pipe 604 is connected to the third main pipe 503.

All of the first to fourth inclined pipes 601 to 604 in the lattice structure 16C extend from the corresponding connector toward a side opposite to the counterpart lattice structure 16B in the longitudinal direction of the lattice structure coupling body 101.

The lattice structure coupling body 101 according to the third embodiment having the above-mentioned structure has the following features. In the third embodiment, as shown in FIG. 19, center lines L of four pin insertion holes 71P in the first to fourth connectors 701 to 704 are parallel to each other.

As shown in FIG. 19 and FIG. 21, in the lattice structure 16C, the first main pipe 501 connected to the first connector 701 extends in a main direction D, and the first inclined pipe 601 connected to the first connector 701 extends in a first inclined direction D1.

As shown in FIG. 22, in the lattice structure 16C, the second main pipe 502 connected to the second connector 702 extends in the main direction D in the same manner as the first main pipe 501, and the second inclined pipe 602 connected to the second connector 702 extends in a second inclined direction D2. One end portion of the second inclined pipe 602 is connected to the second connector 702, and the other end portion of the second inclined pipe 602 is connected to the first main pipe 501.

As shown in FIG. 19, in the lattice structure 16C, the third main pipe 503 connected to the third connector 703 and the fourth main pipe 504 connected to the fourth connector 704 extend in the main direction D in the same manner as the first main pipe 501. In the lattice structure 16C, the third inclined pipe 603 connected to the third connector 703 extends in a third inclined direction D3, and the fourth inclined pipe 604 connected to the fourth connector 704 extends in a fourth inclined direction D4.

As shown in FIG. 19, FIG. 21 and FIG. 22, a first plane parallel to the main direction D and the first inclined direction D1 intersects with a second plane parallel to the main direction D and the second inclined direction D2. In this embodiment, the first plane is orthogonal to the second plane. The first plane is parallel to a third plane parallel to the main direction D and the third inclined direction D3. The first plane is orthogonal to a fourth plane parallel to the main direction D and the fourth inclined direction D4. The second plane and the fourth plane are parallel to each other.

Although the first plane and the second plane (or the fourth plane) are orthogonal to each other as described above, the center lines L of four pin insertion holes 71P in the first to fourth connectors 701 to 704 are parallel to each other. To realize such a structure, as described previously, it is necessary to provide two kinds of connectors 70A, 70B which differ from each other in structure to the end portions of the lattice structure 16C. Specifically, it is necessary to arrange the two connectors 701, 703 at positions which correspond to diagonal positions of the rectangular shape, and to arrange the two connectors 702, 704 at positions which correspond to the other diagonal positions of the rectangular shape. To realize the above-mentioned structure, in each connector, a relative position of the inclined pipe connecting portion 73 with respect to the main pipe connecting portion 72 is set.

Since the third embodiment has the above-mentioned structure, it is possible to suppress lowering of workability at the time of assembling the lattice structure coupling body 101 by coupling the lattice structure 16C and the counterpart lattice structure 16B to each other.

Specifically, an operation of coupling the lattice structure 16C and the counterpart lattice structure 16B to each other includes coupling operations at four portions where four connectors 701 to 704 and four counterpart connectors 801 to 804 are connected to each other. In such a case, among the coupling operations at four portions, first, coupling operations at two upper portions are performed. Specifically, for example, in FIG. 18, the coupling operation between the first connector 701 and the first counterpart connector 801, and the coupling operation between the fourth connector 704 and the fourth counterpart connector 804 are performed. That is, the coupling between the first connector 701 to which the end portion of the first main pipe 501 is connected and the counterpart connector 801 which corresponds to the first connector 701 is performed by inserting the coupling pin 90 into the first pin insertion hole 71P, and the coupling between the fourth connector 704 to which the end portion of the fourth main pipe 504 is connected and the counterpart connector 804 which corresponds to the fourth connector 704 is performed by inserting the coupling pin 90 into the fourth pin insertion hole 71P.

In the third embodiment, the center line L of the first pin insertion hole 71P and the center line L of the fourth pin insertion hole 71P are parallel to each other. Accordingly, in a state where the coupling operations at two portions described above are completed, the lattice structure 16C can be swung up and down with respect to the counterpart lattice structure 16B about the center lines L of the first and fourth pin insertion holes 71P, 71P. Accordingly, the coupling operations of the remaining two portions can be easily performed. That is, an operation of aligning the position of the second connector 702 and the position of the second counterpart connector 802 which corresponds to the second connector 702 with each other and an operation of aligning the position of the third connector 703 and the position of the third counterpart connector 803 which corresponds to the third connector 703 with each other can be performed while swinging the lattice structure 16C with respect to the counterpart lattice structure 16B about the center lines L.

Figure 20:
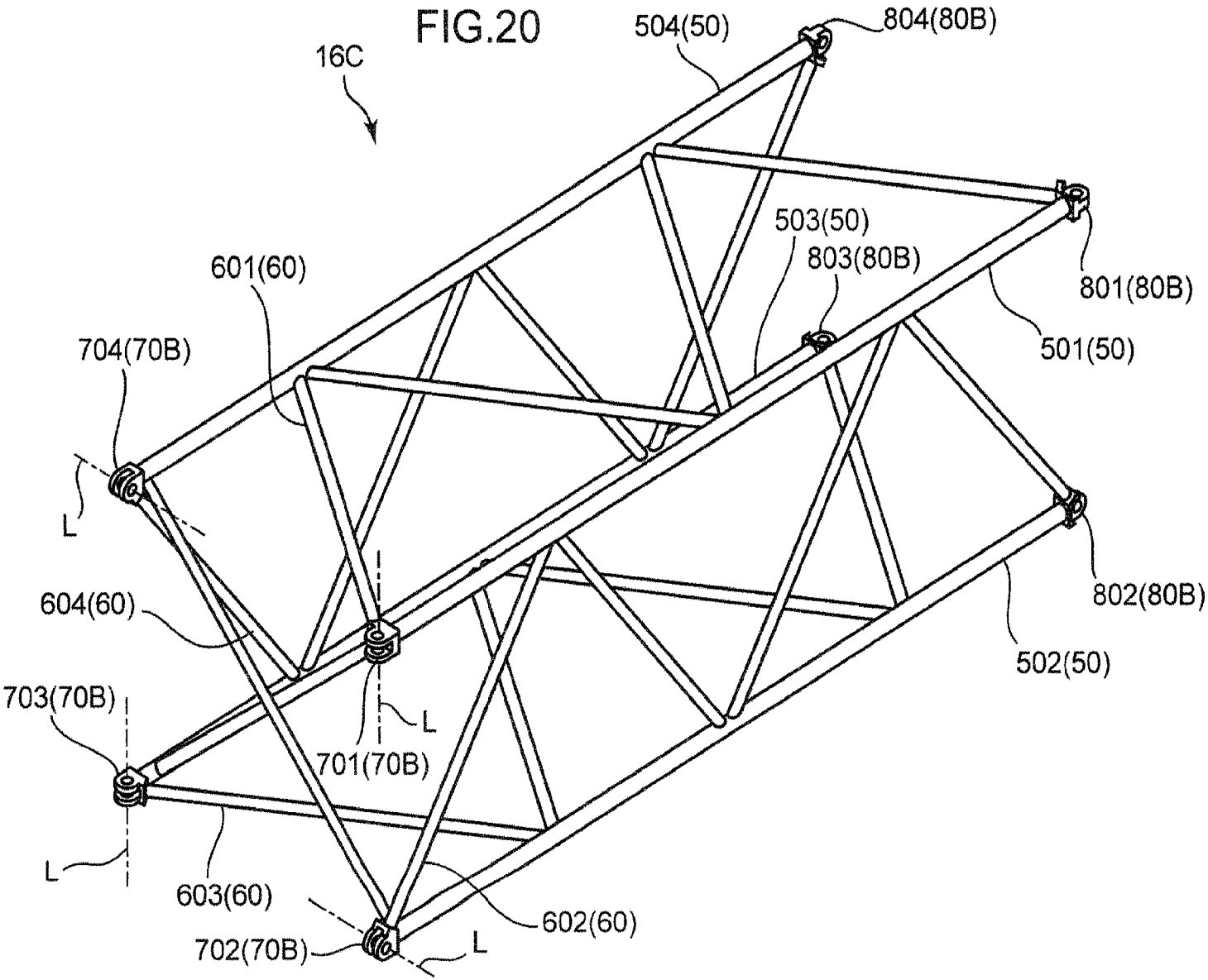
FIG. 20 is a perspective view showing another example of the lattice structure.

FIG. 20 is a perspective view showing the lattice structure 16C where the first to fourth connectors 701 to 704 have the same structures. In a mode shown in FIG. 20, the first plane is orthogonal to the second plane and the fourth plane. In this mode, all of the center lines L of four pin insertion holes 71P in the first to fourth connectors 701 to 704 cannot be made parallel to each other. Specifically, the center line L of the pin insertion hole 71P of the first connector 701 becomes parallel to the center line L of the pin insertion hole 71P of the third connector 703, but is orthogonal to the center line L of the pin insertion hole 71P of the second connector 702 and the center line L of the pin insertion hole 71P of the fourth connector 704.

The above-mentioned contents are the main features of the lattice structure coupling body 101 according to the third embodiment. Hereinafter, although the specific structure examples of the first to fourth connectors 701 to 704 and the first to fourth counterpart connectors 801 to 804 are described, the structures of the connector and the counterpart connector of the present invention are not limited to the following specific examples.

Figure 23:
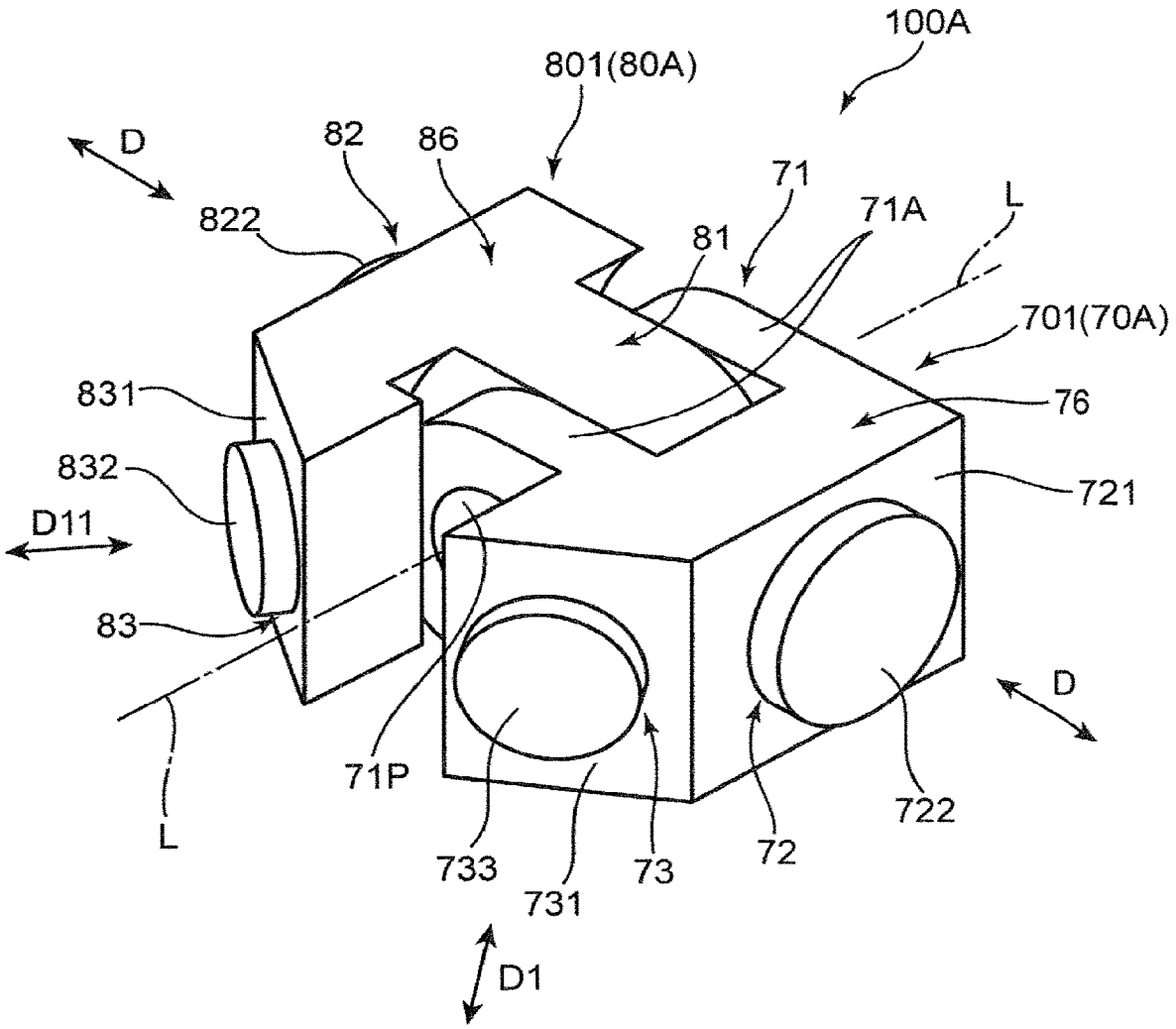
FIG. 23 is a perspective view showing a connector and a counterpart connector used in the region A.
Figure 24:
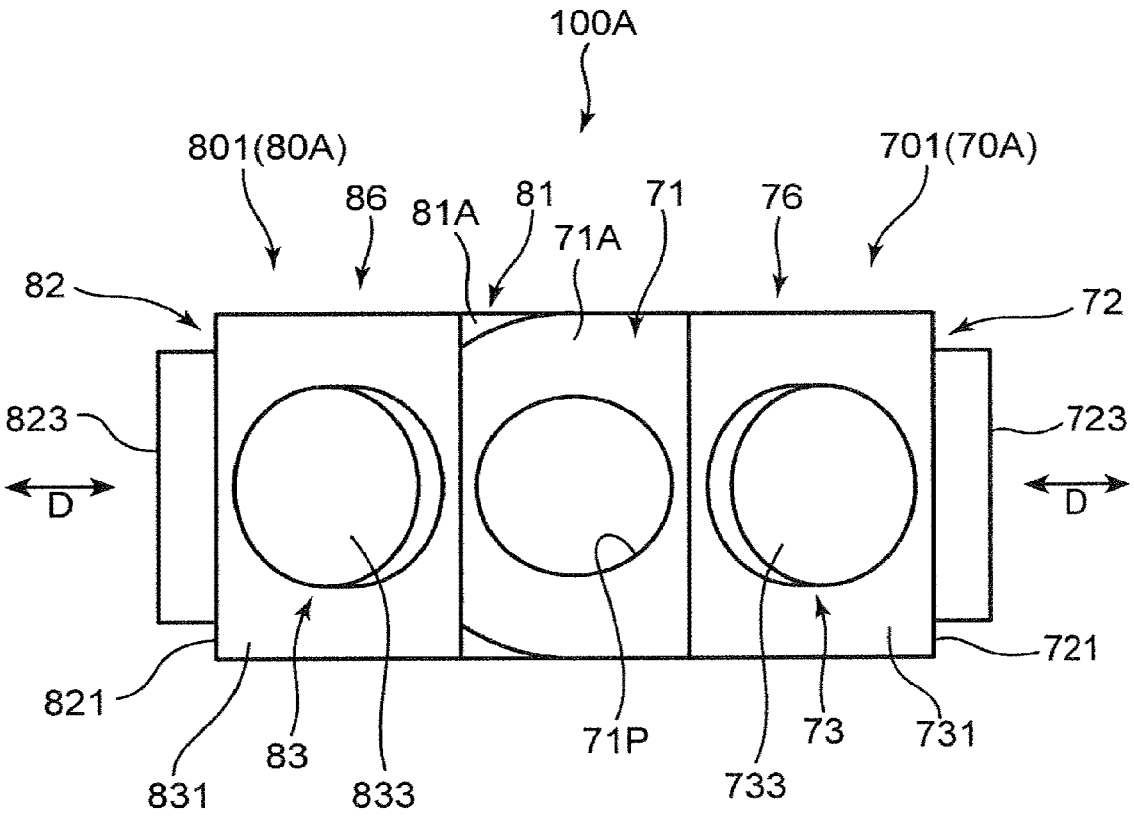
FIG. 24 is a side view showing the connector and the counterpart connector used in the region A.
Figure 25:
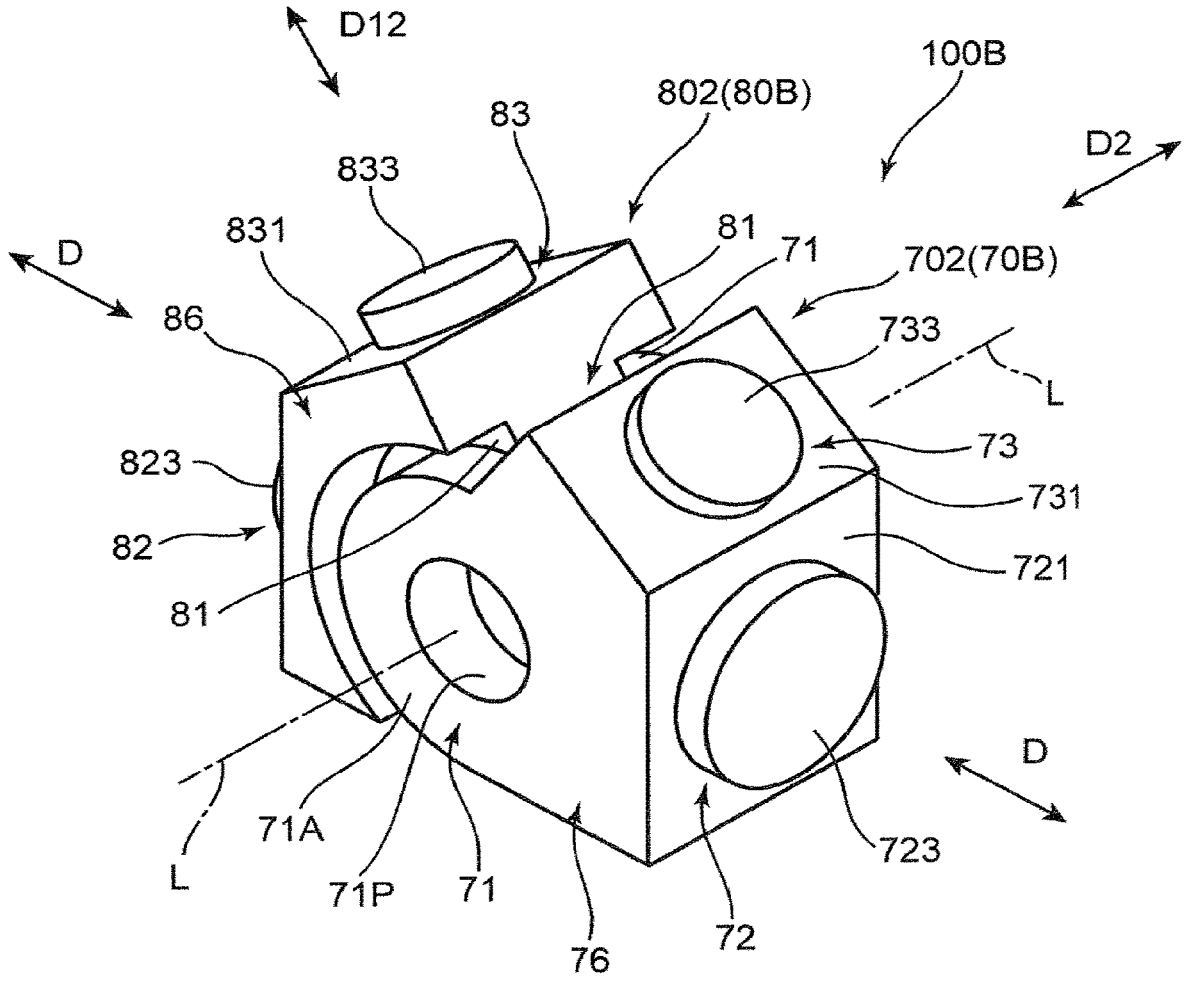
FIG. 25 is a perspective view showing a connector and a counterpart connector used in the region B.
Figure 26:
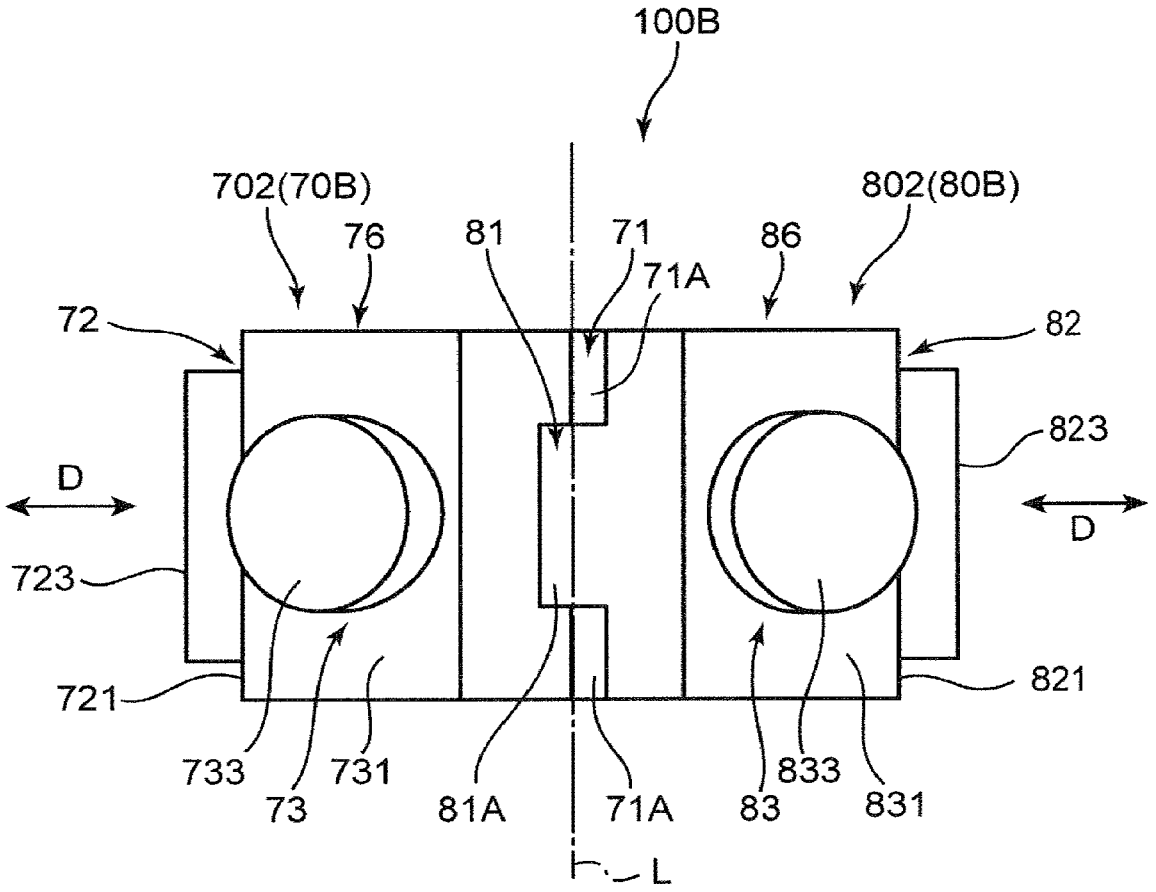
FIG. 26 is a plan view showing the connector and the counterpart connector used in the region B.

FIG. 23 is a perspective view showing the first connector 701 and the first counterpart connector 801, and FIG. 24 is a side view of the first connector 701 and the first counterpart connector 801. FIG. 25 is a perspective view showing the second connector 702 and the second counterpart connector 802, and FIG. 26 is a plan view of the second connector 702 and the second counterpart connector 802.

The third connector 703 and the third counterpart connector 803 have the same structure as the first connector 701 and the first counterpart connector 801, respectively. The fourth connector 704 and the fourth counterpart connector 804 have the same structure as the second connector 702 and the second counterpart connector 802, respectively. Hereinafter, the connector 701 and the counterpart connector 801 shown in FIG. 23 and FIG. 24 are referred to as a type-A connector coupling body 100A, and the connector 702 and the counterpart connector 802 shown in FIG. 25 and FIG. 26 are referred to as a type-B connector coupling body 100B.

These connector coupling bodies 100A, 100B differ from each other mainly with respect to a positional relationship between the main pipes 50 and the inclined pipes 60 with respect to a center line L of a pin insertion hole 71P. The specific configurations are as follows.

As shown in FIG. 21, FIG. 23 and FIG. 24, in the first connector 701 in the type-A connector coupling body 100A, a center line L of a pin insertion hole 71P is parallel to the first plane, that is, a plane parallel to the main direction D and the first inclined direction D1. This feature is realized by setting a relative position of the inclined pipe connecting portion 73 with respect to the main pipe connecting portion 72 in the first connector 701 and by setting a direction of the center line L of the pin insertion hole 71P with respect to these connecting portions 72, 73.

On the other hand, as shown in FIG. 22, FIG. 25 and FIG. 26, in the second connector 702 in the type-B connector coupling body 100B, a center line L of a pin insertion hole 71P is not parallel to the second plane, that is, a plane parallel to the main direction D and the second inclined direction D2, and extends in a direction intersecting with the second plane. Specifically, in the second connector 702 in the type-B connector coupling body 100B, the center line L of the pin insertion hole 71P is orthogonal to the second plane. This feature is realized by setting a relative position of the inclined pipe connecting portion 73 with respect to the main pipe connecting portion 72 in the second connector 702 and by setting a direction of the center line L of the pin insertion hole 71P with respect to these connecting portions 72, 73.

The structure of the first counterpart connector 801 in the type-A connector coupling body 100A is substantially equal to the structure of the first connector 701, and the structure of the second counterpart connector 802 in the type-B connector coupling body 100B is substantially equal to the structure of the second connector 702. The specific configurations are as follows.

As shown in FIG. 21, in the counterpart lattice structure 16B, the first counterpart inclined pipe 601 connected to the first counterpart connector 801 extends in a first counterpart inclined direction D11 and, as shown in FIG. 22, in the counterpart lattice structure 16B, the second counterpart inclined pipe 602 connected to the second counterpart connector 802 extends in a second counterpart inclined direction D12. Here, a plane parallel to the main direction D and the first counterpart inclined direction D11 is referred to as a first counterpart plane, and a plane parallel to the main direction D and the second counterpart inclined direction D12 is referred to as a second counterpart plane.

As shown FIG. 21, FIG. 23 and FIG. 24, in the first counterpart connector 801 of the type-A connector coupling body 100A, the center line L of the pin insertion hole 71P is parallel to the first counterpart plane. This feature is realized by setting a relative position of the inclined pipe connecting portion 83 with respect to the main pipe connecting portion 82 in the first counterpart connector 801 and by setting a direction of the center line L of the pin insertion hole 71P with respect to these connecting portions 82, 83.

On the other hand, as shown in FIG. 22, FIG. 25 and FIG. 26, in the second counterpart connector 802 in the type-B connector coupling body 100B, the center line L of the pin insertion hole 71P is not parallel to the second counterpart plane and extends in a direction intersecting with the second counterpart plane. Specifically, in the second counterpart connector 802 in the type-B connector coupling body 100B, the center line L of the pin insertion hole 71P is orthogonal to the second counterpart plane. This feature is realized by setting a relative position of the inclined pipe connecting portion 83 with respect to the main pipe connecting portion 82 in the second counterpart connector 802 and by setting a direction of the center line L of the pin insertion hole 71P with respect to these connecting portions 82, 83.

The specific structures of the connector body portion 76, the coupling portion 71, the main pipe connecting portion 72, the inclined pipe connecting portion 73 and the like in the first and second connectors 701, 702 and the specific structures of the connector body portion 86, the coupling portion 81, the main pipe connecting portion 82, the inclined pipe connecting portion 83 and the like in the first and second counterpart connectors 801, 802 shown in FIG. 23 to FIG. 26 are substantially equal to those of the first embodiment and the second embodiment, respectively, and hence, these parts are given the same symbols as the first embodiment and the second embodiment and detailed description thereof is omitted.

Figure 27:
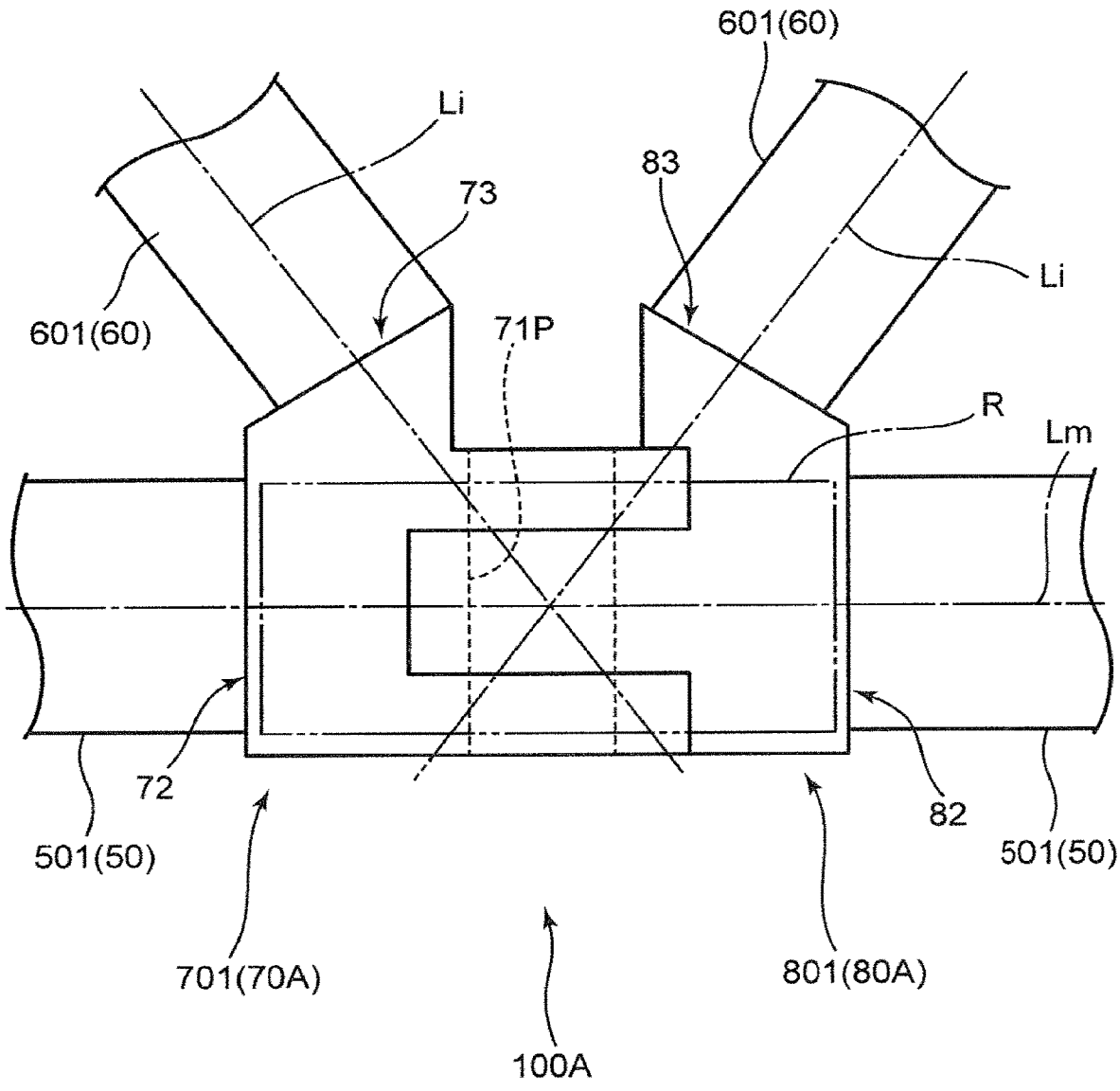
FIG. 27 is a bottom plan view showing the region A in an enlarged manner.
Figure 28:
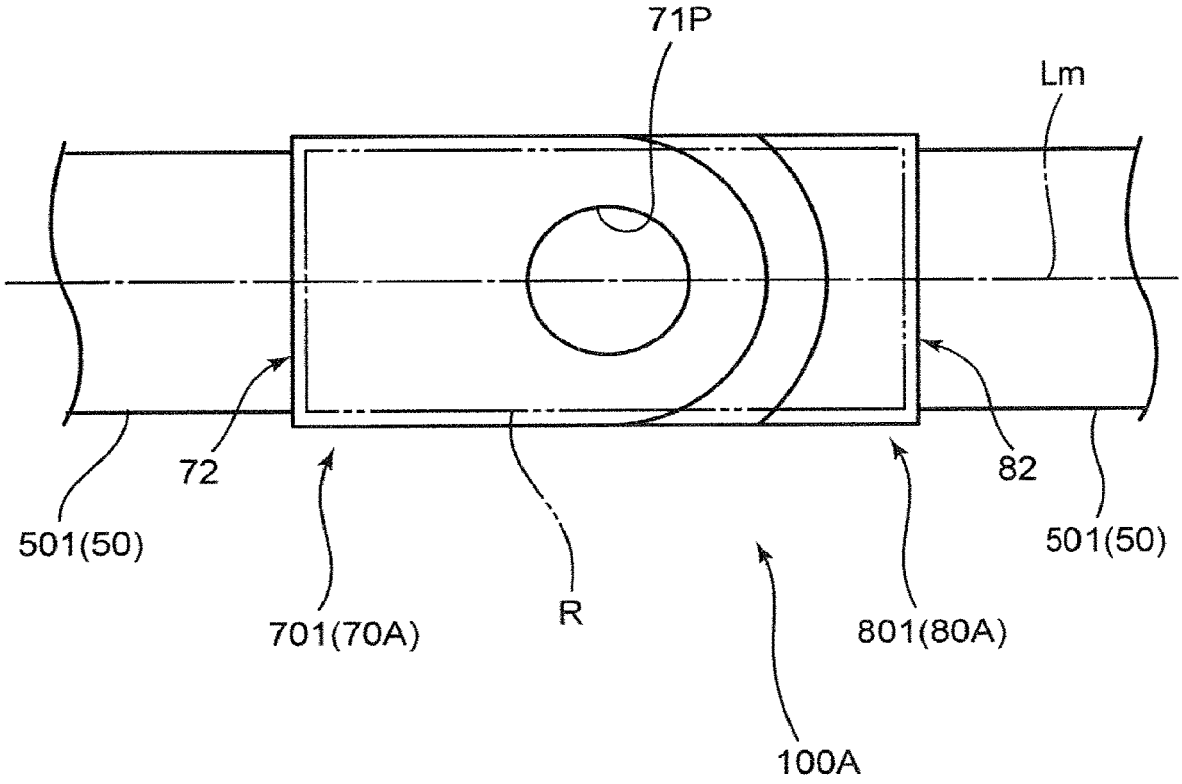
FIG. 28 is a side view showing the region A in an enlarged manner.
Figure 29:
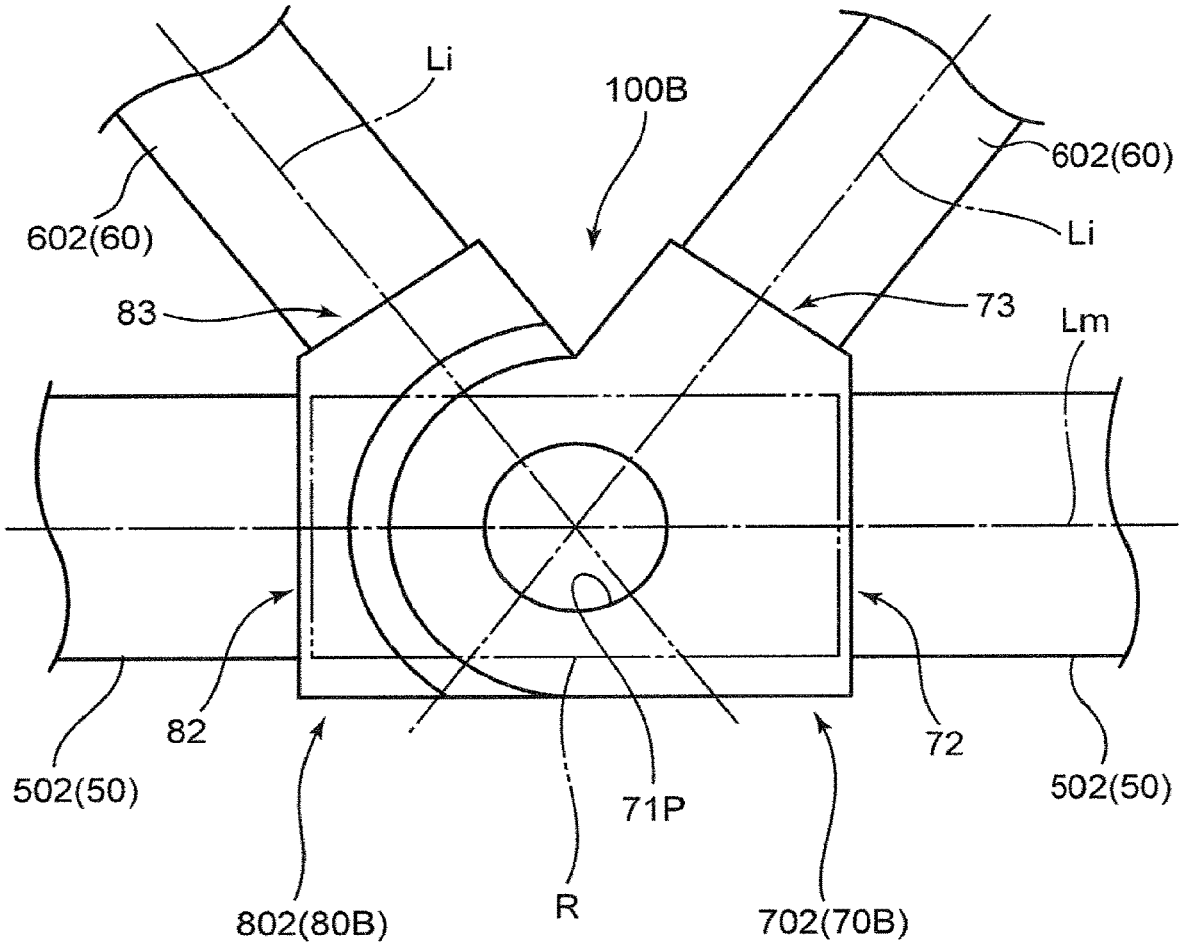
FIG. 29 is a side view showing the region B in an enlarged manner.
Figure 30:
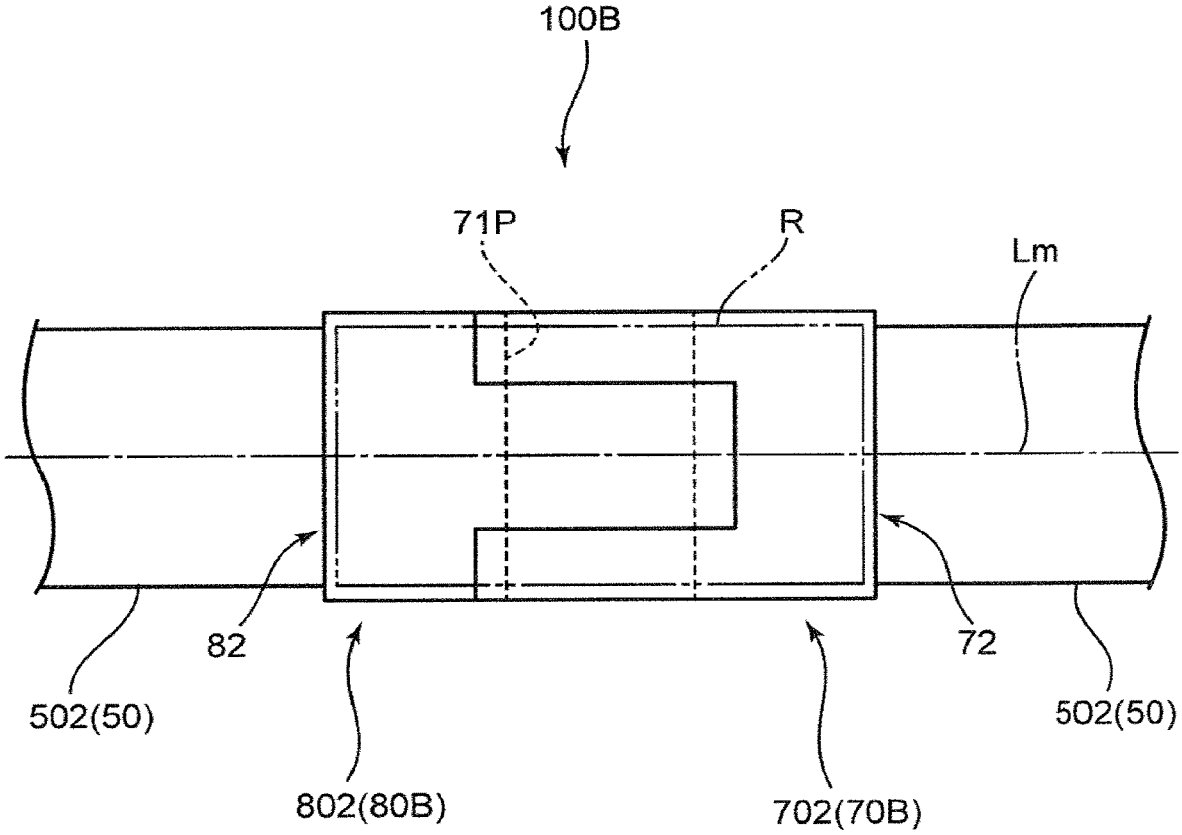
FIG. 30 is a bottom plan view showing the region B in an enlarged manner.

FIG. 27 is a bottom plan view showing the type-A connector coupling body 100A and a plurality of pipes connected to the type-A connector coupling body 100A, and FIG. 28 is a side view of the type-A connector coupling body 100A and the plurality of pipes. FIG. 29 is a side view showing the type-B connector coupling body 100B and a plurality of pipes connected to the type-B connector coupling body 100B, and FIG. 30 is a bottom plan view of the type-B connector coupling body 100B and the plurality of pipes.

As shown in FIG. 27 to FIG. 30, in the respective type-A connector coupling body 100A and the type-B connector coupling body 100B, the positional relationship between the main pipes 50, the inclined pipes 60, and the connector coupling body has the following features.

In any type connector coupling body out of the type-A and type-B connector coupling bodies, all of a center axis line Lm of the main pipes 50 and center axis lines Li of the inclined pipes 60 connected to the connector 70A (or connector 70B) pass through a region surrounded by a profile of the connector (an outer surface of the connector). Both the center axis line Lm and the center axis lines Li pass through at least one of a region surrounded by an inner peripheral surface which defines the pin insertion hole 71P of the connector and a region surrounded by an inner peripheral surface which defines the pin insertion hole 71P of the counterpart connector. Further, the center axis lines Li of the inclined pipes 60 pass through an overlapping region R (a region surrounded by a double-dashed chain line in FIG. 27 to FIG. 30). The overlapping region R is a region where at least one of the region surrounded by the profile of the connector (the outer surface of the connector) and the region surrounded by the profile of the counterpart connector (the outer surface of the counterpart connector) overlaps with a region surrounded by an imaginary plane formed by extending the outer peripheral surface of the main pipe 50 in a direction in which the main pipe 50 extends.

In the same manner, in any type connector coupling body out of the type-A and type-B connector coupling bodies, both the center axis line Lm of the main pipes 50 and center axis lines Li of the inclined pipes 60 connected to the counterpart connector 80A (or counterpart connector 80B) pass through a region surrounded by a profile of the counterpart connector. Both the center axis line Lm and the center axis lines Li pass through at least one of a region surrounded by an inner peripheral surface which defines the pin insertion hole 71P of the connector and a region surrounded by an inner peripheral surface which defines the pin insertion hole 71P of the counterpart connector. Further, the center axis lines Li of the inclined pipes 60 pass through the overlapping region R, that is, the overlapping region R where at least one of a region surrounded by the profile of the connector and the region surrounded by the profile of the counterpart connector overlaps with the region surrounded by the imaginary plane formed by extending the outer peripheral surface of the main pipe 50 in the direction in which the main pipe 50 extends.

Fourth Embodiment

A lattice structure coupling body 101 according to a fourth embodiment of the present invention is characterized in that one main pipe 50 and a plurality of inclined pipes 60 are connected to one connector, and one main pipe 50 and a plurality of inclined pipes 60 are connected to one counterpart connector. In contrast, in the first to third embodiments, one main pipe 50 and one inclined pipe 60 are connected to one connector. Hereinafter, there may be a case where the lattice structure coupling body 101 according to the first to third embodiments is referred to as a lattice-discrete-type lattice structure coupling body, and the lattice structure coupling body 101 according to the fourth embodiment is referred to as a lattice-collective-type lattice structure coupling body.

Figure 31:
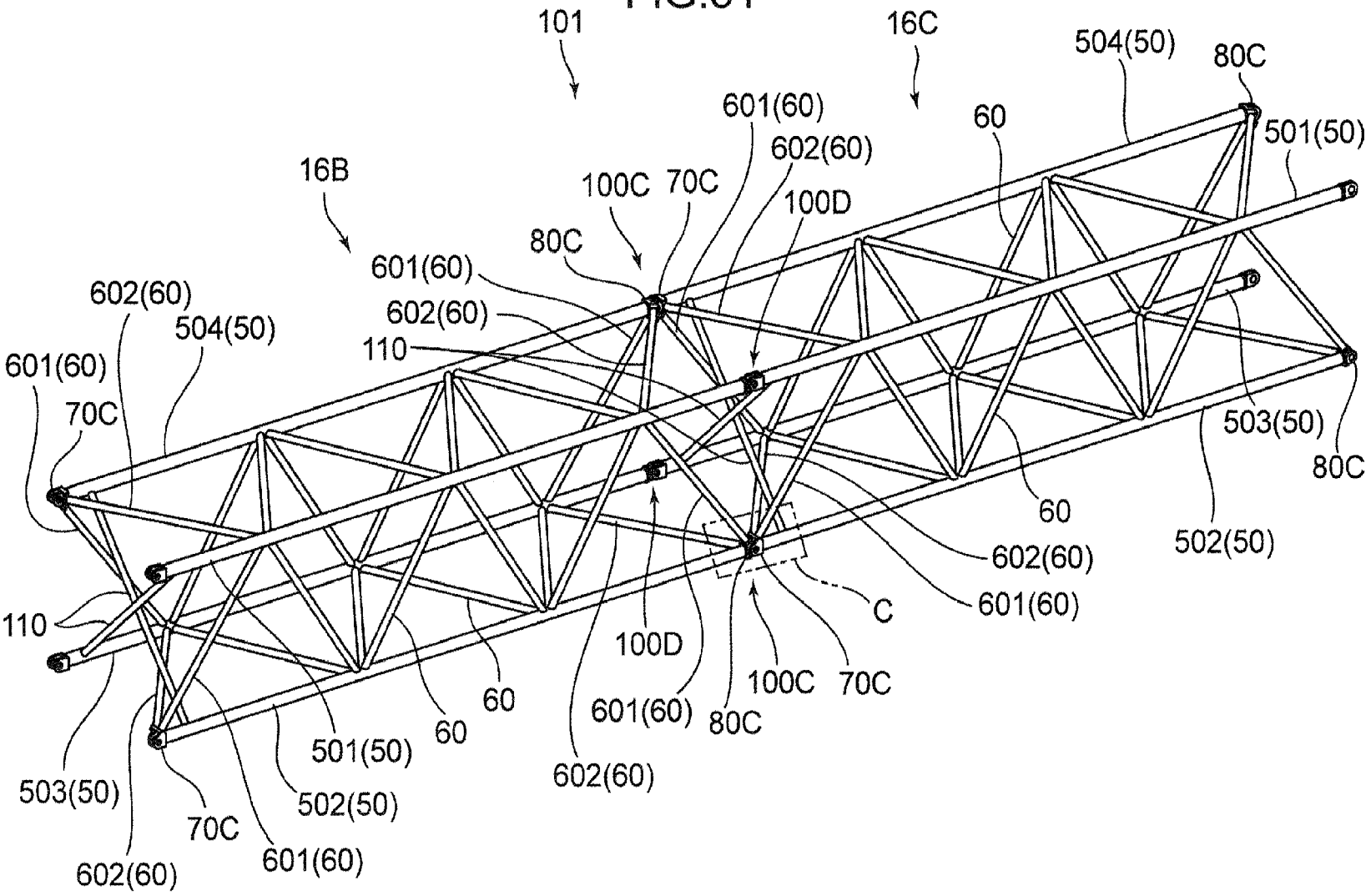
FIG. 31 is a perspective view showing a lattice structure coupling body according to a fourth embodiment of the present invention.
Figure 32:
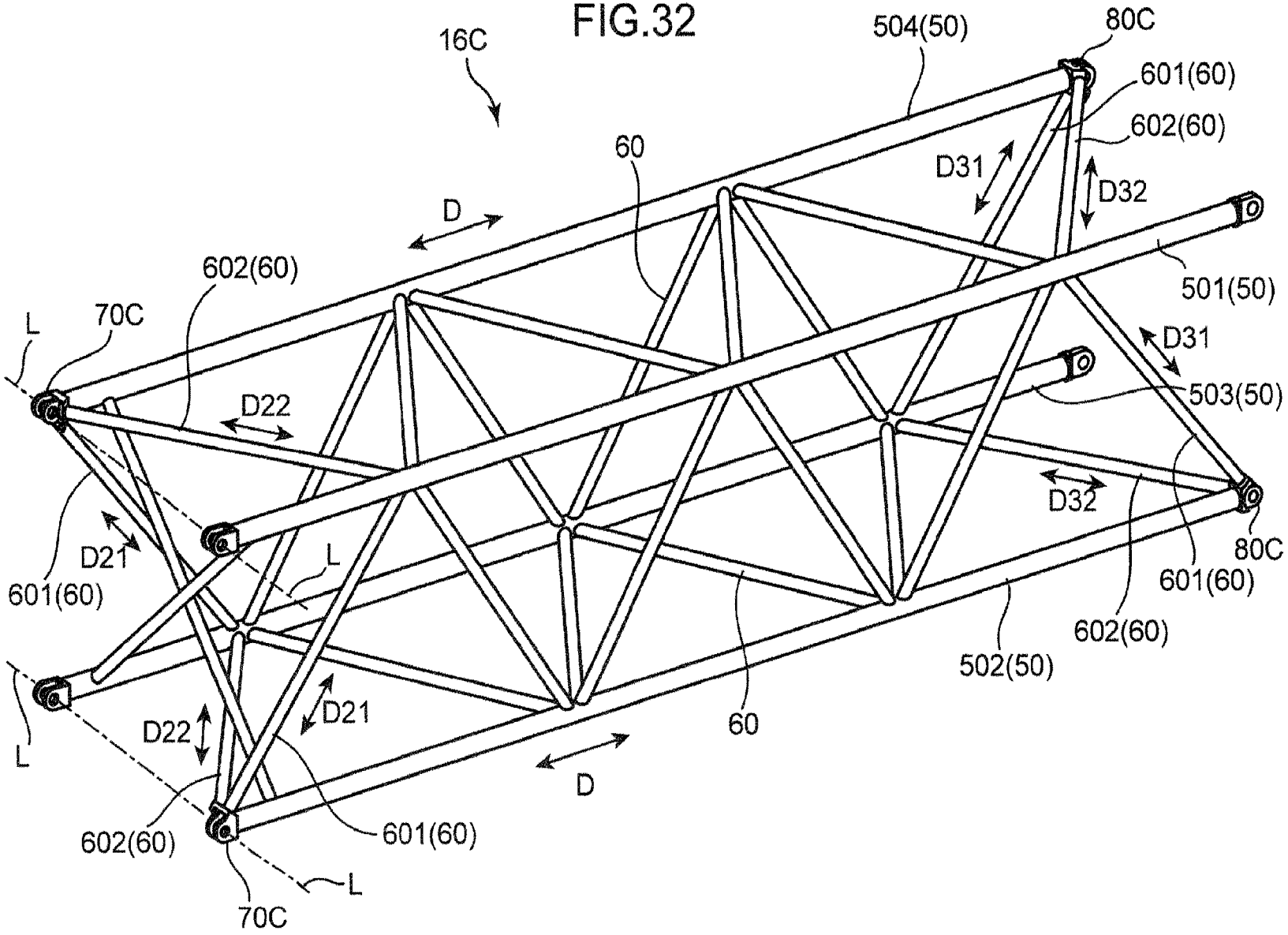
FIG. 32 is a perspective view showing a lattice structure which the lattice structure coupling body according to the fourth embodiment includes.

FIG. 31 is a perspective view showing the lattice-collective-type lattice structure coupling body 101 according to the fourth embodiment, and FIG. 32 is a perspective view showing a lattice structure 16C which the lattice-collective-type lattice structure coupling body 101 includes.

As shown in FIG. 31, the basic structure of the lattice structure coupling body 101 according to the fourth embodiment is substantially equal to the structure of the lattice structure coupling body 101 according to the third embodiment shown in FIG. 18. Hereinafter, a point which makes the fourth embodiment differ from the third embodiment is mainly described, and configurations of the fourth embodiment substantially equal to those of the third embodiment are given the same symbols and detailed description thereof may be omitted.

Also in the fourth embodiment, the lattice structure coupling body 101 includes a boom member 16C (lattice structure 16C), a boom member 16B (counterpart lattice structure 16B), and four connector coupling bodies for coupling these boom members 16B, 16C to each other.

As shown in FIG. 31, four connector coupling bodies are foil led of two connector coupling bodies 100C to which the plurality of inclined pipes 60 are connected, and two connector coupling bodies 100D to which the inclined pipe 60 is not connected. Two connector coupling bodies 100C have the same structure, and two connector coupling bodies 100D have the same structure.

The two connector coupling bodies 100C are connector coupling bodies to which end portions of two main pipes 502, 504 disposed at positions corresponding to two vertices positioned diagonally among four vertices of the rectangular shape are connected, respectively. The two connector coupling bodies 100D are connector coupling bodies to which end portions of two main pipes 501, 503 disposed at positions corresponding to another two vertices positioned diagonally among four vertices of the rectangular shape are connected, respectively. As two connector coupling bodies 100D to which the inclined pipe 60 is not connected, a conventional connector coupling body can be used. Hereinafter, the structure of two connector coupling bodies 100C to which the plurality of inclined pipes 60 are connected is described.

[Connector Coupling Body]

Figure 33:
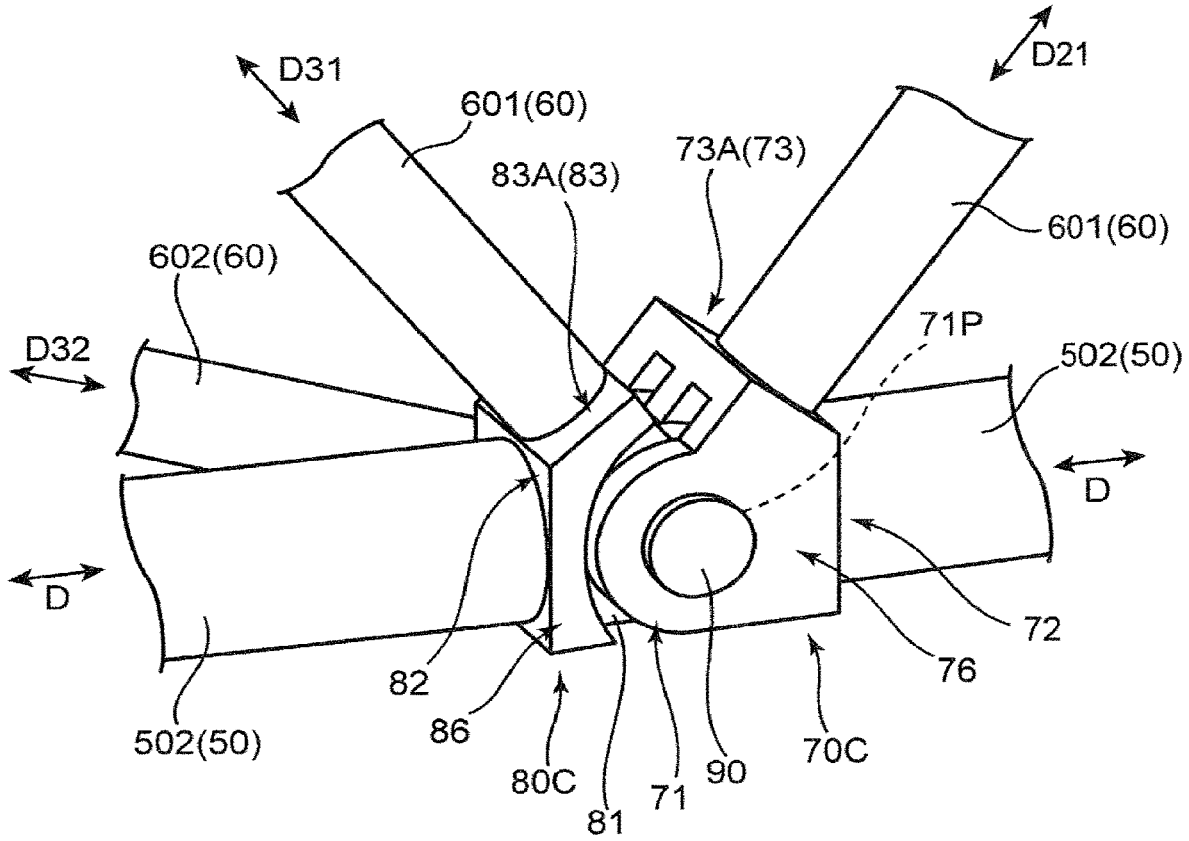
FIG. 33 is a perspective view showing a region C surrounded by a double-dashed chain line in FIG. 31 in an enlarged manner.
Figure 34:
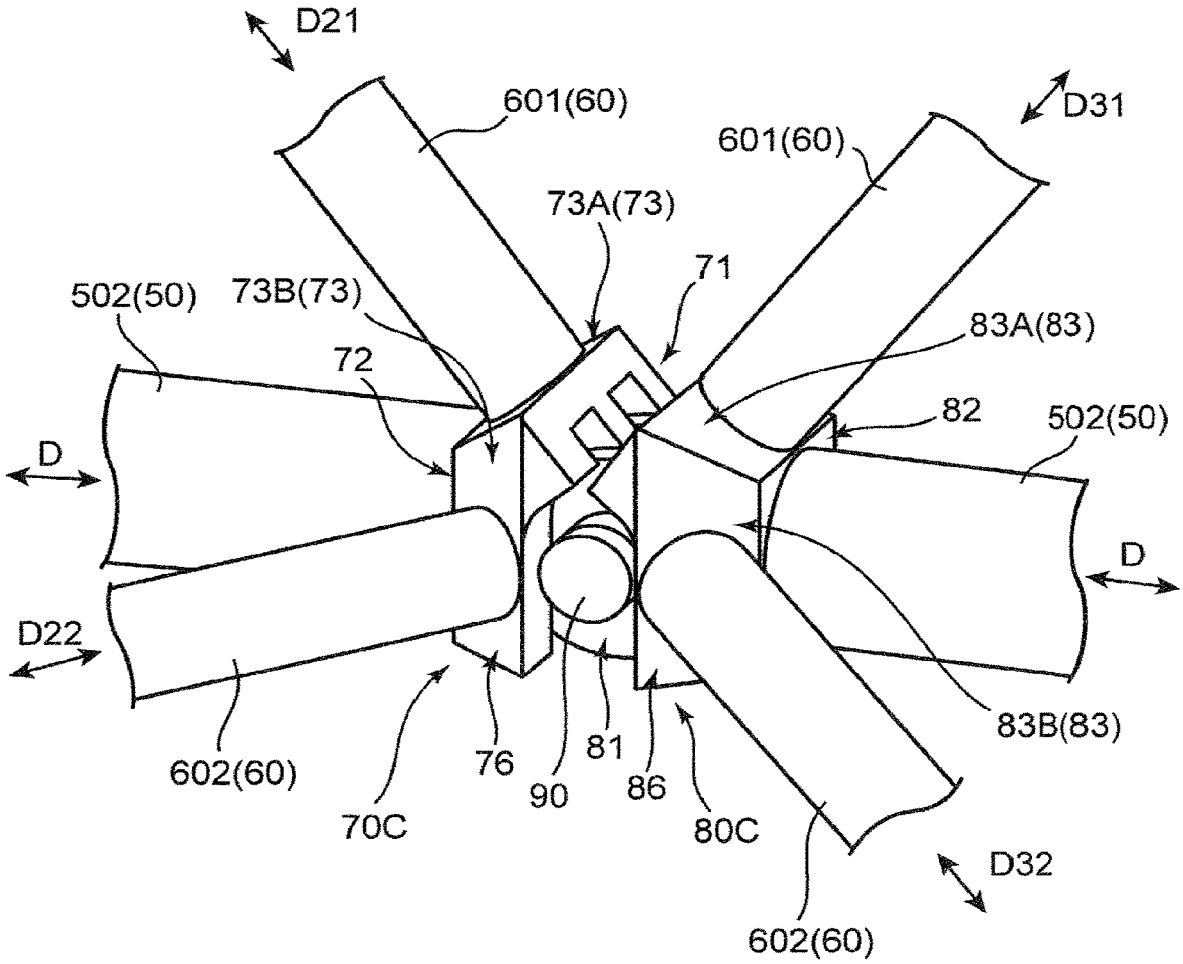
FIG. 34 is a perspective view showing the region C surrounded by a double-dashed chain line in FIG. 31 in an enlarged manner, and is a view of the region C as viewed from a side opposite to FIG. 33.

FIG. 33 is a perspective view showing a region C surrounded by a double-dashed chain line in FIG. 31 in an enlarged manner, and shows the connector coupling body 100C and a plurality of pipes connected to the connector coupling body 100C. FIG. 34 is a perspective view showing the region C in an enlarged manner, wherein the region C is viewed from a side opposite to a viewing side in FIG. 33.

Each of two connector coupling body 100C to which the plurality of inclined pipes 60 are connected includes a connector 70C, a counterpart connector 80C, and a coupling pin 90 for coupling these connectors 70C, 80C to each other. The two connector coupling bodies 1000 have the same structure and hence, hereinafter, the description is made with respect to the connector coupling body 100C disposed in the region C in FIG. 31.

As shown in FIG. 32, in the lattice structure coupling body 101 according to the fourth embodiment, in the same manner as the third embodiment, the center lines L of four connector pin insertion holes 71P in four connector coupling bodies 100C, 100D are parallel to each other. Accordingly, lowering of assembling workability at the time of assembling the lattice structure coupling body 101 is suppressed.

As shown in FIG. 33 to FIG. 34, the connector 70C has a connector body portion 76, and a coupling portion 71. The connector body portion 76 includes a main pipe connecting portion 72, and inclined pipe connecting portions 73. The counterpart connector 80C has a connector body portion 86, and a coupling portion 81. The connector body portion 86 includes a main pipe connecting portion 82, and inclined pipe connecting portions 83.

A pin insertion hole 71P through which the coupling pin 90 passes is formed in a coupling portion 71 of the connector 70C, and a pin insertion hole 71P through which the coupling pin 90 passes is formed in a coupling portion 81 of the counterpart connector 80C. As shown in FIG. 33 and FIG. 34, by inserting the coupling pin 90 into the pin insertion hole 71P of the connector 70C and the pin insertion hole 71P of the counterpart connector 80C in a state where the positions of both pin insertion holes 71P are aligned with each other, the connector 70C and the counterpart connector 80C are coupled to each other.

As shown in FIG. 32 and FIG. 33, end portions of the second main pipe 502 and the fourth main pipe 504 in the lattice structure 16C are connected to main pipe connecting portions 72 of two connectors 70C, respectively. End portions of the first main pipe 501 and the third main pipe 503 in the lattice structure 16C are connected to the main pipe connecting portions of two connectors to which the inclined pipe 60 is not connected, respectively. The same applies for the connection structure of four main pipes 50 in the counterpart lattice structure 16B.

As shown in FIG. 33 and FIG. 34, the plurality of inclined pipes 60 in the lattice structure 16C include two inclined pipes 60 (first inclined pipe 601 and second inclined pipe 602) connected to one connector 70C out of two connectors 70C, and two inclined pipes 60 (first inclined pipe 601 and second inclined pipe 602) connected to the other connector 70C. The two inclined pipes 60 (first inclined pipe 601 and second inclined pipe 602) are connected to the inclined pipe connecting portions 73 of one connector 70C. Specifically, as shown in FIG. 34, the inclined pipe connecting portions 73 of the connector 70C include a first connecting portion 73A and a second connecting portion 73B. The first connecting portion 73A is a portion to which one end portion of the first inclined pipe 601 extending in a first inclined direction D21 out of the two inclined pipes 601, 602 is connected, and the second connecting portion 73B is a portion to which one end portion of the second inclined pipe 602 extending in a second inclined direction D22 out of the two inclined pipes 601, 602 is connected.

A first plane parallel to a main direction D in which the main pipe 50 connected to the connector 70C extends and the first inclined direction D21 intersects with a second plane parallel to the main direction D and the second inclined direction D22. Specifically, in the fourth embodiment, the first plane is orthogonal to the second plane. In the connector 70C, a relative position between the first connecting portion 73A and the second connecting portion 73B is set such that the first plane is orthogonal to the second plane.

The one end portion of the first inclined pipe 601 connected to the first connecting portion 73A is connected to the second main pipe 502 by way of the connector 70C. The one end portion of the second inclined pipe 602 connected to the second connecting portion 73B is connected to the second main pipe 502 by way of the connector 70C. The other end portion of the first inclined pipe 601 connected to the first connecting portion 73A is connected to the first main pipe 501 which is one of two main pipes 501, 503 adjacent to the second main pipe 502 connected to the connector 70. The other end portion of the second inclined pipe 602 connected to the second connecting portion 73B is connected to the third main pipe 503 which is the other of two main pipes 501, 503 adjacent to the second main pipe 502 connected to the connector 70.

Both the first inclined pipe 601 and the second inclined pipe 602 in the lattice structure 16C extend from the connector 70 toward a side opposite to the counterpart lattice structure 16B in a longitudinal direction of the lattice structure coupling body 101.

As shown in FIG. 31, FIG. 33 and FIG. 34, the plurality of counterpart inclined pipes 60 in the counterpart lattice structure 16B include two counterpart inclined pipes 60 (first counterpart inclined pipe 601 and second counterpart inclined pipe 602) which are connected to one counterpart connector 80C out of two counterpart connectors 80C, and two counterpart inclined pipes 60 (first counterpart inclined pipe 601 and second counterpart inclined pipe 602) connected to the other counterpart connector 80C. The two counterpart inclined pipes 60 (first counterpart inclined pipe 601 and second counterpart inclined pipe 602) are connected to the inclined pipe connecting portions 83 of one counterpart connector 80C. Specifically, as shown in FIG. 34, the inclined pipe connecting portions 83 of the counterpart connector 80C include a first connecting portion 83A and a second connecting portion 83B. The first connecting portion 83A is a portion to which one end portion of the first counterpart inclined pipe 601 extending in a first counterpart inclined direction D31 out of the two counterpart inclined pipes 601, 602 is connected, and the second connecting portion 83B is a portion to which one end portion of the second counterpart inclined pipe 602 extending in a second counterpart inclined direction D32 out of the two counterpart inclined pipes 601, 602 is connected.

A first counterpart plane parallel to a main direction D in which the counterpart main pipe 50 connected to the connector 80C extends and the first counterpart inclined direction D31 intersects with a second counterpart plane parallel to the main direction D and the second counterpart inclined direction D32. Specifically, in the fourth embodiment, the first counterpart plane is orthogonal to the second counterpart plane. In the connector 80C, the relative positions of the first connecting portion 83A and the second connecting portion 83B are set such that the first counterpart plane is orthogonal to the second counterpart plane.

One end portion of the first counterpart inclined pipe 601 connected to the first connecting portion 83A is connected to the second counterpart main pipe 502 by way of the connector 80C. One end portion of the second counterpart inclined pipe 602 connected to the second connecting portion 83B is connected to the second counterpart main pipe 502 by way of the connector 80C. The other end portion of the first counterpart inclined pipe 601 connected to the first connecting portion 83A is connected to the first counterpart main pipe 501 which is one of two main pipes 501, 503 adjacent to the second counterpart main pipe 502 connected to the counterpart connector 80. The other end portion of the second counterpart inclined pipe 602 connected to the second connecting portion 83B is connected to the third counterpart main pipe 503 which is the other of two main pipes 501, 503 adjacent to the second counterpart main pipe 502 connected to the counterpart connector 80.

Both the first counterpart inclined pipe 601 and the second counterpart inclined pipe 602 in the counterpart lattice structure 16B extend from the counterpart connector 80 toward a side opposite to the lattice structure 16C in a longitudinal direction of the lattice structure coupling body 101.

In the lattice structure coupling body 101 according to the fourth embodiment having the above-mentioned structure, the first inclined pipe 60 extending in the first inclined direction D21 can be connected to the first connecting portion 73A in the connector 70C, and the second inclined pipe 60 extending in the second inclined direction D22 can be connected to the second connecting portion 73B in the connector 70C. That is, in this embodiment, two inclined pipes 60 are connected to one connector 70C. Thus, it is possible to form the stereoscopic complicated lattice-collective-type lattice arrangement excellent in strength.

Hereinafter, although the specific structure examples of the connector 70C and the counterpart connector 80C are described, the structures of the connector 70C and the counterpart connector 80C are not limited to the following specific examples.

Figure 35:
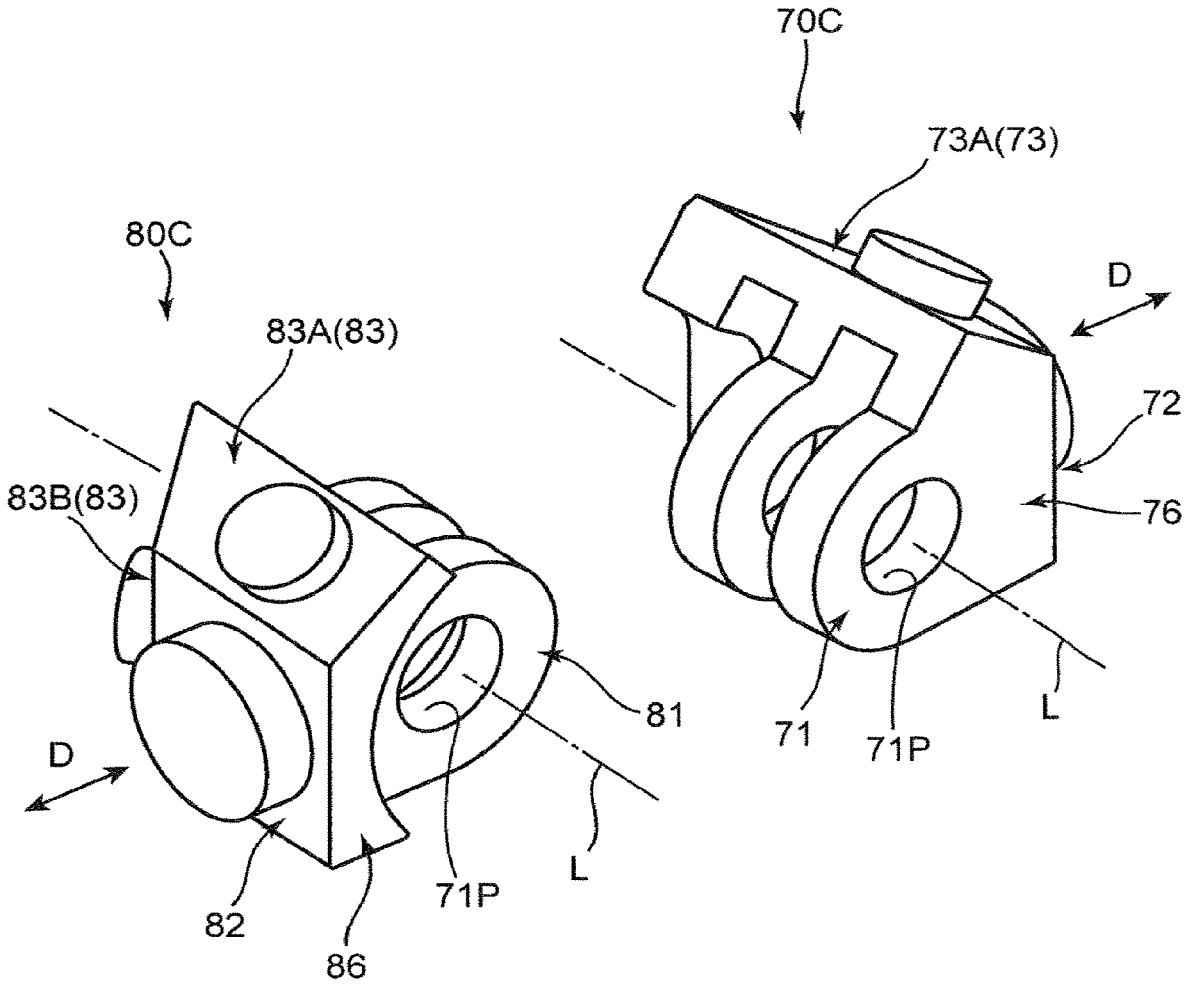
FIG. 35 is a perspective view showing a connector and a counterpart connector used for the lattice structure according to the fourth embodiment.
Figure 36:
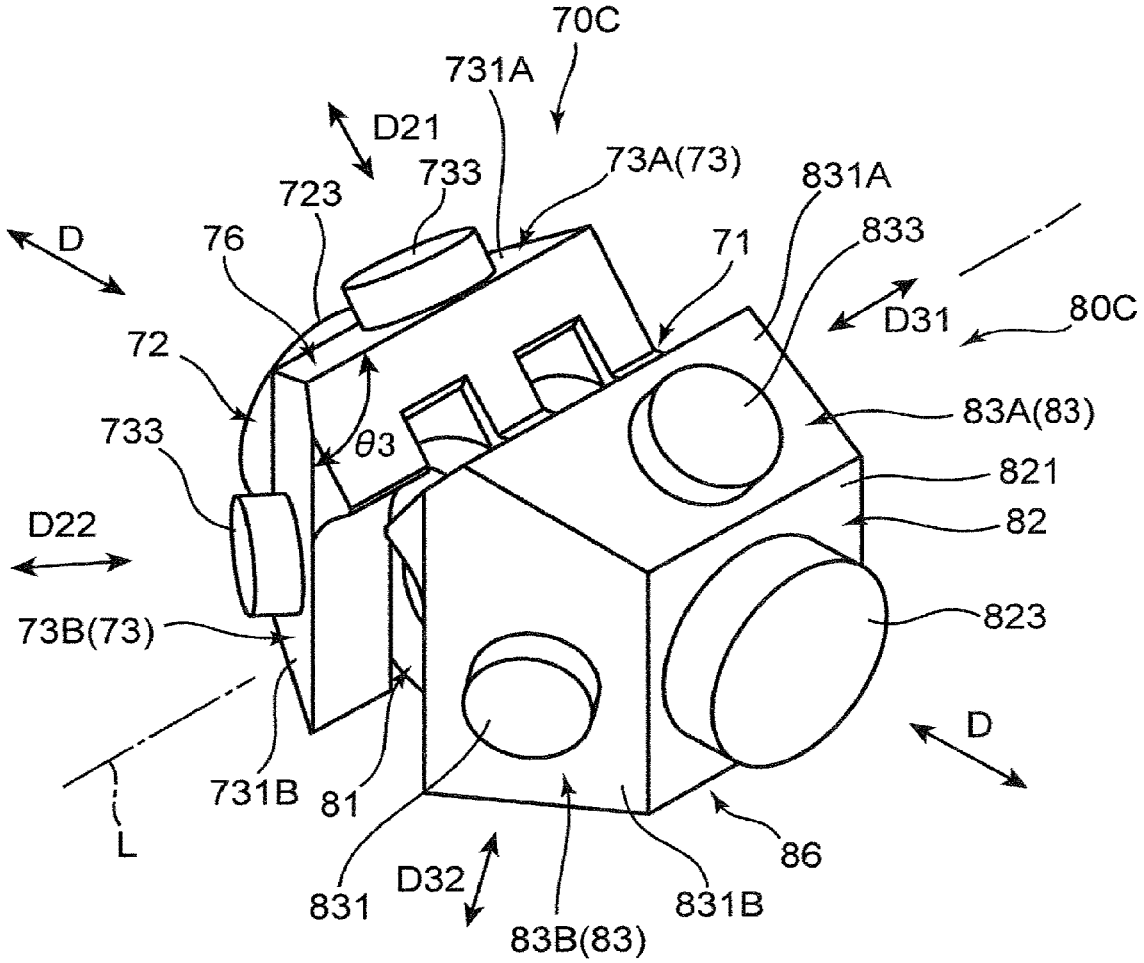
FIG. 36 is a perspective view showing the connector and the counterpart connector used for the lattice structure according to the fourth embodiment.
Figure 37:
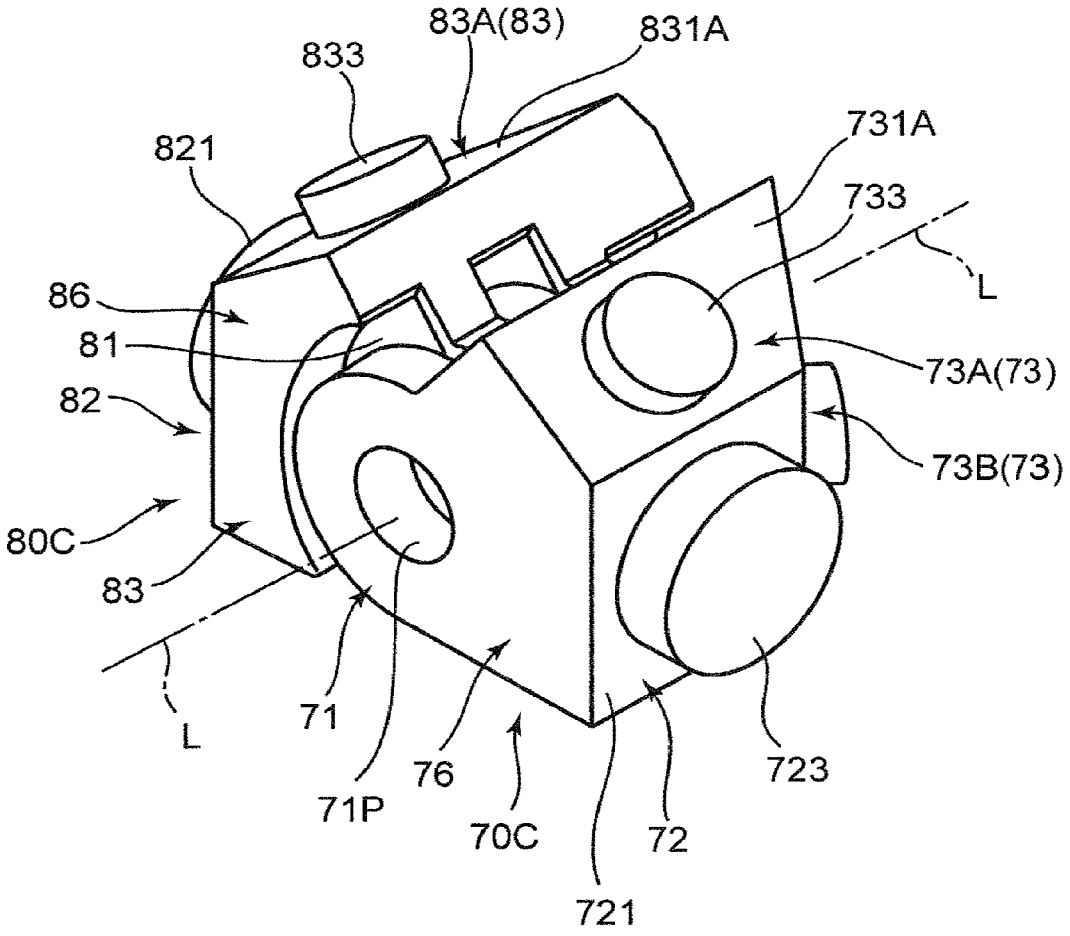
FIG. 37 is a perspective view showing the connector and the counterpart connector used for the lattice structure according to the fourth embodiment.
Figure 38:
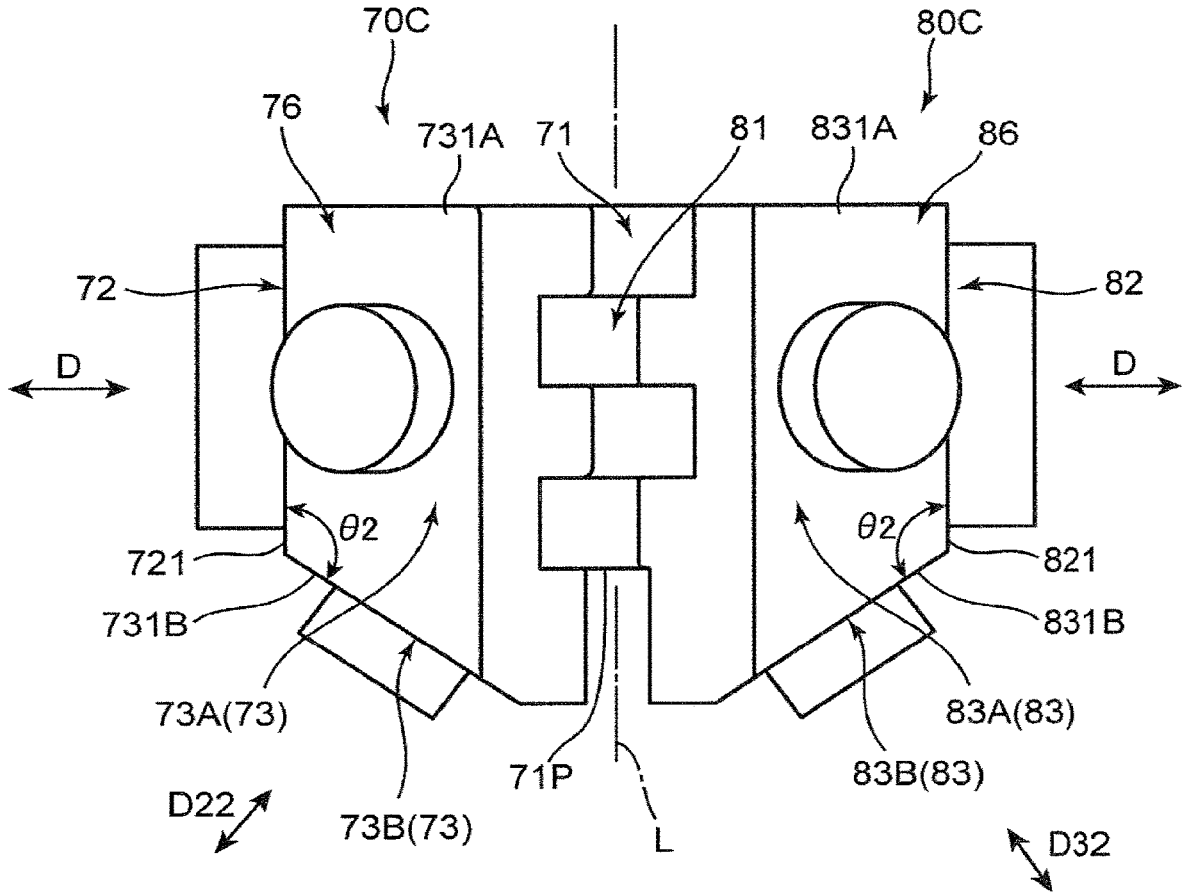
FIG. 38 is a plan view showing the connector and the counterpart connector used for the lattice structure according to the fourth embodiment.
Figure 39:
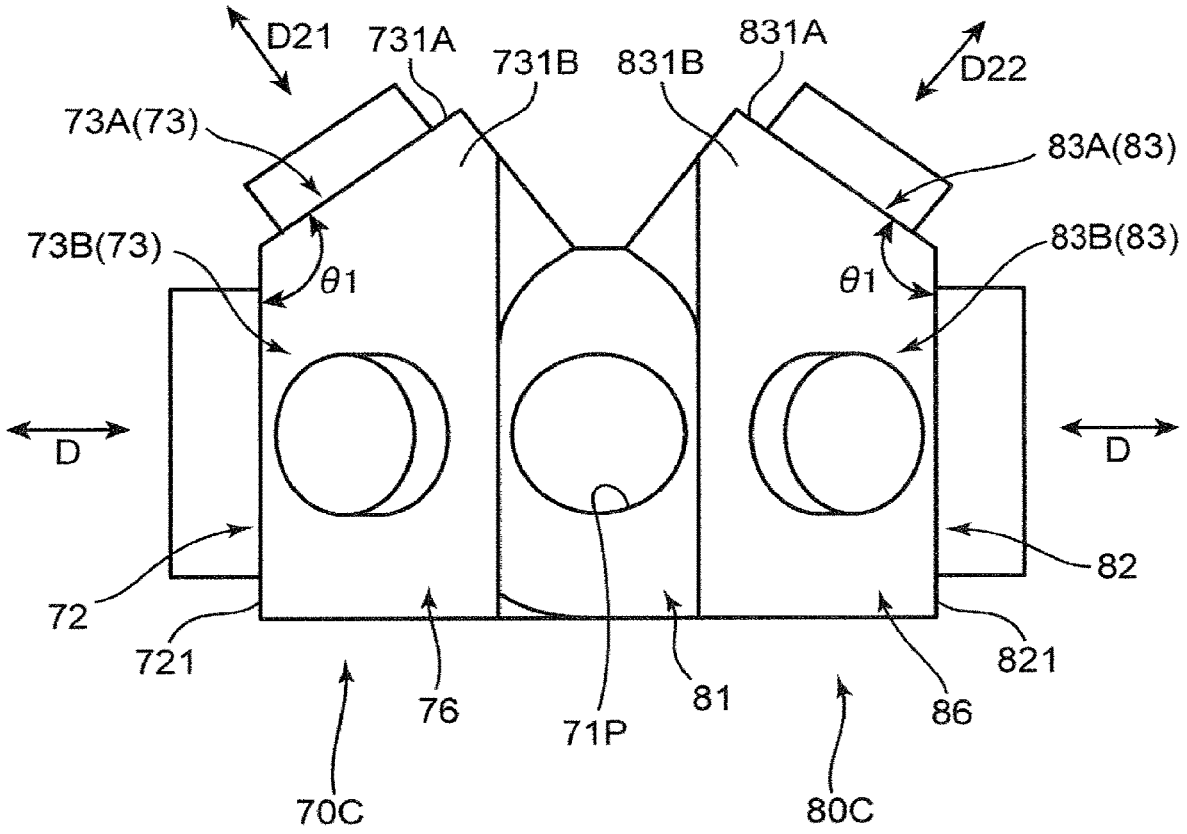
FIG. 39 is a side view showing the connector and the counterpart connector used for the lattice structure according to the fourth embodiment.

FIG. 35 is a perspective view showing the connector 70C and the counterpart connector 80C according to the fourth embodiment, and shows a state where the connector 70C and the counterpart connector 80C are not coupled to each other and are spaced apart from each other. FIG. 36 is a perspective view showing the connector 70C and the counterpart connector 80C according to the fourth embodiment, and FIG. 37 is a perspective view of the connector 70C and the counterpart connector 80C as viewed in a direction different from the viewing direction in FIG. 36. FIG. 38 is a plan view showing the connector 70C and the counterpart connector 80C according to the fourth embodiment, and FIG. 39 is a side view of the connector 70C and the counterpart connector 80C.

As shown in FIG. 33 to FIG. 39, in the connector 70C, the center line L of the pin insertion hole 71P is orthogonal to the first plane, that is, the plane parallel to the main direction D and the first inclined direction D21. The center line L of the pin insertion hole 71P is parallel to the second plane, that is, the plane parallel to the main direction D and the second inclined direction D22. This feature is realized, in the connector 70C, by setting the respective relative positions of the first connecting portion 73A and the second connecting portion 73B with respect to the main pipe connecting portion 72, and by setting the direction of the center line L of the pin insertion hole 71P with respect to these connecting portions 72, 73A, 73B.

In the same manner, in the counterpart connector 80C, a center line L of a pin insertion hole 71P is orthogonal to the first counterpart plane, that is, a plane parallel to the main direction D and the first counterpart inclined direction D31. The center line L of a pin insertion hole 71P is parallel to the second counterpart plane, that is, a plane parallel to the main direction D and the second counterpart inclined direction D32. This feature is realized, in the counterpart connector 80C, by setting the respective relative positions of the first connecting portion 83A and the second connecting portion 83B with respect to the main pipe connecting portion 82, and by setting the direction of the center line L of the pin insertion hole 71P with respect to these connecting portions 82, 83A, 83B.

The specific structures of the connector body portion 76, the coupling portion 71, the main pipe connecting portion 72, the inclined pipe connecting portion 73 and the like in the connector 70C and the specific structures of the connector body portion 86, the coupling portion 81, the main pipe connecting portion 82, the inclined pipe connecting portion 83 and the like in the counterpart connector 80C as shown in FIG. 35 to FIG. 39 are substantially equal to those of the first embodiment and the second embodiment, respectively. Accordingly, these parts are given the same symbols as the first embodiment and the second embodiment and the detailed description thereof is omitted. The feature matters of the fourth embodiment among these configurations are simply described hereinafter.

In the same manner as the first and second embodiments, the main pipe connecting portion 72 of the connector 70C according to the fourth embodiment has an end surface 721 (main end surface 721) which an end surface of the main pipe 50 faces. In the fourth embodiment, the first connecting portion 73A of the inclined pipe connecting portions 73 has an end surface 731A (first inclined end surface 731A) which an end surface of the first inclined pipe 601 faces, and the second connecting portion 73B of the inclined pipe connecting portions 73 has an end surface 731B (second inclined end surface 731B) which an end surface of the second inclined pipe 602 faces.

In this embodiment, the main end surface 721, the first inclined end surface 731A and the second inclined end surface 731B are each formed of a flat surface, are not parallel to each other, and are flat surfaces which intersect with each other. The main end surface 721 is a flat surface parallel to the center line L of the pin insertion hole 71P of the connector 70C. The first inclined end surface 731A is a flat surface parallel to the center line L. The second inclined end surface 731B is a flat surface inclined with respect to the center line L. The second inclined end surface 731B is a flat surface not parallel to the center line L and also not orthogonal to the center line L. An angle θ1 (see FIG. 39) formed by the main end surface 721 and the first inclined end surface 731A and an angle θ2 (see FIG. 38) formed by the main end surface 721 and the second inclined end surface 731B are larger than 90° and smaller than 180°, respectively. An angle θ3 (see FIG. 36) formed by the first inclined end surface 731A and the second inclined end surface 731B is also larger than 90° and smaller than 180°.

In the counterpart connector 80C, a main end surface 821 of the main pipe connecting portion 82, and a first inclined end surface 831A and a second inclined end surface 831B of the inclined pipe connecting portions 83 have substantially the same angular relationship as the above-mentioned configuration. That is, each of an angle θ1 formed by the main end surface 821 and the first inclined end surface 831A, an angle θ2 formed by the main end surface 831 and the second inclined end surface 831B, and an angle θ3 formed by the first inclined end surface 831A and the second inclined end surface 831B is larger than 90° and smaller than 180°.

Figure 40:
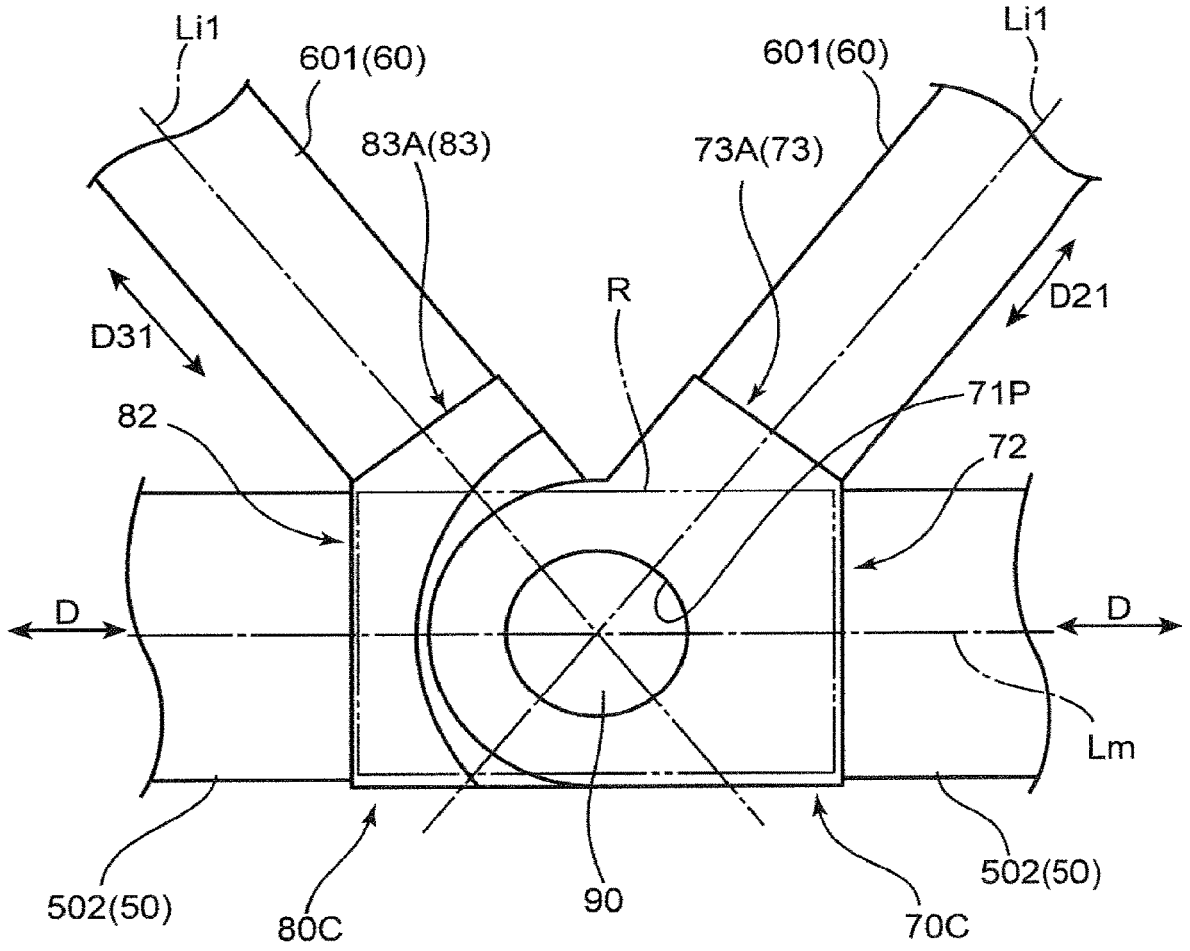
FIG. 40 is a side view showing the region C in an enlarged manner.

The above-mentioned features are described as follows with reference to a center axis line of the pipe. FIG. 40 is a side view showing the region C in FIG. 31 in an enlarged manner, and FIG. 41 is a bottom plan view showing the region C in an enlarged manner.

Figure 41:
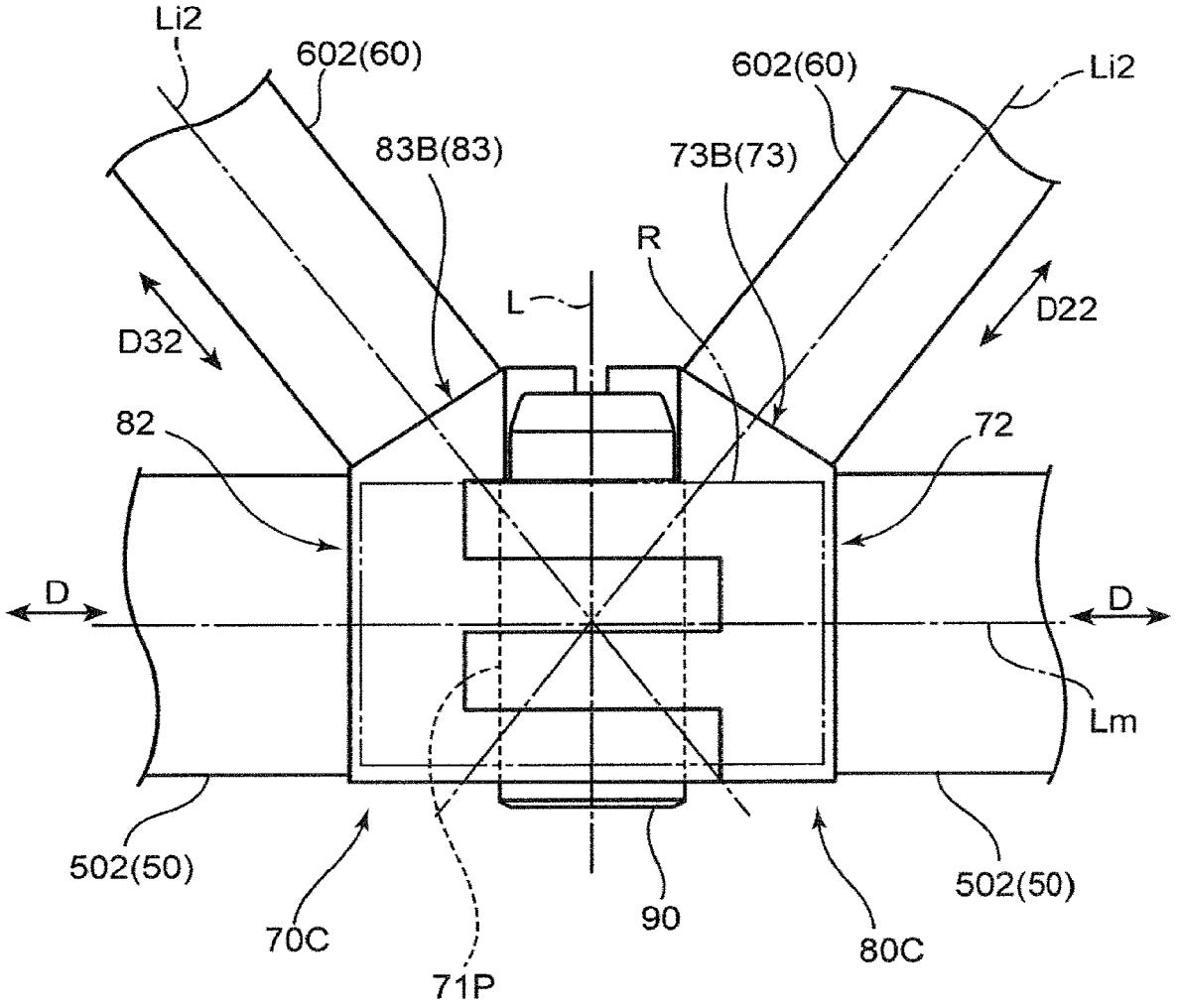
FIG. 41 is a bottom plan view showing the region C in an enlarged manner.

As shown in FIG. 34, FIG. 40 and FIG. 41, a center axis line Lm of the main pipe 50 connected to the connector 70C is orthogonal to the center line L of the pin insertion hole 71P of the connector 70C. A center axis line Li1 of the first inclined pipe 601 connected to the connector 70C is orthogonal to the center line L, and is inclined with respect to the center axis line Lin of the main pipe 50. A center axis line Li2 of the second inclined pipe 602 connected to the connector 70C is inclined with respect to the center line L, and is inclined also with respect to the center axis line Lm of the main pipe 50. A center axis line Lm of the main pipe 50, a center axis line Li1 of the first counterpart inclined pipe 601, and a center axis line Li2 of the second counterpart inclined pipe 602 in the counterpart connector 80C have substantially the same features as in the case of the connector 70C.

As shown in FIG. 40 and FIG. 41, in the lattice structure coupling body 101 according to the fourth embodiment, the positional relationship between the main pipe 50, the inclined pipe 60 and the connector coupling body 100 has the following features.

That is, all of the center axis line Lm of the main pipe 50 connected to the connector 70C, the center axis line Li1 of the first inclined pipe 601 connected to the first connecting portion 73A, and the center axis line Li2 of the second inclined pipe 602 connected to the second connecting portion 73B pass through a region surrounded by a profile of the connector 70C. All of the center axis line Lm of the main pipe 50 connected to the connector 80C, the center axis line Li1 of the first counterpart inclined pipe 601 connected to the first connecting portion 83A, and the center axis line Li2 of the second counterpart inclined pipe 602 connected to the second connecting portion 83B pass through a region surrounded by a profile of the counterpart connector 80C. Thus, it is possible to form the lattice arrangement where the center axis lines Lm, Li1, Li2 of the three pipes 50, 601, 602 are concentrated in the connector 70C in the lattice structure coupling body 101 and, it is also possible to form the lattice arrangement where the center axis lines Lm, Li1, Li2 of three pipes 50, 601, 602 are concentrated in the counterpart connector 80C in the lattice structure coupling body 101.

In the fourth embodiment, all of the center axis line Lm of the main pipe 50, the center axis line Li1 of the first inclined pipe 601, and the center axis line Li2 of the second inclined pipe 602 in the connector 70C pass through at least one of a region surrounded by an inner peripheral surface which defines the pin insertion hole 71P of the connector 70C and a region surrounded by an inner peripheral surface which defines the pin insertion hole 71P of the counterpart connector 80C. In the same manner, the center axis lines Lm, Li1, Li2 in the counterpart connector 80C also pass through at least one of the region surrounded by the inner peripheral surface which defines the pin insertion hole 71P of the connector 70C and the region surrounded by the inner peripheral surface which defines the pin insertion hole 71P of the counterpart connector 80C. Thus, it is possible to form substantially the ideal lattice arrangement where the center axis lines of three pipes connected to the connector 70C and the center axis lines of three pipes connected to the counterpart connector 80C are concentrated in the region surrounded by the inner peripheral surface which defines the pin insertion hole 71P for coupling the connector 70C and the counterpart connector 80C to each other.

Further, both the center axis line Li1 of the first inclined pipe 601 and the center axis line Li2 of the second inclined pipe 602 pass through an overlapping region R. The overlapping region R is a region where at least one of the region surrounded by the profile of the connector 70C and the region surrounded by the profile of the counterpart connector 80C overlaps with a region surrounded by an imaginary plane formed by extending the outer peripheral surface of the main pipe 50 in a direction in which the main pipe 50 extends. In the same manner, the center axis lines Lm, Li1, Li2 in the counterpart connector 80C pass through the overlapping region R. Thus, it is possible to form substantially the ideal lattice arrangement where the center axis lines of three pipes connected to the connector 70C and the center axis lines of three pipes connected to the counterpart connector 80C are concentrated in the overlapping region R.

[Other Modifications]

The present invention is not limited to the above-mentioned embodiments. The present invention includes the following modes, for example.

In the embodiments, by coupling the boom members 16B, 16C to each other using the connectors 70, 80, it is possible to suppress the lowering of a strength of the structure coupling portion and, unlike the conventional technique, it is unnecessary to provide the orthogonal pipes to the end portions of the respective boom members. Accordingly, in the embodiments, the case is exemplified where the orthogonal pipe is not provided to the end portions of the boom members 16B, 16C. However, the present invention does not exclude the configuration in which an orthogonal pipe is provided to the end portion of the lattice structure, and includes the configuration in which the orthogonal pipe is provided to the end portion of the lattice structure. In this case, the lattice structure according to the present invention includes also the connector in addition to the orthogonal pipe and hence, the present invention can acquire an advantageous effect that the structure of the orthogonal pipe can be simplified because of a strength lowering suppressing effect brought about by the connector. Further, in the present invention, the orthogonal pipe and the connector may be used in combination for emphasizing the increase of a strength of the lattice structure.

In the embodiments, the crane is exemplified as the work machine. However, the work machine of the present invention is not limited to the crane, and the present invention is also applicable to other work machines as long as the work machines include a lattice structure.

In the embodiments, the lattice structure is exemplified as a member which forms the boom of the work machine. However, the lattice structure according to the present invention is also applicable to a member which forms the jib 18, the struts 21, 22 and the like of the work machine.

In the embodiments, a case where the base body is the lower traveling body 14 is exemplified. However, the base body is not limited to the lower traveling body 14. The base body may be one which cannot travel on the ground or is fixed to the ground.

In the embodiments, the crane 10 as the work machine includes members such as the jib 18, the mast 20, the struts 21, 22 and the like. However, the present invention is also applicable to a work machine which does not include the members such as the jib 18, the mast 20, the struts 21, 22 and the like.

Further, to the connector 70, end portions of three or more inclined pipes 60 may connected, and to the counterpart connector 80, end portions of three or more inclined pipes 60 may be connected.

Outer diameters of the projections 723, 733, 833, 834 described with reference to FIG. 3, FIG. 6 and the like may be set equal to or larger than the outer diameters of the end portions of the main pipe 50 and the inclined pipe 60. In this case, the end portions of these pipes are disposed so as to abut against the surfaces of the projections, respectively.

The plurality of main pipes 50 which the boom members 16B, 16C according to the embodiments include are disposed such that the axial directions of the main pipes 50 are parallel to each other. However, the present invention is not limited to such a configuration. The main pipe according to the present invention also includes a configuration in which axial directions of at least some main pipes 50 among the plurality of main pipes are not parallel to each other as in the case of the boom members 16A, 16D according to the embodiments. In other words, the main pipe according to the present invention also includes a configuration in which the plurality of main pipes are disposed in a posture that an axial direction of at least one main pipe is inclined with respect to the longitudinal direction of the lattice structure, for example, a configuration in which the entire lattice structure has a pyramid shape or a truncated pyramid shape.

In the embodiments, a mode in which the connector 70 includes a male-type coupling portion 71 and the counterpart connector 80 includes a female-type coupling portion 81 is exemplified. However, the connector 70 may include a female-type coupling portion 71, and the counterpart connector 80 may include a male-type coupling portion 81.

Further, the connector coupling body including the connector according to the present invention is not limited to a connector coupling body where a projection piece of the connector is detachably coupled to the pair of projection pieces of the counterpart connector. That is, the specific structure of the coupling portion of the connector coupling body including the connector according to the present invention is not limited. For example, the coupling portion 71 of the connector 70 and the coupling portion 81 of the connector 80 may have a structure other than the structure using the above-mentioned coupling pin 90.

In the description of the embodiment, the case where the connectors which are included in the range of the connectors of the present invention are coupled to each other is taken as an example. However, the connectors of the present invention are not limited to the mode shown in the embodiments, and may be used in the following mode.

That is, the counterpart connector to which the connector of the present invention is coupled may not always be included in the range of the connector of the present invention. The counterpart connector forms a portion of the counterpart structure, and is coupled to the connector of the present invention which forms the end portion of the lattice structure. In this case, the counterpart structure may not always be the lattice structure, and the counterpart connector which forms a portion of the counterpart structure may not include the inclined pipe connecting portion for connecting the end portion of the inclined pipe thereto. Specific examples are described as follows.

Examples of the counterpart structure include a telescopic boom (a telescopic boom obtained by combining a plurality of booms which differ from each other in cross-sectional size in an extensible and retractable manner). Further, examples of the counterpart structure include a base to which a tower having the lattice arrangement is connected. Neither the telescopic boom nor the base which forms the counterpart structure has a lattice structure. An end portion of the telescopic boom and a portion of the base are formed of a counterpart connector not included in the range of the connector of the present invention.

Even in a case where the connector of the present invention is used for coupling of the connector with the counterpart connector not included in the range of the present invention, the following advantageous effects can be acquired. That is, by exchanging a portion of the connector which a boom of the conventional crane includes with the connector of the present invention, a strength of the exchanged portion can be locally enhanced. By enhancing a strength of the boom in this manner, an ability of suspending a suspended load can be enhanced such as a case where a height of the suspended load can be increased.

As has been described heretofore, it is possible to provide the lattice structure which can suppress the increase of a weight of the lattice structure and the increase of the number of manufacturing man-hours and, at the same time, can suppress also the lowering of a strength at the structure coupling portion where the lattice structures are coupled to each other.

(1) Provided is a lattice structure which is mounted on a work machine, and is detachably coupled to a counterpart lattice structure adjacent to the lattice structure. The lattice structure includes: a plurality of main pipes arranged at an interval in a radial direction; a plurality of inclined pipes extending so as to be inclined with respect to an axial direction of each of the plurality of main pipes, each of the plurality of inclined pipes coupling any two of the plurality of main pipes to each other; and a plurality of connectors detachably coupled to a plurality of counterpart connectors included in the counterpart lattice structure. The plurality of connectors include a predetermined connector to which an end portion of any one of the plurality of main pipes is connected, and to which an end portion of at least one of the plurality of inclined pipes is connected.

According to the lattice structure of the present invention, the predetermined connector is provided and hence, it is possible to suppress the increase of a weight of the lattice structure and the increase of the number of manufacturing man hours and, at the same time, it is also possible to suppress the lowering of a strength and rigidity at the structure coupling portion where the lattice structures are coupled to each other. The specific configurations are as follows. The plurality of connectors in the lattice structure of the present invention include the predetermined connector to which not only main pipe but also the inclined pipe are connected. Accordingly, when the predetermined connector to which the inclined pipe is connected is coupled to the counterpart connector of the counterpart lattice structure, the lattice arrangement can be formed in at least a portion corresponding to the predetermined connector to which the inclined pipe is connected, in the coupling portion where the predetermined connector and the counterpart connector are coupled to each other. Thus, in the coupling portion where the lattice structure of the present invention is used, the lowering of a strength and rigidity can be suppressed compared with a coupling portion where the conventional connector and the conventional counterpart connector are coupled to each other and hence, unlike the conventional technique, it becomes unnecessary to provide the orthogonal pipe to end portions of the respective lattice structures. According to the present invention, it is possible to suppress the increase of a weight of the lattice structure and the increase of the number of manufacturing man hours and, at the same time, it is also possible to suppress the lowering of a strength and rigidity at the structure coupling portion where the lattice structures are coupled to each other.

(2) It is preferable that, in the lattice structure, the plurality of connectors each have a pin insertion hole into which a coupling pin for coupling the connector to the corresponding counterpart connector is inserted, and a position of a portion of the predetermined connector to which the main pipe is connected and a position of a portion of the predetermined connector to which the inclined pipe is connected are respectively set such that center lines of the plurality of pin insertion holes in the plurality of connectors are parallel to each other.

In this mode, it is possible to suppress lowering of workability at the time of assembling the lattice structure coupling body by coupling the lattice structure and the counterpart lattice structure to each other. Specifically, an operation of coupling the lattice structure and the counterpart lattice structure to each other includes a plurality of coupling operations for coupling the plurality of connectors and the plurality of counterpart connectors, respectively. In this mode, the center lines of the plurality of pin insertion holes in the plurality of connectors are parallel to each other. Thus, the plurality of coupling operations can be performed as follows. Hereinafter, the description is made by taking a case where the lattice structure includes four main pipes and the coupling operations are performed at four portions as an example. In this case, out of the coupling operations at four portions, first, the coupling operations at two portions are performed. That is, the coupling between the connector to which the end portion of the first main pipe is connected and the counterpart connector which corresponds to the connector is performed by inserting the coupling pin into the first pin insertion hole, and the coupling between the connector to which the end portion of the second main pipe is connected and the counterpart connector which corresponds to the connector is performed by inserting the coupling pin into the second pin insertion hole. In such a state, the center line of the first pin insertion hole and the center line of the second pin insertion hole are parallel to each other. Thus, the lattice structure can be swung about these center lines with respect to the counterpart lattice structure. Accordingly, the coupling operations at remaining two portions can be easily performed compared to a case where the center lines of the plurality of pin insertion holes are not parallel to each other. That is, an operation of aligning the position of the connector to which the end portion of the third main pipe is connected and the position of the counterpart connector which corresponds to the connector with each other and an operation of aligning the position of the connector to which the end portion of the fourth main pipe is connected and the position of the counterpart connector which corresponds to the connector with each other can be performed while swinging the lattice structure with respect to the counterpart lattice structure about the center lines.

(3) It is preferable that, in the lattice structure, the predetermined connector be a first connector which has a main pipe connecting portion to which an end portion of a first main pipe among the plurality of main pipes is connected, and an inclined pipe connecting portion to which an end portion of a first inclined pipe among the plurality of inclined pipes is connected, the plurality of connectors further include a second connector which has a main pipe connecting portion to which an end portion of a second main pipe among the plurality of main pipes is connected and an inclined pipe connecting portion to which an end portion of a second inclined pipe among the plurality of inclined pipes is connected, and a first plane parallel to a direction in which the first main pipe extends and a direction in which the first inclined pipe extends intersects with a second plane parallel to a direction in which the second main pipe extends and a direction in which the second inclined pipe extends, and a relative position of the inclined pipe connecting portion with respect to the main pipe connecting portion be set in the first connector and a relative position of the inclined pipe connecting portion with respect to the main pipe connecting portion be set in the second connector such that a center line of the pin insertion hole in the first connector is parallel to a center line of the pin insertion hole in the second connector.

In this mode, to each of two connectors among the plurality of connectors in the lattice structure, that is, to each of the first connector and the second connector, the main pipe and the inclined pipe are connected, and each of the plurality of connectors has the pin insertion hole. In this mode, the first inclined pipe is connected to the first connector and the second inclined pipe is connected to the second connector such that the first plane intersects with the second plane. Thus, it is possible to form a stereoscopic lattice arrangement excellent in strength and rigidity in the lattice structure. In a case where the first connector and the second connector have completely the same structure, when the first connector and the second connector are disposed such that the first plane intersects with the second plane, the center lines of the pin insertion holes of the first and second connectors are not parallel to each other. Accordingly, in this mode, a relative position of the inclined pipe connecting portion with respect to the main pipe connecting portion is set in the first connector, and a relative position of the inclined pipe connecting portion with respect to the main pipe connecting portion is set in the second connector such that the center line of the pin insertion hole in the first connector and the center line of the pin insertion hole in the second connector are parallel to each other while forming the stereoscopic lattice arrangement excellent in strength and rigidity. Thus, the lowering of assembling workability at the time of assembling the lattice structure coupling body can be suppressed by coupling the lattice structure and the counterpart lattice structure to each other while suppressing lowering of strength and rigidity of the lattice structure.

(4) It is preferable that, in the lattice structure, the predetermined connector include: a first connecting portion to which the inclined pipe extending in a first inclined direction among the plurality of inclined pipes is connected; and a second connecting portion to which the inclined pipe extending in a second inclined direction among the plurality of inclined pipes is connected.

In this mode, the inclined pipe extending in the first inclined direction can be connected to the first connecting portion in the predetermined connector, and the inclined pipe extending in the second inclined direction can be connected to the second connecting portion in the predetermined connector. That is, in this mode, two inclined pipes are connected to one connector. Thus, it is possible to form a stereoscopic and complicated lattice arrangement excellent in strength and rigidity (for example, a lattice-collective-type lattice arrangement described later).

(5) It is preferable that, in the lattice structure, a relative position between the first connecting portion and the second connecting portion be set such that a plane parallel to a main direction which is a direction in which the main pipe which is connected to the predetermined connector extends and the first inclined direction intersects with a plane parallel to the main direction and the second inclined direction.

In this mode, the plane parallel to the main direction and the first inclined direction intersects with the plane parallel to the main direction and the second inclined direction. That is, the inclined pipe connected to the first connecting portion of the predetermined connector does not extend in a direction parallel to a plane parallel to the main direction and the second inclined direction but extends in the first inclined direction inclined with respect to the plane. Thus, while one end of the inclined pipe connected to the first connecting portion and one end of the inclined pipe connected to the second connecting portion are connected to the same main pipe by way of the predetermined connector, the other ends of these inclined pipes can be connected to the different main pipes, respectively. Thus, it is possible to form a complicated lattice structure.

(6) It is preferable that, in the lattice structure, all of a center axis line of the main pipe connected to the predetermined connector, a center axis line of the inclined pipe connected to the first connecting portion, and a center axis line of the inclined pipe connected to the second connecting portion pass through a region surrounded by a profile of the predetermined connector.

In this mode, all of the center axis lines of three pipes pass through the region surrounded by the profile of the predetermined connector. Thus, it is possible to form a lattice arrangement where center axis lines of the three pipes are concentrated in a portion of the predetermined connector in the lattice structure. In the present invention, the center axis line of the pipe includes a center axis of the pipe and an extension line obtained by extending the center axis.

(7) It is preferable that, in the lattice structure, the predetermined connector has a pin insertion hole into which a coupling pin is inserted, and is configured such that the predetermined connector is coupled to the counterpart connector by inserting the coupling pin into the pin insertion hole and a pin insertion hole formed in the counterpart connector which corresponds to the predetermined connector, and all of a center axis line of the main pipe connected to the predetermined connector, a center axis line of the inclined pipe connected to the first connecting portion, and a center axis line of an inclined pipe connected to the second connecting portion pass through at least one of a region surrounded by an inner peripheral surface which defines the pin insertion hole of the predetermined connector and a region surrounded by an inner peripheral surface which defines the pin insertion hole of the counterpart connector.

In this mode, all of the center axis lines of three pipes pass through at least one of the region surrounded by the inner peripheral surface which defines the pin insertion hole of the predetermined connector and the region surrounded by the inner peripheral surface which defines the pin insertion hole of the counterpart connector. Thus, it is possible to form a substantially ideal lattice arrangement where center axis lines of the three pipes are concentrated in the region surrounded by the inner peripheral surface which defines the pin insertion hole in the lattice structure.

(8) It is preferable that, in the lattice structure, both of a center axis line of the inclined pipe connected to the first connecting portion and a center axis line of the inclined pipe connected to the second connecting portion pass through an overlapping region which is a region where at least one of a region surrounded by a profile of the predetermined connector and a region surrounded by a profile of the counterpart connector which corresponds to the predetermined connector overlaps with a region surrounded by an imaginary plane where an outer peripheral surface of the main pipe connected to the predetermined connector extends in a direction in which the main pipe extends.

In this mode, both the center axis line of the inclined pipe connected to the first connecting portion and the center axis line of the inclined pipe connected to the second connecting portion pass through the overlapping region. Thus, it is possible to form a substantially ideal lattice arrangement where center axis lines of three pipes are concentrated in the overlapping region in the lattice structure.

(9) The lattice structure coupling body of the present invention includes the lattice structure, and the counterpart lattice structure. The counterpart lattice structure further includes: a plurality of counterpart main pipes arranged at an interval in a radial direction; and a plurality of counterpart inclined pipes extending so as to be inclined with respect to an axial direction of each of the plurality of counterpart main pipes, each of the plurality of counterpart inclined pipes coupling any two of the plurality of counterpart main pipes to each other. The plurality of counterpart connectors include a predetermined counterpart connector to which an end portion of any one of the plurality of counterpart main pipes is connected, and to which an end portion of at least one of the plurality of counterpart inclined pipes is connected, the predetermined counterpart connector being detachably coupled to the predetermined connector.

In the lattice structure coupling body of the present invention, the lattice structure and the counterpart lattice structure are coupled to each other using the above-mentioned predetermined connector and the predetermined counterpart connector. Thus, an end portion of the inclined pipe connected to the predetermined connector and an end portion of the counterpart inclined pipe connected to the predetermined counterpart connector can be positioned on the structure coupling portion, that is, on the connector coupling body formed of the predetermined connector and the predetermined counterpart connector, and can be disposed close to each other. Accordingly, in the lattice structure coupling body, configurations similar to the above-mentioned triangular configurations (lattice arrangement) are continued without interruption also in the structure coupling portion and hence, the lowering of a strength and rigidity of the structure coupling portion can be suppressed, and unlike the conventional technique, it becomes unnecessary to provide the orthogonal pipe to the end portions of the respective lattice structures. According to the present invention, it is possible to suppress the increase of a weight of the lattice structure and the increase of the number of manufacturing man hours and, at the same time, it is also possible to suppress the lowering of a strength and rigidity at the structure coupling portion where the lattice structures are coupled to each other.

(10) It is preferable that, in the lattice structure coupling body, as viewed in a side view of the predetermined connector, a center axis line of the main pipe connected to the predetermined connector and a center axis line of the at least one inclined pipe connected to the predetermined connector intersect with each other within a range of the predetermined connector, and as viewed in a side view of the predetermined counterpart connector, a center axis line of the counterpart main pipe connected to the predetermined counterpart connector and a center axis line of the at least one counterpart inclined pipe connected to the predetermined counterpart connector intersect with each other within a range of the predetermined counterpart connector.

For example, as in the case of this mode, by positioning an intersection between the center axis lines of the main pipe and the inclined pipe within the range of the predetermined connector, and by positioning an intersection between the center axis lines of the counterpart main pipe and the counterpart inclined pipe within the range of the predetermined counterpart connector, the configurations similar to the above-mentioned triangular configurations (lattice arrangement) can be continued without interruption in the structure coupling portion.

(11) It is more preferable that, in the lattice structure coupling body, the predetermined connector and the predetermined counterpart connector each have a pin insertion hole into which a coupling pin is inserted, and are configured such that the predetermined connector and the predetermined counterpart connector are coupled to each other by inserting the coupling pin into the pin insertion holes, in a state where the predetermined connector is viewed in an axial direction of the coupling pin, a center axis line of the main pipe connected to the predetermined connector and a center axis line of at least one inclined pipe connected to the predetermined connector intersect with each other within a range of the coupling pin, and in a state where the predetermined counterpart connector is viewed in the axial direction of the coupling pin, a center axis line of the counterpart main pipe connected to the predetermined counterpart connector and a center axis line of the counterpart inclined pipe connected to the predetermined counterpart connector intersect with each other within a range of the coupling pin.

In this mode, both the intersection between the center axis lines of the main pipe and the inclined pipe and the intersection between the center axis lines of the counterpart main pipe and the counterpart inclined pipe are positioned within the range of the coupling pin. Thus, the inclined pipe and the counterpart inclined pipe positioned at the structure coupling portion can form a substantially ideal triangular configuration together with the main pipes. Thus, the lowering of the strength and the rigidity of the structure coupling portion can be further effectively suppressed.

(12) It is more preferable that, in the lattice structure coupling body, in a state where the predetermined connector is viewed in an axial direction of the coupling pin, the center axis line of the main pipe connected to the predetermined connector and the center axis line of the at least one inclined pipe connected to the predetermined connector intersect with each other at a center of the coupling pin, and in a state where the predetermined counterpart connector is viewed in the axial direction of the coupling pin, the center axis line of the counterpart main pipe connected to the predetermined counterpart connector and the center axis line of the at least one inclined pipe connected to the predetermined counterpart connector intersect with each other at the center of the coupling pin.

In this mode, both the intersection between the center axis lines of the main pipe and the inclined pipe and the intersection between the center axis lines of the counterpart main pipe and the counterpart inclined pipe are positioned at the center of the coupling pin. Thus, the inclined pipe and the counterpart inclined pipe positioned at the structure coupling portion can form the ideal triangular configuration together with the main pipes. Accordingly, the lowering of the strength and the rigidity of the structure coupling portion can be further effectively suppressed.

(13) A work machine of the present invention includes: a base body; an upper slewing body slewably mounted on the base body; and a boom swingably mounted on the upper slewing body, the boom having the above-mentioned lattice structure coupling body.

Since the above-mentioned lattice structure coupling body is provided to the boom of the work machine of the present invention and hence, it is possible to suppress the increase of a weight of the work machine and the increase of the number of manufacturing man hours and, at the same time, it is also possible to suppress the lowering of a strength and rigidity at the structure coupling portion where the lattice structures are coupled to each other.

(14) A connector of the present invention is used for the work machine. The connector forms an end portion of a lattice structure which includes: a plurality of main pipes arranged at an interval in a radial direction; and a plurality of inclined pipes extending so as to be inclined with respect to an axial direction of each of the plurality of main pipes, each of the plurality of inclined pipes coupling any two of the plurality of main pipes to each other. The connector is detachably coupled to a counterpart connector included in a counterpart structure adjacent to the lattice structure. The connector includes a coupling portion, a main pipe connecting portion, and an inclined pipe connecting portion. The coupling portion is a portion for coupling the counterpart connector. The main pipe connecting portion is a portion for connecting an end portion of a predetermined main pipe among the plurality of main pipes. The inclined pipe connecting portion is a portion for connecting an end portion of at least one of the plurality of inclined pipes.

The connector of the present invention is used for coupling with the counterpart connector which forms a portion of the counterpart structure. In this case, in the structure coupling portion which is a coupling portion where the connector and the counterpart connector are coupled to each other, the lattice arrangement can be formed in at least a portion corresponding to the connector of the present invention and hence, it is possible to suppress the lowering of the strength and the rigidity of the structure coupling portion compared to the coupling portion where the conventional connectors are coupled to each other.

(15) It is preferable that, in the connector, the counterpart structure be a lattice structure, and the counterpart connector form an end portion of the counterpart structure, and connect an end portion of a counterpart main pipe which forms the counterpart structure and an end portion of a counterpart inclined pipe to each other.

In this mode, by coupling the lattice structures to each other using the connector, both the end portion of the inclined pipe connected to the connector and the end portion of the counterpart inclined pipe connected to the counterpart connector are positioned on the structure coupling portion, that is, on the connector coupling body formed of the connector and the counterpart connector and are disposed close to each other. Accordingly, configurations similar to the above-mentioned triangular configurations (lattice arrangement) are continued without interruption also in the structure coupling portion and hence, the lowering of the strength and the rigidity of the structure coupling portion can be suppressed, and unlike the conventional technique, it becomes unnecessary to provide the orthogonal pipe to the end portions of the respective lattice structures. According to the present invention, it is possible to suppress the increase of a weight of the lattice structure and the increase of the number of manufacturing man hours and, at the same time, it is also possible to suppress the lowering of a strength and rigidity at the structure coupling portion where the lattice structures are coupled to each other.

(16) In the connector, the main pipe connecting portion may include a flat surface which an end surface of the end portion of the predetermined main pipe faces and to which the end portion of the predetermined main pipe is connected, and the inclined pipe connecting portion may include a flat surface which an end surface of the end portion of the at least one inclined pipe faces and to which the end portion of the at least one inclined pipe is connected.

In this mode, in a state where the end surface of the end portion of the predetermined main pipe is made to face the flat surface of the main pipe connecting portion and the end surface of the end portion of the inclined pipe is made to face the flat surface of the inclined pipe connecting portion, the end portion of the predetermined main pipe and the end portion of the inclined pipe can be connected to the main pipe connecting portion and the inclined pipe connecting portion of the connector, respectively, using a joining method such as welding, for example. Accordingly, workability at the time of connecting these pipes is enhanced, and a quality of a connection state can be easily ensured.

(17) In the connector, the main pipe connecting portion may include a spherical surface which an end surface of the end portion of the predetermined main pipe faces and to which the end portion of the predetermined main pipe is connected, and the inclined pipe connecting portion may include a spherical surface which an end surface of the end portion of the at least one inclined pipe faces and to which the end portion of the at least one inclined pipe is connected.

In this mode, in a state where the end surface of the end portion of the predetermined main pipe is made to face the spherical surface of the main pipe connecting portion and the end surface of the end portion of the inclined pipe is made to face the spherical surface of the inclined pipe connecting portion, the end portion of the predetermined main pipe and the end portion of the inclined pipe can be connected to the main pipe connecting portion and the inclined pipe connecting portion of the connector, respectively, using a joining method such as welding, for example. Accordingly, workability at the time of connecting these pipes is enhanced, and a quality of a connection state can be easily ensured.

(18) It is preferable that, in the connector, the coupling portion has a pin insertion hole into which a coupling pin is inserted, and is configured such that the connector and the counterpart connector are coupled to each other by inserting the coupling pin into the pin insertion hole and a pin insertion hole formed in the counterpart connector, and in a state where the connector is viewed in an axial direction of the coupling pin, a center of a sphere including the spherical surface of the main pipe connecting portion and a center of a sphere including the spherical surface of the inclined pipe connecting portion are positioned within a range of the coupling pin.

In this mode, by merely connecting the end portion of the predetermined main pipe and the end portion of the inclined pipe to the main pipe connecting portion and the inclined pipe connecting portion of the connector, respectively, in a state where the end surface of the end portion of the predetermined main pipe is made to face the spherical surface of the main pipe connecting portion and the end surface of the end portion of the inclined pipe is made to face the spherical surface of the inclined pipe connecting portion, an intersection between center axis lines of the predetermined main pipe and the inclined pipe (intersection as viewed in the axial direction of the coupling pin) can be positioned within a range of the coupling pin.

(19) In the connector, in a state where the connector is viewed in an axial direction of the coupling pin, the center of the sphere including the spherical surface of the main pipe connecting portion and the center of the sphere including the spherical surface of the inclined pipe connecting portion are positioned at a center of the coupling pin.

In this mode, as described above, by merely connecting the end portion of the predetermined main pipe and the end portion of the inclined pipe to the main pipe connecting portion and the inclined pipe connecting portion of the connector, respectively, the intersection between the center axis lines of the predetermined main pipe and the first inclined pipe (intersection as viewed in the axial direction of the coupling pin) can be positioned at the center of the coupling pin.

(20) In the connector, the main pipe connecting portion may include a projection or a recess for alignment of the position of the end portion of the predetermined main pipe, and the inclined pipe connecting portion may include a projection or a recess for alignment of the position of the end portion of the at least one inclined pipe.

In this mode, the position alignment can be easily performed at the time of connecting the end portion of the predetermined main pipe and the end portion of the inclined pipe to the main pipe connecting portion and the inclined pipe connecting portion of the connector.

The invention claimed is:

1. A lattice structure which is mounted on a work machine, and is detachably coupled to a counterpart lattice structure adjacent to the lattice structure, the lattice structure comprising:

a plurality of main pipes arranged at an interval in a radial direction;

a plurality of inclined pipes extending so as to be inclined with respect to an axial direction of each of the plurality of main pipes, each of the plurality of inclined pipes coupling any two of the plurality of main pipes to each other; and a plurality of connectors detachably coupled to a plurality of counterpart connectors included in the counterpart lattice structure, wherein the plurality of connectors includes a predetermined connector having a main pipe connecting portion to which an end portion of any one of the plurality of main pipes is connected, and an inclined pipe connecting portion to which an end portion of one of the plurality of inclined pipes is connected, the predetermined connector has a pin insertion hole into which a coupling pin is inserted, and is configured such that the predetermined connector is connected to the counterpart connector by inserting the coupling pin into the pin insertion hole and a pin insertion hole formed in the counterpart connector which corresponds to the predetermined connector, and both a center axis line of the main pipe connected to the main pipe connecting portion and a center axis line of the inclined pipe connected to the inclined pipe connecting portion pass through at least one of a region surrounded by an inner peripheral surface which defines the pin insertion hole of the predetermined connector and a region surrounded by an inner peripheral surface which defines the pin insertion hole of the counterpart connector.

2. The lattice structure according to claim 1, wherein the plurality of connectors each have a pin insertion hole into which a coupling pin for coupling the connector to the corresponding counterpart connector is inserted, and a position of the main pipe connecting portion to which the main pipe is connected and a position of the inclined pipe connecting portion to which the inclined pipe is connected are respectively set such that center lines of the plurality of pin insertion holes in the plurality of connectors are parallel to each other.

3. The lattice structure according to claim 2, wherein the predetermined connector is a first connector which has the main pipe connecting portion to which an end portion of a first main pipe among the plurality of main pipes is connected, and the inclined pipe connecting portion to which an end portion of a first inclined pipe among the plurality of inclined pipes is connected, the plurality of connectors further includes a second connector which has a main pipe connecting portion to which an end portion of a second main pipe among the plurality of main pipes is connected, and an inclined pipe connecting portion to which an end portion of a second inclined pipe among the plurality of inclined pipes is connected, and a first plane parallel to a direction in which the first main pipe extends and a direction in which the first inclined pipe extends intersects with a second plane parallel to a direction in which the second main pipe extends and a direction in which the second inclined pipe extends, and a relative position of the inclined pipe connecting portion with respect to the main pipe connecting portion is set in the first connector and a relative position of the inclined pipe connecting portion with respect to the main pipe connecting portion is set in the second connector such that a center line of the pin insertion hole in the first connector is parallel to a center line of the pin insertion hole in the second connector.

4. The lattice structure according to claim 1, wherein the predetermined connector includes:

a first connecting portion which is the inclined pipe connecting portion and to which the inclined pipe extending in a first inclined direction among the plurality of inclined pipes is connected; and a second connecting portion to which the inclined pipe extending in a second inclined direction among the plurality of inclined pipes is connected.

5. The lattice structure according to claim 4, wherein a relative position between the first connecting portion and the second connecting portion is set such that a plane parallel to a main direction which is a direction in which the main pipe connected to the predetermined connector extends and the first inclined direction intersects with a plane parallel to the main direction and the second inclined direction.

6. The lattice structure according to claim 4, wherein all of the center axis line of the main pipe connected to the predetermined connector, the center axis line of the inclined pipe connected to the first connecting portion, and a center axis line of the inclined pipe connected to the second connecting portion pass through a region surrounded by a profile of the predetermined connector.

7. The lattice structure according to claim 4, wherein both of the center axis line of the inclined pipe connected to the first connecting portion and a center axis line of the inclined pipe connected to the second connecting portion pass through an overlapping region which is a region where at least one of a region surrounded by a profile of the predetermined connector and a region surrounded by a profile of the counterpart connector which corresponds to the predetermined connector overlaps with a region surrounded by an imaginary plane where an outer peripheral surface of the main pipe connected to the predetermined connector extends in a direction in which the main pipe extends.

8. A lattice structure coupling body comprising:

the lattice structure according to claim 1; and the counterpart lattice structure, wherein the counterpart lattice structure further includes:

a plurality of counterpart main pipes arranged at an interval in a radial direction; and a plurality of counterpart inclined pipes extending so as to be inclined with respect to an axial direction of each of the plurality of counterpart main pipes, each of the plurality of counterpart inclined pipes coupling any two of the plurality of counterpart main pipes to each other, and the plurality of counterpart connectors includes a predetermined counterpart connector to which an end portion of any one of the plurality of counterpart main pipes is connected, and to which an end portion of at least one of the plurality of counterpart inclined pipes is connected, the predetermined counterpart connector being detachably coupled to the predetermined connector.

9. The lattice structure coupling body according to claim 8, wherein as viewed in a side view of the predetermined connector, the center axis line of the main pipe connected to the predetermined connector and the center axis line of the inclined pipe connected to the predetermined connector intersect with each other within a range of the predetermined connector, and as viewed in a side view of the predetermined counterpart connector, a center axis line of the counterpart main pipe connected to the predetermined counterpart connector and a center axis line of the at least one counterpart inclined pipe connected to the predetermined counterpart connector intersect with each other within a range of the predetermined counterpart connector.

10. The lattice structure coupling body according to claim 8, wherein in a state where the predetermined connector is viewed in an axial direction of the coupling pin, the center axis line of the main pipe connected to the predetermined connector and the center axis line of the inclined pipe connected to the predetermined connector intersect with each other within a range of the coupling pin, and in a state where the predetermined counterpart connector is viewed in the axial direction of the coupling pin, a center axis line of the counterpart main pipe connected to the predetermined counterpart connector and a center axis line of the at least one counterpart inclined pipe connected to the predetermined counterpart connector intersect with each other within a range of the coupling pin.

11. The lattice structure coupling body according to claim 10, wherein in a state where the predetermined connector is viewed in the axial direction of the coupling pin, the center axis line of the main pipe connected to the predetermined connector and the center axis line of the inclined pipe connected to the predetermined connector intersect with each other at a center of the coupling pin, and in a state where the predetermined counterpart connector is viewed in the axial direction of the coupling pin, the center axis line of the counterpart main pipe connected to the predetermined counterpart connector and the center axis line of the at least one counterpart inclined pipe connected to the predetermined counterpart connector intersect with each other at the center of the coupling pin.

12. A work machine comprising:

a base body;

an upper slewing body slewably mounted on the base body; and a boom swingably mounted on the upper slewing body, the boom having the lattice structure coupling body according to claim 8.

13. A lattice structure which is mounted on a work machine, and is detachably coupled to a counterpart lattice structure adjacent to the lattice structure, the lattice structure comprising:

a plurality of main pipes arranged at an interval in a radial direction;

a plurality of inclined pipes extending so as to be inclined with respect to an axial direction of each of the plurality of main pipes, each of the plurality of inclined pipes coupling any two of the plurality of main pipes to each other; and a plurality of connectors detachably coupled to a plurality of counterpart connectors included in the counterpart lattice structure, wherein the plurality of connectors includes a predetermined connector to which an end portion of any one of the plurality of main pipes is connected, and to which an end portion of at least one of the plurality of inclined pipes is connected, the predetermined connector includes:

a first connecting portion to which the inclined pipe extending in a first inclined direction among the plurality of inclined pipes is connected; and a second connecting portion to which the inclined pipe extending in a second inclined direction among the plurality of inclined pipes is connected, the predetermined connector has a pin insertion hole into which a coupling pin is inserted, and is configured such that the predetermined connector is connected to the counterpart connector by inserting the coupling pin into the pin insertion hole and a pin insertion hole formed in the counterpart connector which corresponds to the predetermined connector, and all of a center axis line of the main pipe connected to the predetermined connector, a center axis line of the inclined pipe connected to the first connecting portion, and a center axis line of an inclined pipe connected to the second connecting portion pass through at least one of a region surrounded by an inner peripheral surface which defines the pin insertion hole of the predetermined connector and a region surrounded by an inner peripheral surface which defines the pin insertion hole of the counterpart connector.

14. A connector used for a work machine and forming an end portion of a lattice structure which includes: a plurality of main pipes arranged at an interval in a radial direction; and a plurality of inclined pipes extending so as to be inclined with respect to an axial direction of each of the plurality of main pipes, each of the plurality of inclined pipes coupling any two of the plurality of main pipes to each other, the connector being detachably coupled to a counterpart connector included in a counterpart structure adjacent to the lattice structure, the connector comprising:

a coupling portion for coupling the counterpart connector;

a main pipe connecting portion for connecting an end portion of a predetermined main pipe among the plurality of main pipes; and an inclined pipe connecting portion for connecting an end portion of at least one of the plurality of inclined pipes, wherein the main pipe connecting portion includes a spherical surface which an end surface of the end portion of the predetermined main pipe faces and to which the end portion of the predetermined main pipe is connected, and the inclined pipe connecting portion includes a spherical surface which an end surface of the end portion of the at least one inclined pipe faces and to which the end portion of the at least one inclined pipe is connected.

15. The connector according to claim 14, wherein the counterpart structure is a lattice structure, and the counterpart connector forms an end portion of the counterpart structure, and connects an end portion of a counterpart main pipe which forms the counterpart structure and an end portion of a counterpart inclined pipe to each other.

16. The connector according to claim 14, wherein the coupling portion has a pin insertion hole into which a coupling pin is inserted, and is configured such that the connector and the counterpart connector are coupled to each other by inserting the coupling pin into the pin insertion hole and a pin insertion hole formed in the counterpart connector, and in a state where the connector is viewed in an axial direction of the coupling pin, a center of a sphere including the spherical surface of the main pipe connecting portion and a center of a sphere including the spherical surface of the inclined pipe connecting portion are positioned within a range of the coupling pin.

17. The connector according to claim 16, wherein in a state where the connector is viewed in the axial direction of the coupling pin, the center of the sphere including the spherical surface of the main pipe connecting portion and the center of the sphere including the spherical surface of the inclined pipe connecting portion are positioned at a center of the coupling pin.

18. The connector according to claim 14, wherein the main pipe connecting portion includes a projection or a recess for alignment of the position of the end portion of the predetermined main pipe, and the inclined pipe connecting portion includes a projection or a recess for alignment of the position of the end portion of the at least one inclined pipe.

* * * * *